US008550464B2

(12) United States Patent
Soltys et al.

(10) Patent No.: US 8,550,464 B2
(45) Date of Patent: Oct. 8, 2013

(54) SYSTEMS, METHODS AND ARTICLES TO FACILITATE PLAYING CARD GAMES WITH SELECTABLE ODDS

(75) Inventors: Richard Soltys, Mercer Island, WA (US); Allen Fleckenstein, Bellevue, WA (US); Richard Huizinga, Mercer Island, WA (US)

(73) Assignee: Bally Gaming, Inc., Las Vegas, NV (US)

( * ) Notice: Subject to any disclaimer, the term of this patent is extended or adjusted under 35 U.S.C. 154(b) by 1649 days.

(21) Appl. No.: 11/428,286

(22) Filed: Jun. 30, 2006

(65) Prior Publication Data

US 2007/0057466 A1 Mar. 15, 2007

Related U.S. Application Data

(60) Provisional application No. 60/716,538, filed on Sep. 12, 2005, provisional application No. 60/802,921, filed on May 23, 2006.

(51) Int. Cl.
*A63F 1/00* (2006.01)

(52) U.S. Cl.
USPC ..... 273/292; 273/149 R; 273/149 P; 463/13

(58) Field of Classification Search
USPC ..... 463/10, 11, 13; 273/149 R, 292, 149 P
See application file for complete search history.

(56) References Cited

U.S. PATENT DOCUMENTS

| | | | | |
|---|---|---|---|---|
| 1,361,202 | A | 12/1920 | Thomas | |
| 1,727,800 | A | 9/1929 | Albert | |
| 1,890,504 | A | 12/1932 | Ferguson, Jr. | |
| 2,567,223 | A | 9/1951 | Maher | |
| 2,663,418 | A | 12/1953 | Grunwald | 206/62 |
| 2,694,662 | A | 11/1954 | Hunter, Jr. | 154/121 |
| 2,731,271 | A | 1/1956 | Brown | |
| 3,222,071 | A | 12/1965 | Lang | 273/149 |
| 3,312,473 | A | 4/1967 | Friedman et al. | 273/149 |

(Continued)

FOREIGN PATENT DOCUMENTS

| | | | |
|---|---|---|---|
| DE | 3807127 | A1 | 9/1989 |
| DE | 44 39 502 | C1 | 9/1995 |

(Continued)

OTHER PUBLICATIONS

U.S. Appl. No. 11/558,409, Soltys, filed Nov. 9, 2006.

(Continued)

*Primary Examiner* — Paul A D'Agostino
*Assistant Examiner* — Brandon Gray
(74) *Attorney, Agent, or Firm* — Frank Abramonte; Fearon Brown; Marvin Hein

(57) ABSTRACT

Playing cards may be selected based on a desired set of payout or house odds and/or house advantage. The playing cards may be placed into, and/or retrieved from, one or more intermediary playing card receivers in a random or pseudo-random order that is based on the selected payout or house odds and/or house advantage. Intermediary playing card receivers may take the form of carousels having an endless array of card receiving compartments. Each compartment may receive a single playing card at a time. The intermediary playing card receivers may pivot bi-directionally about one or more vertical axes. Playing cards may be loaded into one intermediary playing card receivers while being unloaded from the other.

64 Claims, 25 Drawing Sheets

(56) References Cited

U.S. PATENT DOCUMENTS

| | | | | |
|---|---|---|---|---|
| 3,339,223 | A | 9/1967 | Laby | 16/105 |
| 3,377,070 | A | 4/1968 | Nottoli | 273/149 |
| 3,493,728 | A | 2/1970 | Braden et al. | |
| 3,561,756 | A | 2/1971 | Barnett | 271/41 |
| 3,667,759 | A | 6/1972 | Barr | 273/152.1 |
| 3,690,670 | A | 9/1972 | Cassady et al. | 273/149 P |
| 3,735,982 | A | 5/1973 | Gerfin | 273/1 E |
| 3,751,041 | A | 8/1973 | Seifert | 273/149 P |
| 3,752,962 | A | 8/1973 | Greskovics | 235/61.11 |
| 3,766,452 | A | 10/1973 | Burpee et al. | 317/262 R |
| 3,799,553 | A | 3/1974 | Hurley | |
| 3,810,172 | A | 5/1974 | Burpee et al. | 343/5 PD |
| 3,814,436 | A | 6/1974 | Boren | 273/149 P |
| 3,897,954 | A | 8/1975 | Erickson et al. | 273/149 R |
| 3,907,282 | A | 9/1975 | Hunter | 271/233 |
| 3,929,339 | A | 12/1975 | Mattioli | 273/148 A |
| 3,937,311 | A | 2/1976 | Gehrke | 192/45 |
| 3,937,312 | A | 2/1976 | Gehrke | 192/45 |
| 3,942,616 | A | 3/1976 | Elmore | 192/45 |
| 3,966,047 | A | 6/1976 | Steiner | 209/75 |
| 3,972,573 | A | 8/1976 | Marola | 308/217 |
| 3,990,555 | A | 11/1976 | Carullo | 192/45 |
| 3,993,176 | A | 11/1976 | Marola et al. | 192/45 |
| 3,993,177 | A | 11/1976 | Gehrke | 192/45 |
| 3,994,377 | A | 11/1976 | Elmore | 192/45 |
| 4,026,309 | A | 5/1977 | Howard | 133/8 R |
| 4,031,376 | A | 6/1977 | Corkin, Jr. | 235/156 |
| 4,095,795 | A | 6/1978 | Saxton et al. | 273/143 R |
| 4,108,361 | A | 8/1978 | Krause | 235/375 |
| 4,135,663 | A | 1/1979 | Nojiri et al. | 235/463 |
| 4,241,921 | A | 12/1980 | Miller | 273/148 A |
| 4,244,582 | A | 1/1981 | Raees et al. | 273/293 |
| 4,264,074 | A | 4/1981 | Sobajima | 273/149 R |
| 4,283,708 | A | 8/1981 | Lee | 340/146.3 Z |
| 4,310,160 | A | 1/1982 | Willette et al. | 273/149 R |
| 4,339,798 | A | 7/1982 | Hedges et al. | 364/412 |
| 4,373,726 | A | 2/1983 | Churchill et al. | 273/138 A |
| 4,377,285 | A | 3/1983 | Kadlic | 273/148 A |
| 4,448,419 | A | 5/1984 | Telnaes | 273/143 R |
| 4,457,512 | A | 7/1984 | Stevenson | 273/148 |
| 4,475,564 | A | 10/1984 | Koester et al. | 133/8 R |
| 4,482,058 | A | 11/1984 | Steiner | 209/534 |
| 4,497,488 | A | 2/1985 | Plevyak et al. | 273/149 R |
| 4,512,580 | A | 4/1985 | Matviak | 273/148 A |
| 4,517,654 | A | 5/1985 | Carmean | 364/521 |
| 4,531,187 | A | 7/1985 | Uhland | 364/412 |
| 4,531,909 | A | 7/1985 | Takeshita | 432/37 |
| 4,534,562 | A | 8/1985 | Cuff et al. | 273/149 P |
| 4,586,712 | A | 5/1986 | Lorber et al. | 273/149 R |
| 4,636,846 | A | 1/1987 | Villarreal | 358/100 |
| 4,659,082 | A | 4/1987 | Greenberg | 273/149 R |
| 4,662,637 | A | 5/1987 | Pfeiffer | 273/149 P |
| 4,667,959 | A | 5/1987 | Pfeiffer et al. | 273/149 R |
| 4,693,480 | A | 9/1987 | Smith | 273/296 |
| 4,725,079 | A | 2/1988 | Koza et al. | 283/73 |
| 4,728,108 | A | 3/1988 | Neuwahl | 273/296 |
| 4,750,743 | A | 6/1988 | Nicoletti | 273/148 A |
| 4,770,421 | A | 9/1988 | Hoffman | 273/149 R |
| 4,807,884 | A | 2/1989 | Breeding | 273/149 R |
| 4,814,589 | A | 3/1989 | Storch et al. | 235/375 |
| 4,817,528 | A | 4/1989 | Baker | 101/395 |
| 4,822,050 | A | 4/1989 | Normand et al. | 273/149 P |
| 4,832,341 | A | 5/1989 | Muller et al. | 273/139 |
| 4,832,342 | A | 5/1989 | Plevyak et al. | 273/149 R |
| D301,592 | S | 6/1989 | Needler | |
| 4,861,041 | A | 8/1989 | Jones et al. | 273/292 |
| 4,885,700 | A | 12/1989 | Kondziolka et al. | 364/519 |
| 4,889,367 | A | 12/1989 | Miller | 283/88 |
| 4,951,950 | A | 8/1990 | Normand et al. | 273/149 P |
| 4,952,799 | A | 8/1990 | Loewen | |
| 4,969,648 | A | 11/1990 | Hollinger et al. | 273/149 R |
| 4,978,322 | A | 12/1990 | Paulsen | 453/57 |
| 4,995,615 | A | 2/1991 | Cheng | 273/292 |
| 4,998,737 | A | 3/1991 | Lamle | 273/296 |
| 5,000,453 | A | 3/1991 | Stevens et al. | 273/149 R |
| 5,039,102 | A | 8/1991 | Miller | 273/148 R |
| 5,053,612 | A | 10/1991 | Pielemeier et al. | 235/462 |
| 5,067,713 | A | 11/1991 | Soules et al. | 273/149 P |
| 5,096,197 | A | 3/1992 | Embury | 273/149 R |
| 5,110,134 | A | 5/1992 | Laughlin et al. | 273/293 |
| 5,114,153 | A | 5/1992 | Rosenwinkel et al. | 273/292 |
| 5,121,921 | A | 6/1992 | Friedman et al. | 273/149 P |
| 5,157,602 | A | 10/1992 | Fields et al. | 364/412 |
| 5,179,517 | A | 1/1993 | Sarbin et al. | 364/410 |
| 5,186,464 | A | 2/1993 | Lamle | 273/149 R |
| 5,188,363 | A | 2/1993 | Marnell, II et al. | 273/85 CP |
| 5,199,710 | A | 4/1993 | Lamle | 273/149 R |
| 5,216,234 | A | 6/1993 | Bell | 235/494 |
| 5,224,712 | A | 7/1993 | Laughlin et al. | 273/304 |
| 5,240,140 | A | 8/1993 | Huen | 221/13 |
| 5,241,172 | A | 8/1993 | Lugaresi | |
| 5,259,907 | A | 11/1993 | Soules et al. | 156/277 |
| 5,261,667 | A | 11/1993 | Breeding | 273/149 R |
| 5,275,400 | A | 1/1994 | Weingardt et al. | 273/85 CP |
| 5,275,411 | A | 1/1994 | Breeding | 273/149 R |
| 5,283,422 | A | 2/1994 | Storch et al. | 235/375 |
| 5,303,921 | A | 4/1994 | Breeding | 273/149 R |
| 5,312,104 | A | 5/1994 | Miller | 273/148 R |
| 5,317,149 | A | 5/1994 | Uebbing et al. | |
| 5,319,181 | A | 6/1994 | Shellhammer et al. | 235/462 |
| 5,322,295 | A | 6/1994 | Cabot et al. | 273/292 |
| 5,326,104 | A | 7/1994 | Pease et al. | 273/138 A |
| 5,332,219 | A | 7/1994 | Marnell, II et al. | 273/138 A |
| 5,343,028 | A | 8/1994 | Figarella et al. | 235/462 |
| 5,344,146 | A | 9/1994 | Lee | 273/149 R |
| 5,356,145 | A | 10/1994 | Verschoor | 273/149 R |
| 5,361,885 | A | 11/1994 | Modler | 194/214 |
| 5,362,053 | A | 11/1994 | Miller | 273/148 R |
| 5,364,104 | A | 11/1994 | Jones et al. | 273/292 |
| 5,374,061 | A | 12/1994 | Albrecht | 273/149 R |
| 5,381,019 | A | 1/1995 | Sato | 250/556 |
| 5,382,024 | A | 1/1995 | Blaha | 273/149 R |
| 5,386,103 | A | 1/1995 | DeBan et al. | 235/379 |
| 5,393,057 | A | 2/1995 | Marnell, II | 273/85 CP |
| 5,397,133 | A | 3/1995 | Penzias | 273/439 |
| 5,416,308 | A | 5/1995 | Hood et al. | 235/454 |
| 5,417,431 | A | 5/1995 | Gluck | 273/293 |
| 5,431,399 | A | 7/1995 | Kelley | 273/149 P |
| 5,445,377 | A | 8/1995 | Steinbach | 273/149 R |
| 5,470,079 | A | 11/1995 | LeStrange et al. | 273/138 A |
| 5,487,544 | A | 1/1996 | Clapper, Jr. | 273/138 A |
| 5,511,784 | A | 4/1996 | Furry et al. | 273/143 R |
| 5,518,249 | A | 5/1996 | Sines et al. | 273/304 |
| 5,548,110 | A | 8/1996 | Storch et al. | 235/472 |
| 5,575,475 | A | 11/1996 | Steinbach | 273/149 R |
| 5,584,483 | A | 12/1996 | Sines et al. | 273/149 R |
| 5,586,936 | A | 12/1996 | Bennett et al. | 463/25 |
| 5,605,334 | A | 2/1997 | McCrea, Jr. | 273/309 |
| 5,605,504 | A | 2/1997 | Huang | 463/22 |
| 5,613,680 | A | 3/1997 | Groves et al. | 273/138.2 |
| 5,632,483 | A | 5/1997 | Garczynski et al. | 273/148 R |
| 5,636,843 | A | 6/1997 | Roberts | 273/292 |
| 5,643,088 | A | 7/1997 | Vaughn et al. | 463/40 |
| 5,651,548 | A | 7/1997 | French et al. | 273/309 |
| 5,654,050 | A | 8/1997 | Whalen-Shaw | 428/35.7 |
| 5,655,961 | A | 8/1997 | Acres et al. | 463/27 |
| 5,669,816 | A | 9/1997 | Garczynski et al. | 463/12 |
| 5,676,372 | A | 10/1997 | Sines et al. | 273/149 R |
| 5,681,039 | A | 10/1997 | Miller | 273/148 R |
| 5,683,085 | A | 11/1997 | Johnson et al. | 273/149 R |
| 5,685,543 | A | 11/1997 | Garner | 273/148 A |
| 5,690,324 | A | 11/1997 | Otomo et al. | 270/58.02 |
| 5,692,748 | A | 12/1997 | Frisco et al. | 273/149 R |
| 5,695,189 | A | 12/1997 | Breeding et al. | 273/149 R |
| 5,698,839 | A | 12/1997 | Jagielinski et al. | 235/493 |
| 5,699,066 | A | 12/1997 | Marsh et al. | 342/44 |
| 5,707,287 | A | 1/1998 | McCrea, Jr. | 463/27 |
| 5,711,525 | A | 1/1998 | Breeding | 273/292 |
| 5,718,427 | A | 2/1998 | Cranford et al. | 273/149 R |
| 5,720,484 | A | 2/1998 | Hsu | 273/292 |
| 5,722,893 | A | 3/1998 | Hill et al. | 463/47 |
| 5,732,948 | A | 3/1998 | Yoseloff | 273/274 |
| 5,735,525 | A | 4/1998 | McCrea, Jr. | 273/309 |
| 5,743,800 | A | 4/1998 | Huard et al. | |

(56) References Cited

U.S. PATENT DOCUMENTS 5,766,074 A 6/1998 Cannon et al. 463/16
5,769,458 A 6/1998 Carides et al. 283/102
5,770,533 A 6/1998 Franchi 463/42
5,772,505 A 6/1998 Garczynski et al. 463/12
5,779,545 A 7/1998 Berg et al. 463/22
5,779,546 A 7/1998 Meissner et al. 463/25
5,780,831 A 7/1998 Seo et al. 235/462
5,788,573 A 8/1998 Baerlocher et al. 463/16
5,791,988 A 8/1998 Nomi 463/11
5,803,808 A 9/1998 Strisower 463/11
5,803,809 A 9/1998 Yoseloff 463/13
5,823,534 A 10/1998 Banyai 273/269
5,830,064 A 11/1998 Bradish et al. 463/22
5,831,669 A 11/1998 Adrain 348/143
5,842,921 A 12/1998 Mindes et al. 463/16
5,855,515 A 1/1999 Pease et al. 463/27
5,863,249 A 1/1999 Inoue 463/20
5,867,586 A 2/1999 Liang 382/112
5,871,400 A 2/1999 Yfantis 463/22
5,895,048 A 4/1999 Smith, Jr. 273/293
5,911,626 A 6/1999 McCrea, Jr. 463/27
5,919,091 A 7/1999 Bell et al. 463/25
5,934,866 A 8/1999 Redden 414/798.9
5,936,527 A 8/1999 Isaacman et al. 340/572.1
5,941,769 A 8/1999 Order 463/12
5,941,771 A 8/1999 Haste, III 463/17
5,944,310 A 8/1999 Johnson et al. 273/149 R
5,945,654 A 8/1999 Huang 235/449
5,949,050 A 9/1999 Fosbenner et al. 235/449
5,954,654 A 9/1999 Eaton et al. 600/462
5,967,893 A 10/1999 Lawrence et al. 463/10
5,967,894 A 10/1999 Kinoshita et al. 463/13
5,989,122 A 11/1999 Roblejo 463/22
6,010,404 A 1/2000 Walker et al. 463/21
6,019,368 A 2/2000 Sines et al. 273/149 R
6,021,949 A 2/2000 Boiron 235/492
6,039,650 A 3/2000 Hill 463/47
6,042,150 A 3/2000 Daley 283/86
6,062,481 A 5/2000 Storch et al. 235/494
6,062,981 A 5/2000 Luciano, Jr. 463/26
6,066,439 A 5/2000 Nohr et al. 430/347
6,068,258 A 5/2000 Breeding et al. 273/149 R
6,068,552 A 5/2000 Walker et al. 463/21
6,093,103 A 7/2000 McCrea, Jr. 463/27
6,117,009 A 9/2000 Yoseloff 463/20
6,117,012 A 9/2000 McCrea, Jr. 463/27
6,120,588 A 9/2000 Jacobson 106/31.16
6,126,166 A 10/2000 Lorson et al. 273/148 R
6,139,014 A 10/2000 Breeding et al. 273/149 R
6,142,876 A 11/2000 Cumbers 463/25
6,145,838 A 11/2000 White 273/295
6,149,154 A 11/2000 Grauzer et al. 273/149 R
6,152,822 A 11/2000 Herbert 463/22
6,154,131 A 11/2000 Jones, II et al. 340/540
6,159,096 A 12/2000 Yoseloff 463/20
6,161,476 A 12/2000 Yoneoka 101/118
6,166,763 A 12/2000 Rhodes et al. 348/143
6,168,513 B1 1/2001 Souza et al. 453/57
6,186,892 B1 2/2001 Frank et al. 463/19
6,193,607 B1 2/2001 Kay 463/22
6,196,547 B1 3/2001 Pascal et al. 273/292
6,213,877 B1 4/2001 Walker et al. 463/26
6,217,447 B1 4/2001 Lofink et al. 463/12
6,220,959 B1 4/2001 Holmes, Jr. et al. 463/13
6,234,898 B1 5/2001 Belamant et al. 463/25
6,250,632 B1 6/2001 Albrecht 273/149 R
6,254,096 B1 7/2001 Grauzer et al. 273/149 R
6,254,484 B1 7/2001 McCrea, Jr. 463/27
6,267,248 B1 7/2001 Johnson et al. 209/547
6,267,669 B1 7/2001 Luciano, Jr. et al. 463/7
6,267,671 B1 7/2001 Hogan 463/25
6,276,267 B1 8/2001 Yoneoka 101/114
6,293,546 B1 9/2001 Hessing et al. 273/138.2
6,293,864 B1 9/2001 Romero 463/12
6,299,167 B1 10/2001 Sines et al. 273/149 R
6,299,170 B1 10/2001 Yoseloff 273/292
6,299,536 B1 10/2001 Hill 463/47
6,302,790 B1 10/2001 Brossard 463/20
6,312,334 B1 11/2001 Yoseloff 463/25
6,313,871 B1 11/2001 Schubert 348/143
6,315,664 B1 11/2001 Baerlocher et al. 463/21
6,325,373 B1 12/2001 Breeding et al. 273/149 R
6,346,044 B1 2/2002 McCrea, Jr. 463/27
6,350,199 B1 2/2002 Williams et al. 463/16
6,357,746 B1 3/2002 Sadowski 273/148 R
6,361,044 B1 3/2002 Block et al. 273/149 R
6,371,482 B1 4/2002 Hall, Jr. 273/138.1
6,386,973 B1 5/2002 Yoseloff 463/13
6,394,902 B1 5/2002 Glavich et al. 463/20
6,402,142 B1 6/2002 Warren et al. 273/149 R
6,403,908 B2 6/2002 Stardust et al. 209/587
6,406,023 B1 6/2002 Rowe 273/292
6,406,369 B1 6/2002 Baerlocher et al. 463/20
6,409,595 B1 6/2002 Uihlein et al. 463/29
6,413,162 B1 7/2002 Baerlocher et al. 463/20
6,422,670 B1 7/2002 Hedrick et al. 312/223.1
6,425,824 B1 7/2002 Baerlocher et al. 463/16
6,439,425 B1 8/2002 Masek 221/241
6,446,864 B1 9/2002 Kim et al. 235/382
6,457,715 B1 10/2002 Friedman 273/274
6,460,848 B1 10/2002 Soltys et al. 273/149 R
6,464,581 B1 10/2002 Yoseloff 463/20
6,468,156 B1 10/2002 Hughs-Baird et al. 463/25
6,471,208 B2 10/2002 Yoseloff et al. 273/143 R
6,485,366 B1 11/2002 Rowe 463/13
6,502,116 B1 12/2002 Kelly et al. 708/250
6,508,709 B1 1/2003 Karmarkar 463/42
6,514,140 B1 2/2003 Storch 463/25
6,517,435 B2 2/2003 Soltys et al. 463/25
6,517,436 B2 2/2003 Soltys et al. 463/29
6,517,437 B1 2/2003 Wells et al. 463/30
6,520,856 B1 2/2003 Walker et al. 463/21
6,520,857 B2 2/2003 Soltys et al. 463/29
6,527,271 B2 3/2003 Soltys et al. 273/148 R
6,530,836 B2 3/2003 Soltys et al. 463/29
6,530,837 B2 3/2003 Soltys et al. 463/29
6,533,276 B2 3/2003 Soltys et al. 273/148 R
6,533,662 B2 3/2003 Soltys et al. 463/25
6,533,664 B1 3/2003 Crumby 463/42
6,543,770 B1 4/2003 Kaji et al. 273/148 R
6,561,897 B1 5/2003 Bourbour et al. 463/13
6,568,678 B2 5/2003 Breeding et al. 273/149 R
6,579,179 B2 6/2003 Poole et al. 463/25
6,579,180 B2 6/2003 Soltys et al. 463/25
6,579,181 B2 6/2003 Soltys et al. 463/25
6,581,747 B1 6/2003 Charlier et al. 194/214
6,582,301 B2 * 6/2003 Hill 463/11
6,588,750 B1 7/2003 Grauzer et al. 273/149 R
6,588,751 B1 7/2003 Grauzer et al. 273/149 R
6,595,857 B2 7/2003 Soltys et al. 463/29
6,599,185 B1 7/2003 Kaminkow et al. 463/16
6,629,591 B1 10/2003 Griswold et al. 194/205
6,629,889 B2 10/2003 Mothwurf 463/25
6,638,161 B2 10/2003 Soltys et al. 463/12
6,651,981 B2 11/2003 Grauzer et al. 273/149 R
6,651,982 B2 11/2003 Grauzer et al. 273/149 R
6,652,379 B2 11/2003 Soltys et al. 463/22
6,655,684 B2 12/2003 Grauzer et al. 273/149 R
6,656,048 B2 12/2003 Olsen
6,659,460 B2 12/2003 Blaha et al. 273/149 R
6,663,490 B2 12/2003 Soltys et al. 463/25
6,676,127 B2 1/2004 Johnson et al. 273/149 R
6,676,516 B2 1/2004 Baerlocher et al. 463/25
6,676,522 B2 1/2004 Rowe et al. 463/42
6,685,189 B2 2/2004 Cherven
6,685,568 B2 2/2004 Soltys et al. 463/47
6,688,975 B2 2/2004 Baerlocher et al. 463/16
6,688,979 B2 2/2004 Soltys et al. 463/25
6,698,756 B1 3/2004 Baker et al. 273/149 R
6,698,759 B2 3/2004 Webb et al. 273/292
6,712,693 B1 3/2004 Hettinger 463/20
6,712,696 B2 3/2004 Soltys et al. 463/25
6,719,288 B2 4/2004 Hessing et al. 273/149 R
6,726,099 B2 4/2004 Becker et al. 235/380

(56) References Cited

U.S. PATENT DOCUMENTS 6,726,205 B1 4/2004 Purton ..... 273/148 R
6,728,740 B2 4/2004 Kelly et al. ..... 708/250
6,729,956 B2 5/2004 Wolf et al. ..... 463/25
6,729,961 B1 5/2004 Millerschone ..... 463/30
6,736,250 B2 5/2004 Mattice ..... 194/203
6,745,330 B1 6/2004 Maillot ..... 713/200
6,746,330 B2 6/2004 Cannon ..... 463/25
6,752,312 B1 6/2004 Chamberlain et al. ..... 235/375
6,758,751 B2 7/2004 Soltys et al. ..... 463/29
6,817,948 B2 11/2004 Pascal et al. ..... 463/42
6,857,961 B2 2/2005 Soltys et al. ..... 463/47
6,889,979 B2 5/2005 Blaha et al. ..... 273/149 R
6,896,618 B2 5/2005 Benoy et al. ..... 463/25
6,902,481 B2 6/2005 Breckner et al. ..... 463/30
6,912,812 B2 7/2005 Inage ..... 49/409
6,923,719 B2 8/2005 Wolf ..... 463/16
6,925,701 B2 8/2005 Eckstein et al. ..... 29/602.1
6,955,599 B2 10/2005 Bourbour et al. ..... 463/13
6,964,612 B2 11/2005 Soltys et al. ..... 463/47
6,991,540 B2 1/2006 Marlow ..... 463/16
6,991,544 B2 1/2006 Soltys et al. ..... 463/42
7,005,985 B1 2/2006 Steeves ..... 340/572.1
7,011,309 B2 3/2006 Soltys et al. ..... 273/149 R
7,029,009 B2 4/2006 Grauzer et al. ..... 273/149 P
7,036,818 B2 * 5/2006 Grauzer et al. ..... 273/149 R
7,055,823 B2 6/2006 Denkewicz, Jr.
7,073,791 B2 7/2006 Grauzer et al. ..... 273/149 R
7,077,332 B2 7/2006 Verschuur et al. ..... 235/492
7,099,035 B2 8/2006 Brooks et al.
7,103,438 B2 9/2006 Hallowell et al.
7,137,627 B2 11/2006 Grauzer et al. ..... 273/149 R
7,201,656 B2 4/2007 Darder
7,213,812 B2 5/2007 Schubert et al. ..... 273/149 R
7,255,344 B2 8/2007 Grauzer et al. ..... 273/149 R
7,264,241 B2 9/2007 Schubert et al. ..... 273/149 R
7,271,727 B2 9/2007 Steeves ..... 340/572.7
7,291,068 B2 11/2007 Bryant et al. ..... 463/25
7,311,598 B2 12/2007 Kaminkow et al.
7,322,576 B2 1/2008 Grauzer et al. ..... 273/149 R
7,331,520 B2 2/2008 Silva et al.
7,338,044 B2 3/2008 Grauzer et al. ..... 273/149 R
7,341,254 B2 3/2008 Loewenstein et al. ..... 273/292
7,364,510 B2 4/2008 Walker et al.
7,384,044 B2 6/2008 Grauzer et al. ..... 273/149 R
7,404,763 B2 7/2008 Malone et al.
7,404,765 B2 7/2008 Soltys et al. ..... 463/25
7,407,438 B2 8/2008 Schubert et al. ..... 463/22
7,413,191 B2 8/2008 Grauzer et al. ..... 273/149 R
7,427,233 B2 9/2008 Walker et al. ..... 463/16
7,427,234 B2 9/2008 Soltys et al. ..... 463/16
7,427,236 B2 9/2008 Kaminkow et al.
7,438,643 B2 10/2008 Brosnan et al. ..... 463/42
7,500,915 B2 3/2009 Wolf et al. ..... 463/27
7,523,937 B2 4/2009 Fleckenstein ..... 273/149 R
7,525,283 B2 4/2009 Cheng et al. ..... 320/108
7,559,839 B2 7/2009 Bahar
7,578,739 B2 8/2009 Gauselmann ..... 463/27
7,585,217 B2 9/2009 Lutnick et al.
7,611,409 B2 11/2009 Muir et al. ..... 463/29
7,617,151 B2 11/2009 Rowe ..... 705/39
7,684,874 B2 3/2010 Schlottmann et al. ..... 700/9
7,685,516 B2 3/2010 Fischer
7,736,223 B2 6/2010 Pace
7,744,462 B2 6/2010 Grav et al. ..... 463/27
7,753,781 B2 7/2010 Storch
7,753,790 B2 7/2010 Nguyen et al. ..... 463/42
7,770,893 B2 8/2010 Soltys et al. ..... 273/149 R
7,780,525 B2 8/2010 Walker et al. ..... 463/29
7,819,745 B2 10/2010 Cuddy et al.
7,824,267 B2 11/2010 Cannon et al. ..... 463/42
7,846,020 B2 12/2010 Walker et al.
7,850,528 B2 12/2010 Wells
7,857,702 B2 12/2010 Hilbert
7,901,294 B2 3/2011 Walker et al.
8,062,121 B2 11/2011 Crivelli
1,034,402 A1 7/2012 Hardy
2001/0016515 A1 8/2001 Oliver ..... 463/25
2002/0024179 A1 2/2002 Chida ..... 273/307
2002/0063389 A1 5/2002 Breeding et al. ..... 273/292
2002/0142844 A1 10/2002 Kerr
2002/0142846 A1 10/2002 Paulsen ..... 463/43
2002/0147042 A1 10/2002 Vuong et al. ..... 463/40
2002/0163125 A1 11/2002 Grauzer et al. ..... 273/149 R
2002/0187821 A1 12/2002 Soltys et al. ..... 463/11
2003/0022714 A1 1/2003 Oliver ..... 463/25
2003/0032474 A1 2/2003 Kaminkow ..... 463/25
2003/0036425 A1 2/2003 Kaminkow et al. ..... 463/25
2003/0064774 A1 4/2003 Fujimoto et al. ..... 463/16
2003/0078789 A1 4/2003 Oren ..... 705/1
2003/0083126 A1 5/2003 Paulsen ..... 463/25
2003/0090059 A1 5/2003 Grauzer et al. ..... 273/149 R
2003/0090064 A1 5/2003 Hoyt et al. ..... 273/292
2003/0176209 A1 9/2003 Soltys et al. ..... 463/13
2003/0195037 A1 10/2003 Vuong et al. ..... 463/29
2003/0232651 A1 12/2003 Huard et al. ..... 463/42
2004/0002379 A1 1/2004 Parrott et al. ..... 463/29
2004/0005920 A1 1/2004 Soltys et al. ..... 463/25
2004/0033095 A1 2/2004 Saffari et al. ..... 400/120.01
2004/0043815 A1 3/2004 Kaminkow ..... 463/25
2004/0067789 A1 4/2004 Grauzer et al. ..... 463/11
2004/0068654 A1 4/2004 Cockerille et al. ..... 713/168
2004/0087375 A1 5/2004 Gelinotte ..... 463/47
2004/0100026 A1 5/2004 Haggard ..... 273/304
2004/0108255 A1 6/2004 Johnson ..... 209/547
2004/0108654 A1 6/2004 Grauzer et al. ..... 273/148 R
2004/0132529 A1 7/2004 Mkrtchyan et al. ..... 463/29
2004/0150702 A1 8/2004 Tsuyoshi et al. ..... 347/100
2004/0169332 A1 9/2004 Grauzer et al. ..... 273/149 R
2004/0207156 A1 10/2004 Soltys et al. ..... 273/292
2004/0224777 A1 11/2004 Smith et al. ..... 463/47
2004/0229682 A1 11/2004 Gelinotte ..... 463/25
2004/0259618 A1 12/2004 Soltys et al. ..... 463/11
2005/0012270 A1 1/2005 Schubert et al. ..... 273/149 R
2005/0023752 A1 2/2005 Grauzer et al. ..... 273/149 R
2005/0026680 A1 2/2005 Gururajan ..... 463/25
2005/0026681 A1 2/2005 Grauzer et al. ..... 463/29
2005/0026682 A1 2/2005 Grauzer et al. ..... 463/29
2005/0040594 A1 2/2005 Krenn et al. ..... 273/149 R
2005/0043094 A1 2/2005 Nguyen et al. ..... 463/42
2005/0051955 A1 3/2005 Schubert et al. ..... 273/149 R
2005/0051965 A1 3/2005 Gururajan ..... 273/292
2005/0054408 A1 3/2005 Steil et al. ..... 463/11
2005/0059479 A1 3/2005 Soltys et al. ..... 463/29
2005/0062226 A1 3/2005 Schubert et al. ..... 273/149 R
2005/0062227 A1 3/2005 Grauzer et al. ..... 273/149 R
2005/0070358 A1 3/2005 Angell et al. ..... 463/39
2005/0073102 A1 4/2005 Yoseloff et al. ..... 273/292
2005/0093230 A1 5/2005 Grauzer et al. ..... 273/149 R
2005/0093231 A1 * 5/2005 Grauzer et al. ..... 273/149 R
2005/0098951 A1 5/2005 Groves ..... 273/292
2005/0101367 A1 5/2005 Soltys et al. ..... 463/12
2005/0110210 A1 * 5/2005 Soltys et al. ..... 273/149 P
2005/0121852 A1 6/2005 Soltys et al. ..... 273/149 P
2005/0137005 A1 6/2005 Soltys et al. ..... 463/13
2005/0156318 A1 7/2005 Douglas ..... 257/761
2005/0164761 A1 7/2005 Tain ..... 463/13
2005/0215311 A1 9/2005 Hornik et al. ..... 463/20
2005/0239542 A1 10/2005 Olsen ..... 463/27
2005/0282614 A1 12/2005 Gauselmann
2005/0282626 A1 12/2005 Manfredi et al. ..... 463/25
2005/0288083 A1 12/2005 Downs, III ..... 463/11
2005/0288084 A1 12/2005 Schubert ..... 463/11
2005/0288085 A1 12/2005 Schubert et al. ..... 463/11
2006/0001217 A1 1/2006 Soltys et al. ..... 273/292
2006/0019745 A1 1/2006 Benbrahim ..... 463/29
2006/0046849 A1 3/2006 Kovacs ..... 463/39
2006/0181026 A1 8/2006 Wong
2006/0205508 A1 9/2006 Green ..... 463/40
2006/0205519 A1 9/2006 Soltys ..... 463/47
2006/0247013 A1 11/2006 Walker et al. ..... 463/20
2007/0015583 A1 1/2007 Tran ..... 463/40
2007/0032288 A1 2/2007 Nelson et al.
2007/0057462 A1 3/2007 Fleckenstein ..... 273/274
2007/0057466 A1 3/2007 Soltys et al. ..... 273/292

(56) References Cited

U.S. PATENT DOCUMENTS

| | | | | |
|---|---|---|---|---|
| 2007/0057469 | A1 | 3/2007 | Grauzer et al. | 273/309 |
| 2007/0060365 | A1 | 3/2007 | Tien et al. | 463/42 |
| 2007/0077990 | A1 | 4/2007 | Cuddy et al. | 463/25 |
| 2007/0093298 | A1 | 4/2007 | Brunet | 463/42 |
| 2007/0111775 | A1 | 5/2007 | Yoseloff | 463/16 |
| 2007/0117608 | A1 | 5/2007 | Roper et al. | 463/16 |
| 2007/0168251 | A1 | 7/2007 | Hilbert et al. | 705/14 |
| 2007/0198418 | A1 | 8/2007 | MacDonald et al. | 705/52 |
| 2007/0208816 | A1 | 9/2007 | Baldwin et al. | 709/206 |
| 2007/0235521 | A1 | 10/2007 | Mateen et al. | 235/379 |
| 2007/0241498 | A1 | 10/2007 | Soltys | 273/149 R |
| 2007/0259711 | A1 | 11/2007 | Thomas | 463/22 |
| 2007/0287535 | A1 | 12/2007 | Soltys | 463/29 |
| 2007/0298865 | A1 | 12/2007 | Soltys | 463/22 |
| 2007/0298868 | A1 | 12/2007 | Soltys | 463/25 |
| 2008/0004108 | A1 | 1/2008 | Klinkhammer | |
| 2008/0026832 | A1 | 1/2008 | Stevens et al. | |
| 2008/0026848 | A1 | 1/2008 | Byng | |
| 2008/0038035 | A1 | 2/2008 | Shuldman et al. | |
| 2008/0045341 | A1 | 2/2008 | Englman | |
| 2008/0090651 | A1 | 4/2008 | Baerlocher | 463/27 |
| 2008/0113704 | A1 | 5/2008 | Jackson | 463/13 |
| 2008/0113764 | A1 | 5/2008 | Soltys | 463/22 |
| 2008/0113773 | A1 | 5/2008 | Johnson et al. | 463/25 |
| 2008/0113781 | A1 | 5/2008 | Soltys et al. | 463/28 |
| 2008/0119284 | A1 | 5/2008 | Luciano, Jr. et al. | 463/42 |
| 2008/0171588 | A1 | 7/2008 | Atashband | 463/20 |
| 2008/0287185 | A1 | 11/2008 | Yoseloff et al. | |
| 2008/0311971 | A1 | 12/2008 | Dean | |
| 2008/0318671 | A1 | 12/2008 | Rowe et al. | |
| 2009/0005176 | A1 | 1/2009 | Morrow et al. | 463/43 |
| 2009/0011833 | A1 | 1/2009 | Seelig et al. | |
| 2009/0075739 | A1 | 3/2009 | Richardson | |
| 2009/0115133 | A1 | 5/2009 | Kelly et al. | 273/274 |
| 2009/0117994 | A1 | 5/2009 | Kelly et al. | 463/25 |
| 2009/0118001 | A1 | 5/2009 | Kelly et al. | 463/29 |
| 2009/0118005 | A1 | 5/2009 | Kelly et al. | 463/31 |
| 2009/0118006 | A1 | 5/2009 | Kelly et al. | 463/31 |
| 2009/0163279 | A1 | 6/2009 | Hermansen et al. | 463/42 |
| 2009/0170594 | A1 | 7/2009 | Delaney et al. | 463/25 |
| 2009/0176556 | A1 | 7/2009 | Gagner et al. | |
| 2009/0253483 | A1 | 10/2009 | Pacey et al. | |
| 2009/0270170 | A1 | 10/2009 | Patton | 463/36 |
| 2009/0275393 | A1 | 11/2009 | Kisenwether et al. | 463/25 |
| 2009/0275402 | A1 | 11/2009 | Backover et al. | 463/29 |
| 2009/0275411 | A1 | 11/2009 | Kisenwether et al. | 463/42 |
| 2009/0307069 | A1 | 12/2009 | Meyerhofer | |
| 2010/0016068 | A1 | 1/2010 | White et al. | 463/25 |
| 2010/0113125 | A1 | 5/2010 | Bernard et al. | 463/20 |
| 2010/0125851 | A1 | 5/2010 | Singh et al. | |
| 2011/0009184 | A1 | 1/2011 | Byng | |

FOREIGN PATENT DOCUMENTS

| | | | |
|---|---|---|---|
| DE | 197 48 930 | A1 | 5/1998 |
| EP | 0 327 069 | A2 | 8/1989 |
| EP | 0 790 848 | | 8/1997 |
| EP | 0 700 980 | B1 | 11/1999 |
| EP | 1 291 045 | A2 | 3/2003 |
| EP | 1463008 | A2 | 9/2004 |
| FR | 530732 | | 12/1921 |
| FR | 24238 | | 3/1922 |
| FR | 2 775 196 | | 8/1999 |
| GB | 2 246 520 | A | 2/1992 |
| GB | 2 370 791 | A | 7/2002 |
| GB | 2 380 143 | A | 4/2003 |
| GB | 2 382 034 | A | 5/2003 |
| JP | 8255059 | | 10/1996 |
| KR | 20-0335819 | Y1 | 12/2003 |
| WO | 96/14115 | A1 | 5/1996 |
| WO | WO 96/36253 | | 11/1996 |
| WO | 97/36658 | A1 | 10/1997 |
| WO | WO 99/43403 | | 9/1999 |
| WO | WO 02/05914 | A1 | 1/2002 |
| WO | 2002-0061793 | | 7/2002 |
| WO | WO 02/051512 | A2 | 7/2002 |
| WO | WO 03/004116 | A1 | 1/2003 |
| WO | WO 03/060846 | A2 | 7/2003 |
| WO | 2005/035084 | | 4/2005 |
| WO | WO 2006/039308 | A2 | 4/2006 |
| WO | 2006/110348 | | 10/2006 |
| WO | 03/006928 | A1 | 12/2012 |

OTHER PUBLICATIONS

English Translation of German Patent No. DE 197 48 930, publication dated of May 14, 1998, inventor: Markeev.

Beijing Hope Electronic Press, www.bhp.com.cn, 232 pages.

Chemical Industry Press, 280 pages.

U.S. Appl. No. 12/112,410, McMahan et al., Apr. 30, 2008.

U.S. Appl. No. 12/112,554, Nelson et al., Apr. 30, 2008.

U.S. Appl. No. 12/112,928, Young et al., Apr. 30, 2008.

U.S. Appl. No. 12/113,005, McAllister et al., Apr. 30, 2008.

U.S. Appl. No. 12/113,021, Singh et al., Apr. 30, 2008.

Humble, L., *The World's Greatest Blackjack Book*, Random House, Inc., New York, 1987, p. 182.

Bulaysky, J., "Tracking the Tables," *Casino Journal*, May 2004, pp. 44-47, accessed Dec. 21, 2005, URL = http://www.ascendgaming.com/cj/vendors_manufacturers_table/Trackin916200411141AM.htm, 5 pages.

Burke, A., "Tracking the Tables," reprinted from *International Gaming & Wagering Business*, Aug. 2003, 4 pages.

Griffin, P., *The Theory of Blackjack*, GBC Press, Las Vegas, Nevada, 1979, 190 pages.

Gros, R., "All You Ever Wanted to Know About Table Games," reprinted from *Global Gaming Business*, Aug. 1, 2003, 2 pages.

Pro, L.V., "Book Review—The Card Counter's Guide to Casino Surveillance," *Blackjack Insider Newsletter*, May 2003, #40, accessed Aug. 25, 2006, URL = http:/bjinsider.com/newsletter_40_surveillance.shtml, 5 pages.

Scarne, J., *Scarne's Encyclopedia of Games*, Harper & Row, New York, 1973, p. 153.

Scarne, J., *Scarne's New Complete Guide to Gambling*, Simon & Schuster, Inc., New York, 1974, pp. 358-359.

Snyder, A., "The High-Tech Eye," excerpt from *Blackjack Forum*, Spring 1997, accessed Dec. 21, 2005, from Casino Software & Services, LLC, URL = http://www.casinosoftware.com/bj_forum.html.

Terdiman, D., "Who's Holding the Aces Now?", reprinted from *Wired News*, Aug. 18, 2003, 2 pages.

Ward, K., "BJ Tracking System has Players Down for the Count," *Gaming Today*, Mar. 5, 2002, accessed Dec. 21, 2005, from Casino Software & Services, LLC, URL = http://www.casinosoftware.com/gaming_today.html.

Winkler, C., "Product Spotlight: MindPlay," reprinted from *Gaming and Leisure Technology*, Fall 2003, 2 pages.

Bally TMS, "MP21—Automated Table Tracking/Features," 2 pages, Nov. 2005.

Bally TMS, "MPBacc—Intelligent Table Tracking/Features," 2 pages, Nov. 2005.

Bally TMS, "MPBacc—Specifications/Specifications," 2 pages, Nov. 2005.

Bravo Gaming Systems, "Casino Table Wager Analysis and Player Tracking System—Table Operations/Unique Features," accessed Apr. 11, 2005, URL = http://www.genesisgaming.com, 4 pages.

Casino Software & Services, LLC., accessed Aug. 25, 2006, URL = http:/casinosoftware.com/home.html, 6 pages.

International Guild of Hospitality & Restaurant Managers, "Shuffle Master, Inc. (NasdaqNM:SHFL)," accessed Dec. 30, 2003, URL = http://hospitalityguide.com/Financial/Casinos/Shuffle.htm, 3 pages.

Mikohn, "Mikohn Tablelink—The Industry's Premier Table Tracking Solution Delivers Improvements Straight to the Bottom Line," 2 pages, before Jan. 1, 2004.

Mikohn, "Tablelink™, The New Standard in Table Games," before Jan. 1, 2004, 14 pages.

Plaintiff's Declaration of Lawrence Luciano in Opposition to Shuffle Master's Motion for Preliminary Injunction, *Card, LLC* v. *Shuffle Master, Inc.*, D. Nev. (No. CV-N-03-0244-ECR-(RAM)), Nov. 24, 2003.

(56) References Cited

OTHER PUBLICATIONS

Shuffle Master, Inc., "Shuffle Master Announces New Products; Intelligent Table System to Be Debuted at G2E," Sep. 10, 2003, 2 pages.
Shuffle Master, Inc., "Shuffle Master Gaming Presents the Ultimate Player Rating System . . . Bloodhound Sniffs Out the Pros and Cons," Dec. 31, 1997, 6 pages.
Bally TMS, "MPLite—Table Management System/Features," 2 pages, Nov. 2005.
MagTek, "Port Powered Swipe Reader," Technical Reference Manual, Manual Part No. 99875094 Rev 12, Jun. 2003, 20 pages.
U.S. Appl. No. 10/885,875, filed Jul. 7, 2004, Soltys et al.
U.S. Appl. No. 10/902,436, filed Jul. 29, 2004, Soltys et al.
U.S. Appl. No. 10/962,166, filed Oct. 8, 2004, Soltys et al.
U.S. Appl. No. 11/059,743, filed Feb. 16, 2005, Soltys et al.
U.S. Appl. No. 11/112,793, filed Apr. 21, 2005, Soltys et al.
U.S. Appl. No. 11/337,375, filed Jan. 23, 2006, Soltys et al.
U.S. Appl. No. 11/352,416, filed Feb. 10, 2006, Soltys.
U.S. Appl. No. 11/428,240, filed Jun. 30, 2006, Fleckenstein.
U.S. Appl. No. 11/428,244, filed Jun. 30, 2006, Soltys.
U.S. Appl. No. 11/428,249, filed Jun. 30, 2006, Fleckenstein.
U.S. Appl. No. 11/428,253, filed Jun. 30, 2006, Fleckenstein.
U.S. Appl. No. 11/428,258, filed Jun. 30, 2006, Fleckenstein.
U.S. Appl. No. 11/428,264, filed Jun. 30, 2006, Soltys.
U.S. Appl. No. 11/437,590, filed May 19, 2006, Soltys et al.
U.S. Appl. No. 11/478,360, filed Jun. 29, 2006, Fleckenstein.
U.S. Appl. No. 11/479,930, filed Jun. 30, 2006, Soltys et al.
U.S. Appl. No. 11/479,963, filed Jun. 29, 2006, Fleckenstein.
U.S. Appl. No. 11/479,991, filed Jun. 29, 2006, Soltys.

* cited by examiner

SYSTEMS, METHODS AND ARTICLES TO FACILITATE PLAYING CARD GAMES WITH SELECTABLE ODDS

CROSS-REFERENCES TO RELATED APPLICATIONS

This application claims priority under 35 U.S.C. §119(e) from U.S. Provisional Patent Application Ser. Nos. 60/716,538, filed Sep. 12, 2005 and 60/802,921, filed May 23, 2006.

BACKGROUND

1. Field

This description generally relates to the field of table gaming, and more particularly to games played with playing cards.

2. Description of the Related Art

There are numerous games played with playing cards. For example, blackjack, baccarat, various types of poker, LET IT RIDE®, and/or UNO®, to name a few. Games may be played with one or more standard decks of playing cards. A standard deck of playing cards typically comprises fifty-two playing cards, each playing card having a combination of a rank symbol and a suit symbol, selected from thirteen rank symbols (i.e., 2, 3, 4, 5, 6, 7, 8, 9, 10, J, Q, K, and A) and four suit symbols (i.e., ♥, ♣, ♦, and ♠). Some games may include non-standard playing cards, for example playing cards with symbols other than the rank and suit symbols associated with a standard deck, such as those used in the game marketed under the brand UNO® by Mattel.

In some instances playing card games involve wagering, where money and/or prizes may be won. In other instances playing card games are played for fun or recreation without wagering. In either case, it is typically desirable to randomize the set of playing cards before dealing the playing cards to the participants (e.g., players and/or dealer). Randomizing is typically referred to as shuffling, which may be performed manually by riffling or interleaving the corners of two stacks of playing cards by hand, or may be performed automatically by an automatic card shuffling machine.

While there may exist variation from casino-to-casino, playing card games typically have a fixed set of theoretical or "true" odds associated with them. The theoretical or true odds are reflected in the schedule of payout or "house" odds associated with the game, and typically provide for a house edge or advantage (e.g., theoretical hold). Many casinos set a house advantage or theoretical hold of at least 0.5%, which means that the house would likely earn 0.5% of every dollar wagered for the particular game over the long term. The house advantage may be as high as 30%, for example for the game Let-It-Ride®.

A casino may, for example, provide a schedule of payout or house odds for blackjack. A typical house odds schedule may provide for a 1:1 or "even money" payout for all winning bets with the exception of blackjack (i.e., initial two cards dealt to player have a total value of twenty-one). A blackjack may be paid at 3:1, unless the dealer also has a blackjack which is typically considered a tie (i.e., push) and no money is exchanged. The theoretical or true odds reflect the statistical probabilities of the occurrence of certain events over a large number of attempts or trials.

The casino typically has a house advantage due to a difference between the theoretical or true odds and the payout or house odds. The casino may achieve a higher house advantage due to specific rules of the game. For example, under most blackjack rules the dealer selects hit cards only after all of the players have completed their hands. This provides the opportunity for the players to draw hands with a value exceeding twenty-one (i.e., bust) and lose, without the dealer having to take any hit cards. Thus, the dealer avoids the possibility of busting, and losing to a player that has already gone bust. Consequently, the house enjoys a further advantage over the true odds of the game. The casino may obtain a further house advantage by setting the rules with respect to when the dealer must take additional playing cards (e.g., stand on hand with value of a hard or soft 17 points, hit on 16 points, etc.). The casino may obtain a further house advantage by selecting the total number of decks from which the card game will be dealt. Thus, while the basic rules determine the theoretical or true odds of the game, variations in the rules as well as the house odds may effect the house advantage.

At least in blackjack, the theoretical true odds reflect the probability of certain outcomes over a large number of hands, predicated on "perfect play" by a player. Typically, players cannot play perfectly, and may make decisions (e.g., hit or stand, split, double down) that do not accord with the decision that would provide the highest probability of winning (e.g., "basic" strategy). This provides a further advantage to the casino or house. Some players adopt various playing strategies to obtain or to try to exceed the theoretical odds. Some of these strategies are legal, some illegal, and some while legal, are discouraged by certain gaming establishments. For example, a player may play basic strategy as outlined in numerous references on gaming. Some players may tracking the playing cards that appear on the gaming table using various card counting strategies (e.g., fives count, tens count), also outlined in numerous references on gaming. This may allow the player to adjust the amount of wagers based on whether the cards remaining to be dealt are thought to be favorable or unfavorable. For example, a set or "deck" having a relatively high percentage of playing cards with a value of ten is typically considered favorable to the dealer, while a relatively low percentage of playing cards with values of 2-8 is typically considered favorable to the player.

Casinos and other gaming establishments are continually looking for ways to make gaming fresher and more exciting for their patrons. For example, many casinos offer the ability to place bonus wagers and/or progressive wagers. New approaches to varying existing card games are highly desirable.

BRIEF SUMMARY

In one embodiment, a gaming system comprises an input device operable to receive selections indicative of at least one of a set of house odds or a house advantage for at least one hand to be played by at least one player of a card game; and a playing card handling system comprising a playing card input receiver, a playing card output receiver, at least one playing card transport path between the playing card input receiver and the playing card output receiver, and at least a first intermediary playing card receiver interposed in the at least one playing card transport path between the playing card input receiver and the playing card output receiver, the first intermediary playing card receiver having a plurality of playing card receiving receptacles, the playing card handling system responsive to the selections received at the input device to provide the at least one hand of playing cards, where the playing cards forming the at least one hand correspond to at least one set of virtual playing card values pseudo-randomly generated based at least in part on the received selections indicative of the at least one of the set of house odds or the house advantage.

In another embodiment, a method of operating a gaming system comprises receiving selections indicative of at least one of a set of house odds or a house advantage for at least one hand to be played by at least one player of a card game; and controlling transport of a plurality of playing cards with respect to at least one intermediary playing card receiver comprising a plurality of playing card receiving compartments to provide the at least one hand of playing cards, where the playing cards forming the at least one hand correspond to a set of virtual playing card values pseudo-randomly generated at least in part based on the received selection indicative of at least one of the set of house odds or the house advantage.

In another embodiment, a computer-readable medium stores instructions that causes a computer to operate a gaming system, by: receiving selections indicative of at least one of a set of house odds or a house advantage for at least one hand to be played by at least one player of a card game; and controlling transport of a plurality of playing cards with respect to at least one intermediary playing card receiver comprising a plurality of playing card receiving compartments to provide the at least one hand of playing cards, where the playing cards forming the at least one hand correspond to a set of virtual playing card values pseudo-randomly generated at least in part based on the received selection indicative of at least one of the set of house odds or the house advantage.

In another embodiment, a playing card handling system comprises a playing card input receiver sized and dimensioned to receive a plurality of collected playing cards; a playing card output receiver sized and dimensioned to receive a plurality of randomized playing cards; at least a first playing card transport path extending between the playing card input receiver and the playing card output receiver; and a first intermediary playing card receiver interposed in the first playing card transport path between the playing card input receiver and the playing card output receiver, the first intermediary playing card receiver selectively removable from the first playing card transport path.

In another embodiment, a method of operating a playing card handling system comprises loading playing cards into card receiving compartments of a first intermediary playing card receiver; selectively interposing the first intermediary playing card receiver in a first playing card transport path between a playing card input receiver and a playing card output receiver; and activating the playing card handling system to provide randomized playing cards to the playing card output receiver.

In one embodiment, a playing card handling system comprises a playing card input receiver; a playing card output receiver; at least one playing card transport path extending between the playing card input receiver and the playing card output receiver; a first intermediary playing card receiver disposed between the playing card input receiver and the playing card output receiver in the at least one playing card transport path, the first intermediary playing card receiver comprising a plurality of playing card receiving compartments, the plurality of playing card receiving compartments of the first intermediary playing card receiver physically coupled for movement together; and a second intermediary playing card receiver disposed between the playing card input receiver and the playing card output receiver in the at least one playing card transport path, the second intermediary playing card receiver comprising a plurality of playing card receiving compartments, the plurality of playing card receiving compartments of the first intermediary playing card receiver physically coupled for movement together. The playing card handling system may further comprise a processor configured to control placement of playing cards into the playing card receiving compartments of the first and the second intermediary playing card receivers. For example, the processor may be configured to load playing cards into the playing card receiving compartments of the first intermediary playing card receiver at a first period, and to load playing cards into the playing card receiving compartments of the second intermediary playing card receiver during a second period, different than the first period. Also for example, the processor may be configured to load playing cards into the playing card receiving compartments of the first intermediary playing card receiver at a first period, and to unload playing cards from the playing card receiving compartments of the second intermediary playing card receiver during the first period.

In another embodiment, a method of operating a a playing card handling system comprises loading playing cards from a playing card input receiver into playing card receiving compartments of a first intermediary playing card receiver; unloading playing cards from the playing card receiving compartments of the first intermediary playing card receiver to a playing card output receiver; loading playing cards from the playing card input receiver into playing card receiving compartments of a second intermediary playing card receiver; and unloading playing cards from the playing card receiving compartments of the second intermediary playing card receiver to the playing card output receiver. For example, loading playing cards from the playing card input receiver into the playing card receiving compartments of the first intermediary playing card receiver occurs during a first period and loading playing cards from the playing card input receiver into the playing card receiving compartments of the second intermediary playing card receiver occurs during a second period, different from the first period. Also for example, loading playing cards from the playing card input receiver into the playing card receiving compartments of the first intermediary playing card receiver during a first period and unloading playing cards from the playing card receiving compartments of the second intermediary playing card receiver to the playing card output receiver occurs during the first period. As another example, loading playing cards from the playing card input receiver into the playing card receiving compartments of the first intermediary playing card receiver comprises loading playing cards from the playing card input receiver into randomly selected ones of the playing card receiving compartments of the first intermediary playing card receiver. As a further example, unloading playing cards from the playing card receiving compartments of the first intermediary playing card receiver to the playing card output receiver comprises unloading playing cards from randomly selected ones of the playing card receiving compartments of the first intermediary playing card receiver.

In a further embodiment, a playing card handling system comprises a playing card input receiver; a playing card output receiver; at least one playing card transport path extending between the playing card input receiver and the playing card output receiver; a first intermediary playing card receiver disposed between the playing card input receiver and the playing card output receiver in the at least one playing card transport path, the first intermediary playing card receiver comprising a plurality of playing card receiving compartments, the plurality of playing card receiving compartments of the first intermediary playing card receiver physically coupled for movement together about a first vertical axis; and a second intermediary playing card receiver disposed between the playing card input receiver and the playing card output receiver in the at least one playing card transport path, the second intermediary playing card receiver comprising a plurality of playing card receiving compartments, the plurality of playing card receiving compartments of the first intermediary playing card receiver physically coupled for movement together about a second vertical axis. The first and the second intermediary playing card receivers may each take the form of a respective carousel comprising an endless array of the playing card receiving compartments.

BRIEF DESCRIPTION OF THE SEVERAL VIEWS OF THE DRAWINGS

In the drawings, identical reference numbers identify similar elements or acts. The sizes and relative positions of elements in the drawings are not necessarily drawn to scale. For example, the shapes of various elements and angles are not drawn to scale, and some of these elements are arbitrarily enlarged and positioned to improve drawing legibility. Further, the particular shapes of the elements as drawn, are not intended to convey any information regarding the actual shape of the particular elements, and have been solely selected for ease of recognition in the drawings.

DETAILED DESCRIPTION

In the following description, certain specific details are set forth in order to provide a thorough understanding of various disclosed embodiments. However, one skilled in the relevant art will recognize that embodiments may be practiced without one or more of these specific details, or with other methods, components, materials, etc. In other instances, well-known structures associated with servers, networks, displays, media handling and/or printers have not been shown or described in detail to avoid unnecessarily obscuring descriptions of the embodiments.

Unless the context requires otherwise, throughout the specification and claims which follow, the word "comprise" and variations thereof, such as, "comprises" and "comprising" are to be construed in an open, inclusive sense, that is as "including, but not limited to."

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Further more, the particular features, structures, or characteristics may be combined in any suitable manner in one or more embodiments.

The headings provided herein are for convenience only and do not interpret the scope or meaning of the embodiments.

Description of Gaming Environments

Figure 1:
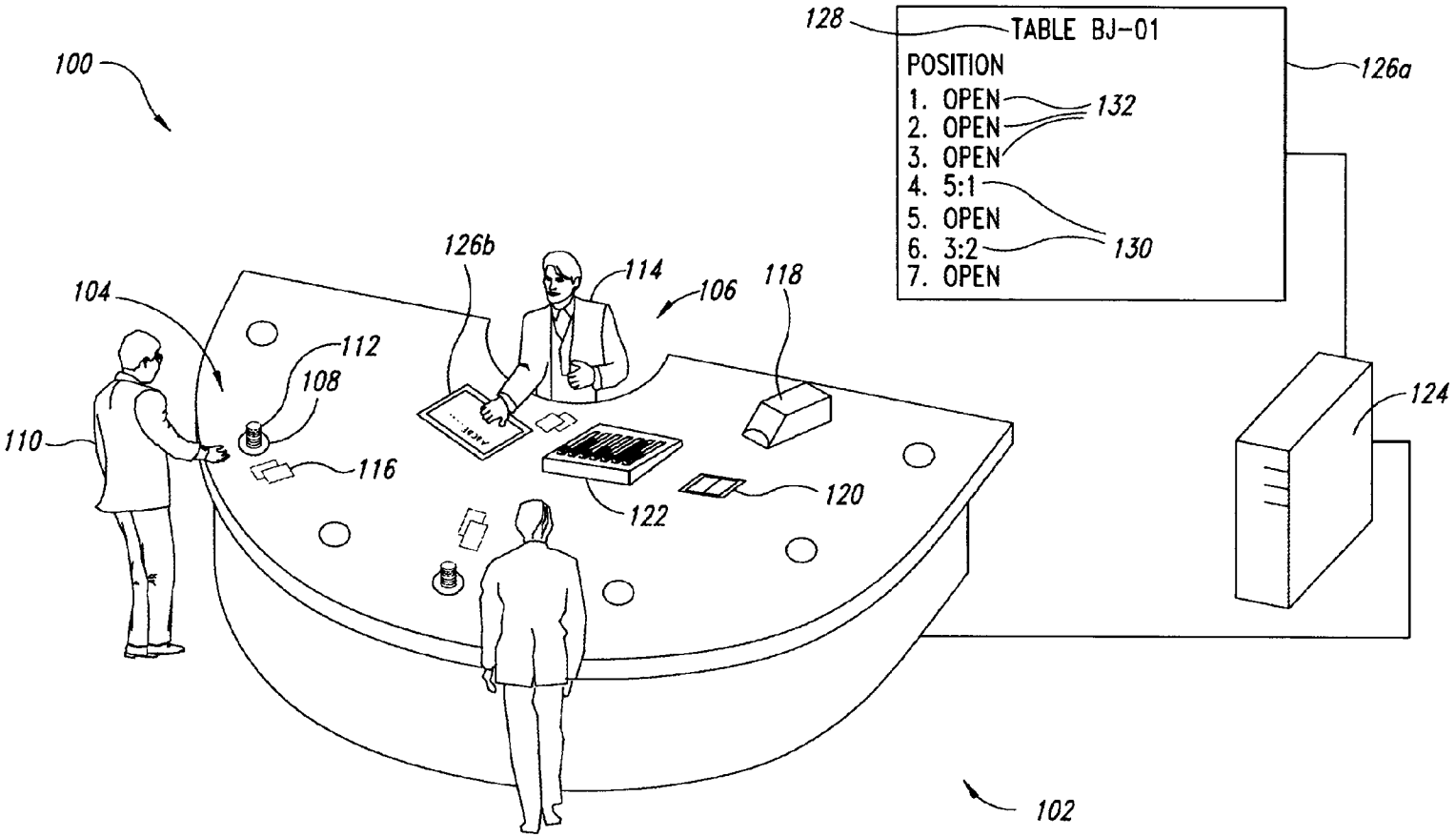
FIG. 1 is a schematic view of a gaming environment, including a gaming table, a host computing system, and at least one display visible to a number of participants, according to one illustrated embodiment.

FIG. 1 shows a gaming environment 100 according one illustrated embodiment.

The gaming environment 100 includes one or more gaming tables 102 having a number of player positions 104 (only one called out in Figure) and a dealer position 106. The player positions 104 are typically associated with a wagering area demarcated on the playing surface of the gaming table 102 and commonly referred to as a betting circle 108 (only one called out in Figure). A player 110 (only one called out in Figure) places a bet or wager by locating one or more chips 112 or other items of value in the betting circle 108.

A dealer 114 deals playing cards 116 to the players 110. In some games, the dealer 114 may deal playing cards to the dealer's own self. The dealer 114 may deal playing cards 116 from a handheld deck or from a card shoe 118. The dealer 114 may retrieve the playing cards 116 from a playing card handling system 120, for example, an automatic shuffling machine. The dealer 114 may load the retrieved playing cards 116 into the card shoe 118, if the card shoe 118 is present on the gaming table 102. The dealer 114 uses a chip tray 122 for storing wagers collected from losing players 110 and for paying out winnings to winning players 110.

The gaming environment 100 may also include a host computing system 124 and one or more displays 126*a*, 126*b* (collectively 126). The host computing system 124 is communicatively coupled to one or more systems and subsystems at the gaming table 102, and to the displays 126*a*, 126*b*. The host computing system 124 may, for example, control or provide information to the display 126*a*, 126*b* for displaying information about the game being played at the gaming table 102. For example, the host computing system 124 can cause the displays 126*a*, 126*b* to display a table identifier 128 that identifies the gaming table 102. The host computing system 124 may also display information about the various player positions 104. For example, the host computing system 124 can cause the display 126*a*, 126*b* to display payout or house odds 130 for each of the player positions 104. Additionally, or alternatively, the host computing system 124 can cause the display 126*a*, 126*b* to display a status indication of the player position 104. For example, the display 126*a*, 126*b* may display information 132 indicating that a player position 104 is open or is not currently open.

One or more of the displays 126*a* may be in the line-of-sight or otherwise visible from one or more of the player positions 104. One or more of the displays 126*b* may be in the line-of-sight or otherwise visible from the dealer position 106. Some embodiments may only include a display 126*b* visible from the dealer position 106, and may or may not include a shield or other features that prevent the players 110 from seeing the information displayed on the display 126*b* visible from the dealer position 106.

One or more displays may provide an input interface for the dealer 114. For example, the display 126*b* may take the form of a touch sensitive display, presenting a graphical user interface (GUI) with one or more user selectable icons. The display 126*b* may be positioned within reach (e.g., within approximately 3 feet) of the dealer position 106. Such may allow the dealer 114 to enter odds information for each of the respective player positions 104. For example, the dealer 114 may enter payout or house odds, such as standard blackjack payout or house odds 3:2 for player position 6, while entering non-standard blackjack payout or house odds (e.g., 5:1) for the fourth player position.

Figure 2:
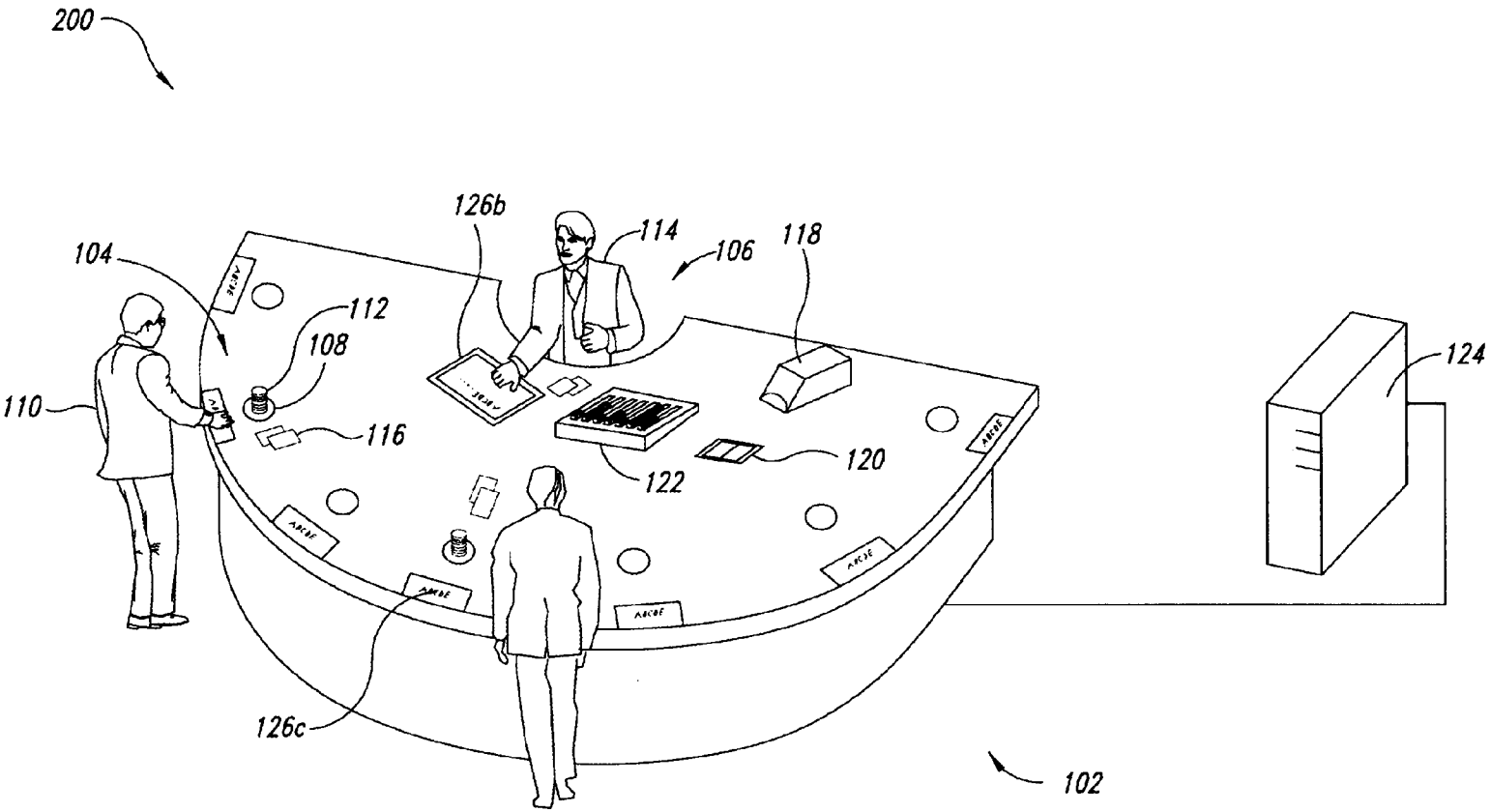
FIG. 2 is a schematic diagram of a gaming environment, including a gaming table, computing system, and a plurality of touch screen displays proximate a number of player positions, according to one illustrated embodiment.

FIG. 2 shows a gaming environment 200 according to another illustrated embodiment. This embodiment and other embodiments described herein are substantially similar to the previously described embodiment, and common acts and structures are identified by the same references. Only significant differences in operation and structure are described below.

In the embodiment illustrated in FIG. 2, displays 126*c* (only one called in the Figure) is positioned proximate respective ones of the player positions 104. The host computing system 124 can cause the displays 126*c* to display information regarding the game. In particular, the host computing system 124 can cause the displays 126*c* to display information regarding payout or house odds for all of the player positions 104. Alternatively, the host computing system 124 can cause the displays 126*c* to display information regarding payout or house odds for only the respective player position 104 to which the display 126*c* is proximate.

The displays 126*c* may take the form of touch screen displays presenting a GUI with user selectable icons. The user selectable icons may allow the players 110 to select payout or house odds for a particular hand or game. The user selectable icons may allow the player 110 to select between a set of predefined house odds (e.g., 1:1, 2:1, 3:1, . . . , 100:1, . . . , 1000:1, etc.) or may permit the user to enter a user defined set of payout or house odds. Alternatively, or additionally, other user input devices may be employed, for example, keypads and/or keyboards. The user selected house odds may be displayed on the display 126*b* viewable by the dealer 114. In other embodiments, the payout or house odds may be kept secret from the dealer 114 as well as from the other players 110.

Figure 3:
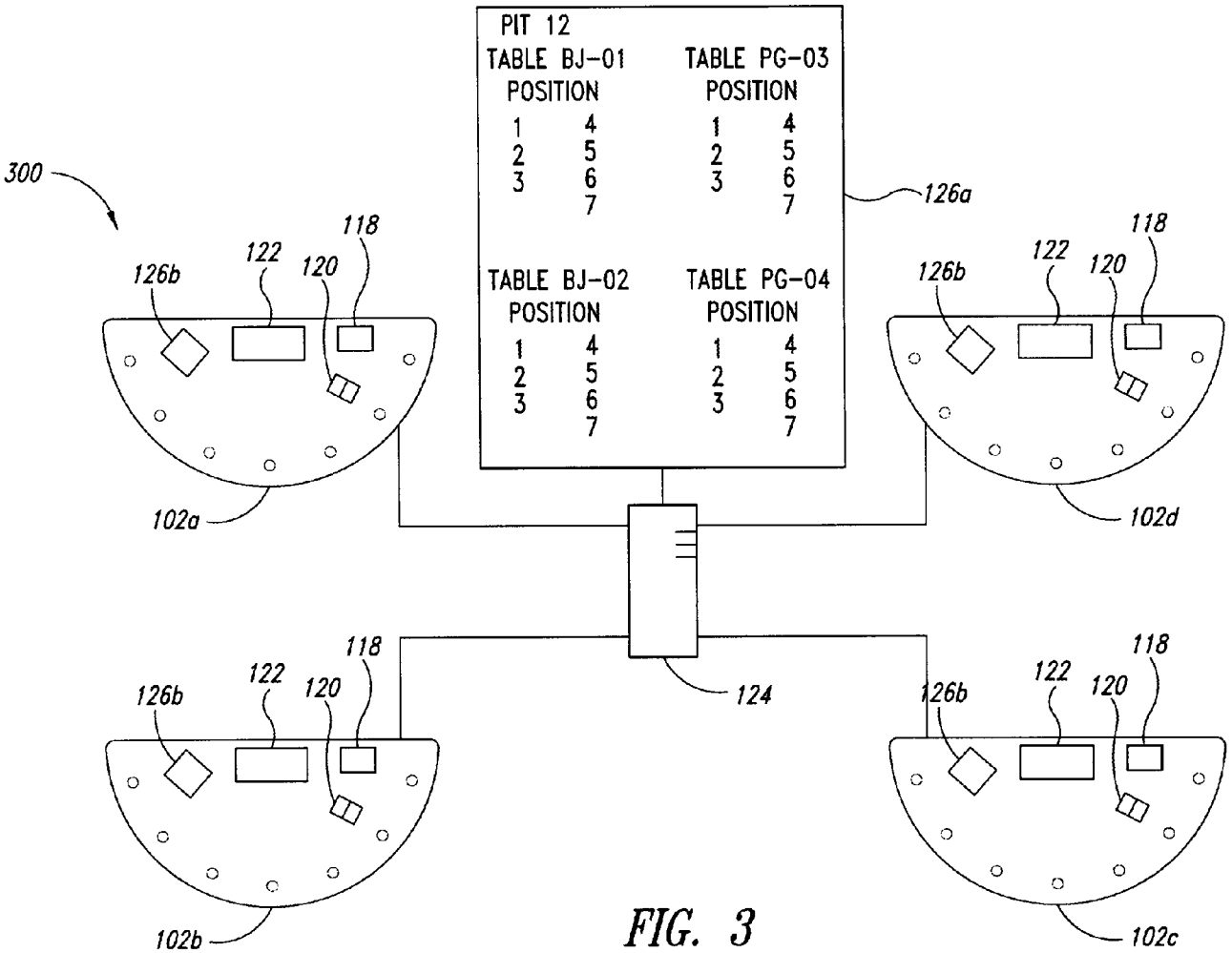
FIG. 3 is a schematic diagram of a gaming environment, including a number of gaming tables associated with the gaming pit, a computing system, and at least one display visible to a number of participants, according to another illustrated embodiment.

FIG. 3 shows a gaming environment 300 in the form of a pit, including a plurality (e.g., four) of gaming tables 102*a*-102*d* communicatively coupled to the display 126*a* via the host computing system 124. The display 126*a* may be viewable by some or all of the players 110 at the various gaming tables 102*a*-102*d*. The displays 126*a* may be viewable by other patrons of the casino. Such may advantageously create excitement amongst the patrons. Such also advantageously allows pit bosses or other casino personnel to easily keep track of the payout or house odds selected by the players 110 in the various player positions 104 at multiple tables. The pit bosses or other casino personnel may quickly and easily discern suspect or extraordinarily high payout or house odds selections. Additionally, or alternatively, the host computing system 124 may provide a notification (e.g., audible and/or visual) to casino security personnel.

Discussion of Suitable Computing Environment

Figure 4:
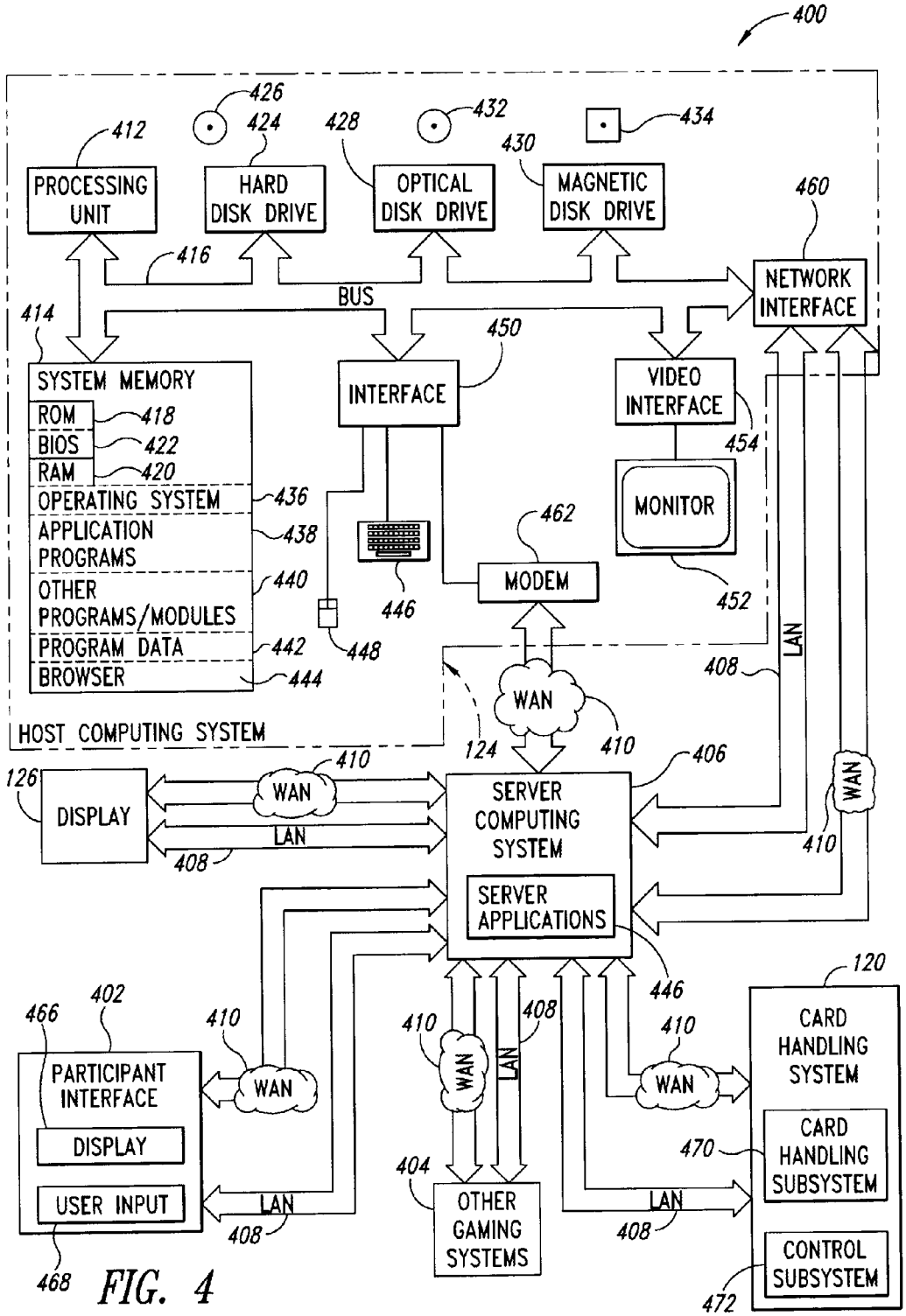
FIG. 4 is a schematic diagram of a gaming system, including a host computing system, gaming table system, participant interface, other gaming systems, and server computing system communicatively coupling at least some of the other elements, according to one illustrated embodiment.

FIG. 4 and the following discussion provide a brief, general description of a suitable computing environment 400 in which the various illustrated embodiments can be implemented. Although not required, the embodiments will be described in the general context of computer-executable instructions, such as program application modules, objects, or macros being executed by a computer. Those skilled in the relevant art will appreciate that the illustrated embodiments as well as other embodiments can be practiced with other computer system configurations, including hand-held devices, multiprocessor systems, microprocessor-based or programmable consumer electronics, personal computers ("PCs"), network PCs, mini computers, mainframe computers, and the like. The embodiments can be practiced in distributed computing environments where tasks or modules are performed by remote processing devices, which are linked through a communications network. In a distributed computing environment, program modules may be located in both local and remote memory storage devices.

FIG. 4 shows the computing environment 400 comprising one or more host computing systems 124, displays 126, participant interfaces 402, playing card handling systems 120, other gaming systems 404, and/or server computing systems 406 coupled by one or more communications channels, for example one or more local area networks (LANs) 408 or wide area networks (WANs) 410. The computing environment 400 may employ other computers, such as conventional personal computers, where the size or scale of the system allows.

The host computing system 124 may take the form of a conventional mainframe or mini-computer, that includes a processing unit 412, a system memory 414 and a system bus 416 that couples various system components including the system memory 414 to the processing unit 412. The host computing system 124 will at times be referred to in the singular herein, but this is not intended to limit the embodiments to a single host computing system since in typical embodiments, there will be more than one host computing system or other device involved.

The processing unit 412 may be any logic processing unit, such as one or more central processing units (CPUs), digital signal processors (DSPs), application-specific integrated circuits (ASICs), etc. Unless described otherwise, the construction and operation of the various blocks shown in FIG. 4 are of conventional design. As a result, such blocks need not be described in further detail herein, as they will be understood by those skilled in the relevant art.

The system bus 416 can employ any known bus structures or architectures, including a memory bus with memory controller, a peripheral bus, and a local bus. The system memory 414 includes read-only memory ("ROM") 418 and random access memory ("RAM") 420. A basic input/output system ("BIOS") 422, which can form part of the ROM 418, contains basic routines that help transfer information between elements within the host computing system 124, such as during start-up.

The host computing system 124 also includes a hard disk drive 424 for reading from and writing to a hard disk 426, and an optical disk drive 428 and a magnetic disk drive 430 for reading from and writing to removable optical disks 432 and magnetic disks 434, respectively. The optical disk 432 can be a CD-ROM, while the magnetic disk 434 can be a magnetic floppy disk or diskette. The hard disk drive 424, optical disk drive 428 and magnetic disk drive 430 communicate with the processing unit 412 via the system bus 416. The hard disk drive 424, optical disk drive 428 and magnetic disk drive 430 may include interfaces or controllers (not shown) coupled between such drives and the system bus 416, as is known by those skilled in the relevant art. The drives 424, 428 and 430, and their associated computer-readable media 426, 432, 434, provide nonvolatile storage of computer readable instructions, data structures, program modules and other data for the host computing system 124. Although the depicted host computing system 124 employs hard disk 424, optical disk 428 and magnetic disk 430, those skilled in the relevant art will appreciate that other types of computer-readable media that can store data accessible by a computer may be employed, such as magnetic cassettes, flash memory cards, digital video disks ("DVD"), Bernoulli cartridges, RAMs, ROMs, smart cards, etc.

Program modules can be stored in the system memory 414, such as an operating system 436, one or more application programs 438, other programs or modules 440 and program data 442. The system memory 414 may also include communications programs for example a Web client or browser 444 for permitting the host computing system 124 to access and exchange data with sources such as Web sites of the Internet, corporate intranets, or other networks as described below, as well as other server applications on server computing systems such as those discussed further below. The browser 444 in the depicted embodiment is markup language based, such as Hypertext Markup Language (HTML), Extensible Markup Language (XML) or Wireless Markup Language (WML), and operates with markup languages that use syntactically delimited characters added to the data of a document to represent the structure of the document. A number of Web clients or browsers are commercially available such as those from America Online and Microsoft of Redmond, Wash.

While shown in FIG. 4 as being stored in the system memory 414, the operating system 436, application programs 438, other programs/modules 440, program data 442 and browser 444 can be stored on the hard disk 426 of the hard disk drive 424, the optical disk 432 of the optical disk drive 428 and/or the magnetic disk 434 of the magnetic disk drive 430. An operator, such as casino personnel, can enter commands and information into the host computing system 124 through input devices such as a touch screen or keyboard 446 and/or a pointing device such as a mouse 448. Other input devices can include a microphone, joystick, game pad, tablet, scanner, etc. These and other input devices are connected to the processing unit 412 through an interface 450 such as a serial port interface that couples to the system bus 416, although other interfaces such as a parallel port, a game port or a wireless interface or a universal serial bus ("USB") can be used. A monitor 452 or other display device is coupled to the system bus 416 via a video interface 454, such as a video adapter. The host computing system 124 can include other output devices, such as speakers, printers, etc.

The host computing system 124 can operate in a networked environment using logical connections to one or more remote computers and/or devices, for example the server computing system 406. The server computing system 406 can be another personal computer, a server, another type of computer, or a collection of more than one computer communicatively linked together and typically includes many or all of the elements described above for the host computing system 124. The server computing system 406 is logically connected to one or more of the host computing systems 124 under any known method of permitting computers to communicate, such as through one or more LANs 408 and/or WANs 410 such as the Internet. Such networking environments are well known in wired and wireless enterprise-wide computer networks, intranets, extranets, and the Internet. Other embodiments include other types of communication networks including telecommunications networks, cellular networks, paging networks, and other mobile networks.

When used in a LAN networking environment, the host computing system 124 is connected to the LAN 408 through an adapter or network interface 460 (communicatively linked to the system bus 416). When used in a WAN networking environment, the host computing system 124 may include a modem 462 or other device, such as the network interface 460, for establishing communications over the WAN 410. The modem 462 is shown in FIG. 4 as communicatively linked between the interface 450 and the WAN 410. In a networked environment, program modules, application programs, or data, or portions thereof, can be stored in the server computing system 406. In the depicted embodiment, the host computing system 124 is communicatively linked to the server computing system 406 through the LANs 408 and/or WAN 410, for example with TCP/IP middle layer network protocols. However, other similar network protocol layers are used in other embodiments, such as User Datagram Protocol ("UDP"). Those skilled in the relevant art will readily recognize that the network connections shown in FIG. 4 are only some examples of establishing communication links between computers, and other links may be used, including wireless links.

The server computing system 406 is also communicatively linked to one or more other computing systems or devices, such as the display 126, participant interface 402, playing card handling system 120 and/or other gaming systems 404, typically through the LAN 408 or the WAN 410 or other networking configuration such as a direct asynchronous connection (not shown).

The server computing system 406 includes server applications 464 for the routing of instructions, programs, data and agents between the host computing system 124, display 126, playing card handling system 120, participant interface 402, and/or other gaming systems 404. For example the server applications 464 may include conventional server applications such as WINDOWS NT 4.0 Server, and/or WINDOWS 2000 Server, available from Microsoft Corporation or Redmond, Wash. Additionally, or alternatively, the server applications 464 can include any of a number of commercially available Web servers, such as INTERNET INFORMATION SERVICE from Microsoft Corporation and/or IPLANET from Netscape.

The participant interface 402 may include one or more displays 466 and user input devices 468. The participant interface 402 may take the form of one or more of the displays 126*b*, 126*c* (FIGS. 1, 2). As discussed above, the displays 126 may take the form of touch screen displays. Alternatively, or additionally, the participant interface 402 may employ a separate user input device, for example a keyboard or keypad. The participant interface 402 may further include one or more sound transducers, such as a speaker and/or microphone.

The participant interface 402 may include one or more controllers, memories and may store and execute one or more applications for providing information to, and collecting information from the participants 110, 114 (FIGS. 1 and 2). For example, the players 110 may select payout or house odds and/or house advantage via the participant interface 402, for example via a GUI. The participant interface 402 may provide the player 110 with a selection of predefined payout or house odds and/or house advantages, or may receive payout or house odds and/or house advantage defined by the player 110. The participant interface 402 may permit the players 110 to select from a variety of bonus and/or progressive gaming options. Likewise, the participant interface 402 may provide the dealer 114 with the selected payout or house odds and/or house advantage for the various players 110, and may permit the dealer to enter the payout or house odds or house advantage for the various player positions 104.

Additionally, the participant interface 402 may include instructions for handling security such as password or other access protection and communications encryption. The participant interface 402 can also provide statistics (win, loss, time, etc.) to the players 110 and/or dealer 114. The statistics may be provided in real-time or almost real-time. Further, the participant interface 402 may allow the player 110 to request drinks, food, and/or services. The participant interface 402 may allow the dealer 114 to request assistance, for example requesting more chips or new playing cards. Other information may include one or more of player identification data, preference data, statistical data for the particular player and/or other players, account numbers, account balances, maximum and/or minimum wagers, etc.

Various playing card handling systems 120 are discussed in detail below, and may include one or more playing card handling subsystems 470 and one or more controller subsystems 472, which may include one or more programmed microprocessors, application specific integrated circuits (ASICs), memories or the like.

The other gaming systems 404 may include one or more sensors, detectors, input devices, output devices, actuators, and/or controllers such as programmed microprocessor and/or ASIC or the like. The controllers may execute one or more gaming applications. The gaming applications can include instructions for acquiring wagering and gaming event information from the live gaming at the gaming table 102 (FIGS. 1-3). The other gaming systems 404 may collect information via images (visible, infrared, ultraviolet), radio or microwave electromagnetic radiation, and/or by detecting magnetic, inductance, or mechanical energy. Such may be implemented in the card shoe 118, chip tray 122, or other areas at or proximate the gaming table 102. For example, the other gaming systems 404 may acquire images of the wagers 112 and/or identifiers on playing cards 116. The gaming applications can also include instructions for processing, at least partially, the acquired wagering and gaming event information, for example, identifying the position and size of each wager and/or the value of each hand of playing cards. The gaming applications may include statistical packages for producing statistical information regarding the play at a particular gaming table, the performance of one or more players, and/or the performance of the dealer 114 and/or game operator. The gaming applications can also include instructions for providing a video feed and/or simulation of some or all of the participant positions 104, 106. Gaming applications may determine, track, monitor or otherwise process outcomes of games, amounts of wagers, average wager, player identity information, complimentary benefits information ("comps"), player performance data, dealer performance data, chip tray accounting information, playing card sequences, etc. Some suitable applications are described in one or more of commonly assigned U.S. patent applications: Ser. No. 60/442,368, filed Apr. 21, 1999; Ser. No. 09/474,858 filed Dec. 30, 1999, entitled "METHOD AND APPARATUS FOR MONITORING CASINO GAMING"; Ser. No. 60/259,658, filed Jan. 4, 2001; Ser. No. 09/849,456 filed May 4, 2001, Ser. No. 09/790,480, filed Feb. 21, 2001, entitled "METHOD, APPARATUS AND ARTICLE FOR EVALUATING CARD GAMES, SUCH AS BLACKJACK".

Some embodiments may communicatively couple one or more of the systems 120, 124, 404, displays 126 and/or participant interfaces 402 without the use of the server computing system 406, or alternatively via multiple server computing systems.

Structural Aspects of the Playing Card Handling Systems

Figure 5A:
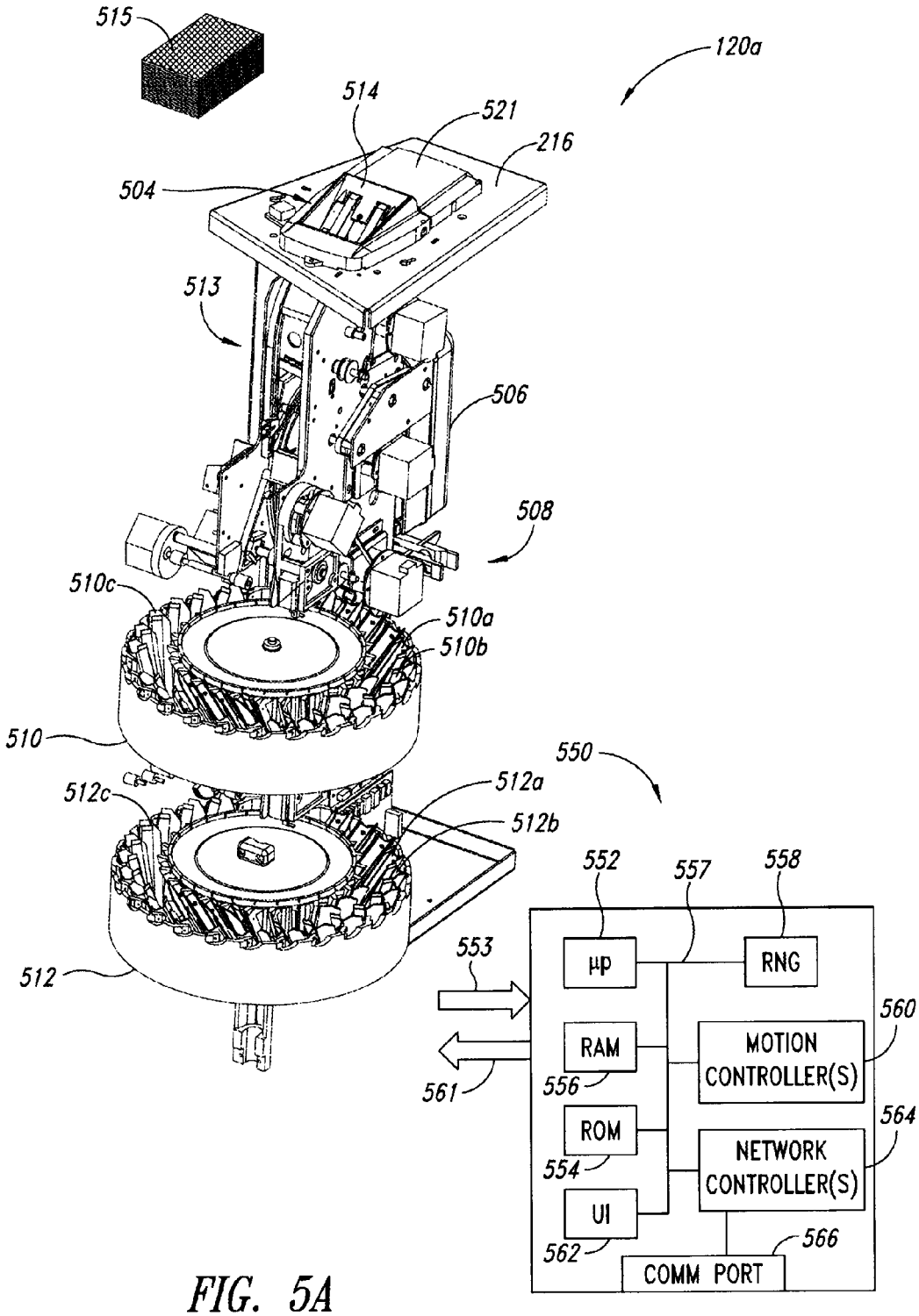
FIG. 5A is an isometric view of a playing card handling system according to one illustrated embodiment.
Figure 5B:
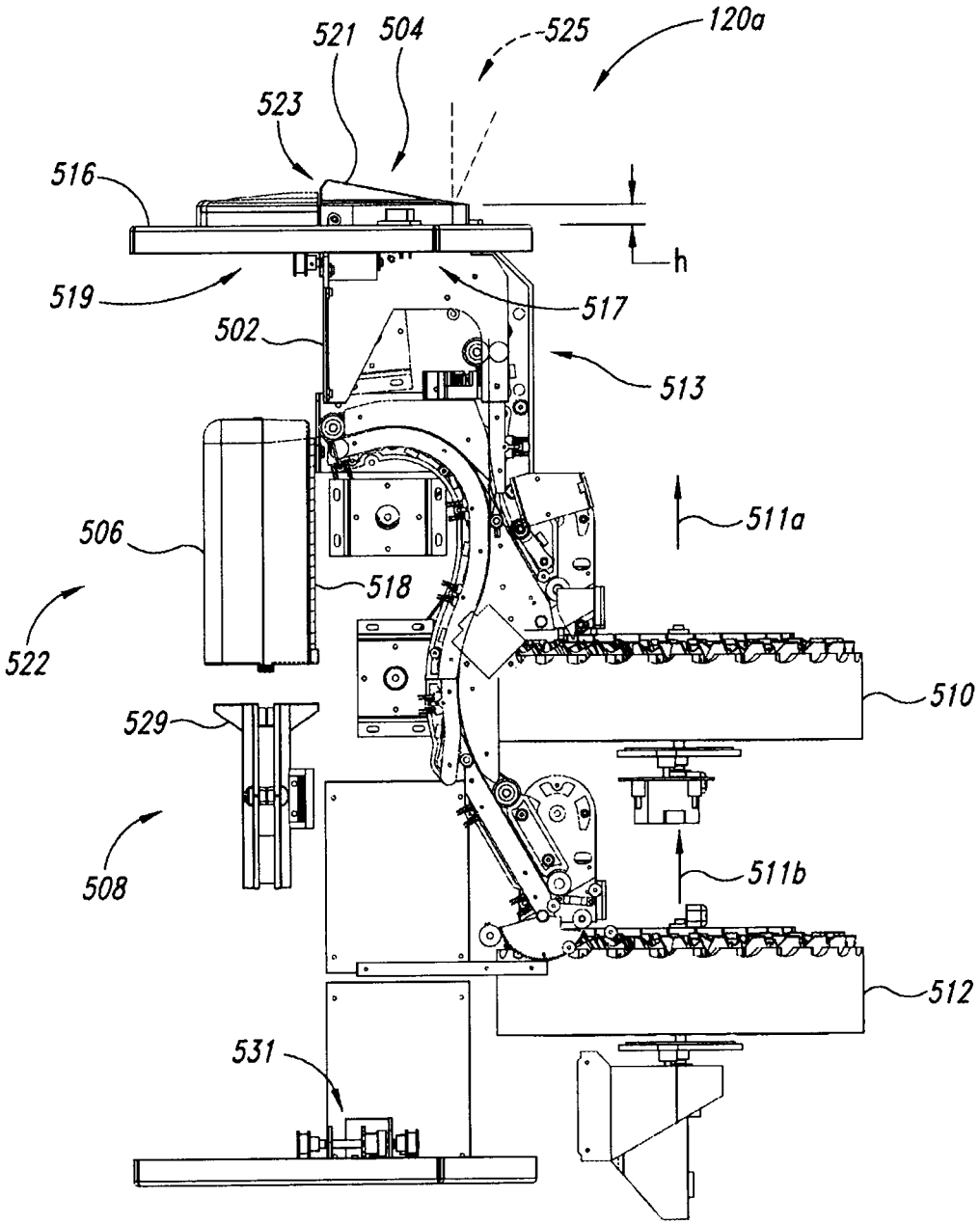
FIG. 5B is an isometric view of a playing card handling system of FIG. 5A.

FIGS. 5A and 5B show a playing card handling system 120*a* for handling playing cards according to one illustrated embodiment. As explained in detail below, the playing card handling system 120*a* is operable to provide one or more sets of randomized playing cards for use in a card game, based at least in part on selected payout or house odds and/or house advantage.

The playing card handling system 120*a* can be coupled to or installed with or near the gaming table 102 (FIGS. 1-3). In one embodiment, the playing card handling system 120*a* is installed away from the gaming table 102, for example, in a restricted area of a casino where decks of playing cards are received and shuffled.

The playing card handling system 120*a* includes a structural frame 502, a playing card input receiver 504, a playing card output receiver 506, a card elevator mechanism 508, a first intermediary playing card receiver 510, and an optional, second intermediary playing card receiver 512. The playing card handling system 120*a* may be partially or fully enclosed by a housing (not shown) and/or by the gaming table 102 (FIGS. 1-3).

At least one playing card reading sensor 513 is positioned between the playing card input receiver 504 and the playing card output receiver 506. The playing card reading sensor is operable to read identifying information form the playing cards. The information allows the playing cards to be identified, for example by rank and/or suit, or other values such as a point value of the playing card. The playing card reading sensor 513 may, for example, take the form an optical machine-readable symbol reader, operable to read non-standard playing card markings from the playing cards, for example machine-readable symbols such as barcode, matrix or area code, or stacked code symbols. The playing card reading sensor 513 may be operable to read standard playing card markings (e.g., rank, suit, pips). Such optical machine-readable symbol readers may take the form of a scanner or an imager. The playing card reading sensor 513 may take the form of a magnetic strip reader or inductive sensor to read magnetic stripe or other indicia carried on or in the playing cards. The playing card reading sensor 513 may take the form of an radio frequency reader, for example an radio frequency identification (RFID) interrogator where the playing cards carry RFID tags or circuits. The playing card reading sensor 513 may, for example, read playing cards one at a time as the playing cards pass the playing card reading sensor 513 while traveling along the playing card transport path 509.

The playing card reading sensor 513 may be positioned between the input card receiver 504 and the intermediary playing card receivers 510, 512. This allows the playing card handling system 120*a* to sort playing cards into appropriate ones of the first and the second intermediary playing card receivers 510, 512, or within selected ones of compartments or receptacles of the first and the second intermediary playing card receivers 510, 512.

The playing card input receiver 504 is sized and positioned to receive playing cards collected at the end of a hand or game (i.e., collected playing cards 515), which are to be randomized or otherwise handled. The collected playing cards 515 may be collected from the gaming table 102 during play or after a card game or round has been played. The playing card input receiver 504 may be carried or formed by a plate 516, which may be in turn be carried by, coupled to, or otherwise connected to the gaming table 102. The playing card input receiver 504 may include a card input ramp 514 on to which the collected playing cards 515 may be fed by a dealer or other person, as individual cards or as a group of cards. An input passage 517 extends through the plate 516 and the playing surface of the gaming table 102 (FIGS. 1-3) to allow passage of the collected playing cards 515 from the playing card input receiver 504 to the playing card transport path of the playing card handling system 120*a*.

The first and second intermediary playing card receivers 510, 512 may take the form of carousels, each pivotally mounted about respective vertical axes 511*a*, 511*b* (FIG. 5B), which are vertical with respect to gravity or a base. Carousels may advantageously employ bi-directional rotational motion, in contrast to racks or trays, which typically require translation. The vertical axes 511*a*, 511*b* may advantageously be coaxial, thereby minimizing the area or "footprint" of the playing card handling system 120*a*. The first and second intermediary playing card receivers 510, 512 include a plurality of card receiving compartments, each of the compartments sized to hold a respective playing card. For example, there may be sufficient compartments to hold two or more decks of playing cards. Also for example, the first intermediary playing card receiver 510 may include a plurality of playing card receiving compartments 510*a*, 510*b*, 510*c* (e.g., 180, only three called out in FIG. 5A), each sized to hold a respective playing card. Also for example, the second intermediary playing card receiver 512 may include a plurality of playing card receiving compartments 512*a*, 512*b*, 512*c* (e.g., 180, only three called out in Figure) each sized to hold a respective playing card. The number of card receiving compartments, as well as the number of inventory playing cards (i.e., playing cards in the playing card handling system 120*a*) can be greater or lesser than the illustrated embodiment. In addition, the number of intermediary playing card receptacles 510, 512 may be greater or lesser than the two shown in the illustrated embodiment.

The term "carousel" as used herein is intended to be a generic term for a structure that comprises an endless plurality of physical playing card receptacles, referred to as card receiving compartments for convenience, particularly suited for rotational movement. Some embodiments may employ other card storage devices, for example a rack having a generally rectangular structure of card receiving compartments, mounted for translation. The rack may, for example, be vertically-oriented. An wedge or portion of an annulus shaped structure of card receiving compartments, mounted for pivoting. It is appreciated that the various types of structures and/or orientations employing card receiving compartments are too numerous to describe in detail herein. Furthermore, such structures may be moved in any suitable direction, orientation and/or manner. Any such structure and/or orientation comprising a plurality of card receiving compartments configured to be a repository for inventory cards are intended to be included within the scope of this disclosure.

In one embodiment, playing cards may be loaded from the playing card input receiver 504 to one of the intermediary playing card receivers 510, 512 while concurrently unloading playing cards to the playing card output receiver 506 from the other of the intermediary playing card receivers 510, 512. This advantageously reduces any delay in providing playing cards to the gaming table 102. The first and second intermediary playing card receivers 510, 512 may be removable, allowing fresh playing cards to be loaded into the playing card handling system 120*a*. Loading of fresh playing cards may occur while the playing card handling system 102*a* is building a set of playing cards in the output receiver from the previously loaded intermediary playing card receiver 510, 512.

The playing card output receiver 506 is sized to receive a plurality of randomized playing cards 518 (e.g., 2-8 decks or 110-416 playing cards). As illustrated, the playing card output receiver 506 may take the form of a cartridge or rectangular box with a floor, and open, for example, on one or more sides to allow placement and removal of the randomized playing cards 518. The playing card output receiver 506 may pass through an output passage 519 that extends through the plate 516 and the playing surface of the gaming table 102 (FIGS. 1-3), to allow the card elevator mechanism 508 to deliver the randomized playing cards 518 to the gaming table 102.

In one embodiment, the playing card handling system 120*a* is located completely below the playing surface of the gaming table 102. In another embodiment, a vertical sidewall formed around the playing card input receiver 504 and the output passage 519 has a height "h." The height "h" corresponds to a thickness of the gaming table top such that the top portions of the playing card input receiver 504 and the output passage 519 may be flush with or extend just a little bit above (e.g., low profile) the playing surface of the gaming table 102 (FIGS. 1-3). The playing surface of the gaming table 102 typically comprises a felt cover on top of a foam pad, both of which are positioned on top of a sheet of composite, wood, or other type of material. One type of suitable surface 104 is described in detail in U.S. patent application Ser. No. 10/981,132. Some embodiments may omit the plate 516, and form the passages 517, 519 only through the playing surface of the gaming table 102. Still other embodiments may not locate the playing card handling system 120*a* under the playing surface of the playing table 102, thus such embodiments may omit the passages 517, 519 through the gaming table 102. To conserve space, in one embodiment the playing card input receiver 504 and the output passage 519 are positioned adjacent to one another.

Depending upon the embodiments and/or the type of card game, the randomized playing cards 518 may be delivered individually or as a group of cards. Embodiments of the playing card handling system 120*a* may be user configurable to provide randomized playing cards 518 having any specified number of playing cards, and/or any specified suit of cards, and/or any specified rank(s) of cards, and/or other cards such as bonus cards or the like.

A cover 521 may be manually moved from a closed position 523 to an opened position 525 (FIG. 5B, broken line), where in the closed position 523 the cover 521 is disposed over the output passage 519 so as to limit or preclude access or a view into the output passage 519, and where in the opened position 525 the cover 521 is spaced from the output passage 519 so as to not limit nor preclude access or a view into the output passage 519. The cover 521 may be pivotally or slideably coupled to the frame 502, plate 516 or other portion of the playing card handling system 120*a* for movement between the closed and the opened positions. In particular, the cover 521 may be pivotally coupled to the frame or other portion of the playing card handling system 120*a* for movement between the closed and the opened positions, 523, 525, respectively. Alternatively, the cover 521 may be slideably or pivotally coupled directly to the gaming table 102.

The playing card output receiver 506 is moveable between a lowered position 522 and a raised position (not shown). In the raised position, at least a portion of the playing card output receiver 506 is positioned to permit the randomized playing cards 518 to be withdrawn from the playing card output receiver 506 by a dealer 114 (FIGS. 1 and 2) or another person at the gaming table 102. For example, the raised position may, for example, be spaced sufficiently above the plate 516 to expose all or some of the randomized playing cards 518 above the surface 104 of the gaming table 102 (FIGS. 1-3). In the lowered position 522, the playing card output receiver 506 is positioned such that the randomized playing cards 518 cannot be withdrawn from the playing card output receiver 506. For example, a top of the playing card output receiver 506 may be spaced flush with, or below the playing surface of the gaming table 102 and/or below a top of the plate 516.

The card elevator mechanism 508 moves the playing card output receiver 506 between the lowered position 552 and the raised position. The card elevator mechanism 508 may, for example, comprise a linkage 529 and an elevator motor 531 coupled to drive the linkage 529. FIGS. 5A and 5B employ a partially exploded view, showing the playing card output receiver 506 spaced from linkage 529 of the card elevator mechanism 508 to better illustrate the components. In use, the playing card output receiver 506 will be physically connected or coupled to the linkage 529. In one embodiment, the elevator motor 531 is a DC stepper motor. Alternatively, the elevator motor 531 may take the form of a servo-motor. The card elevator mechanism 508 may employ any suitable linkage, including but not limited to a belt, sprocket chain, gear, scissors linkage or the like (not shown for clarity). Activation of the elevator motor 531 moves the linkage 529 and the playing card output receiver 506 relative to the structural frame 502.

After the playing card output receiver 506 delivers the randomized playing cards 518 to the gaming table 102, the card elevator mechanism 508 returns the playing card output receiver 506 to the lowered position 522. The lowered position 522 may be aligned with an elevator branch.

In some embodiments, one or more external switches (not called out) are positioned to be accessible from an exterior of the playing card handling system 120*a*. The external switches may, for example, be carried by the plate 516, the playing surface of the gaming table 102, or a housing (not shown) of the playing card handling system 102*a*. The external switches may be selectively activated to cause the card elevator mechanism 508 to move the playing card output receptacle 506 to the lowered position 522. Additionally, or alternatively, the external switches may be selectively activated to cause the card elevator mechanism 508 to move the playing card output receptacle 506 to the raised position. In some embodiments, a cover switch (not called out) is responsive to movement and/or a position of the cover 521 to cause the card elevator mechanism 508 to automatically move the playing card output receiver 506 upward from the lowered position 522 to the raised position. Additionally or alternatively, the cover switch is responsive to movement and/or a position of the cover 521 to cause the card elevator mechanism 508 to automatically move the playing card output receiver 506 downward from the raised position to the lowered position 522. The cover switch 233 may be employed in addition to, or in place of, the external switches 231. The cover switch 233 may take the form of a contact switch or sensor such as a proximity sensor, light sensor, infrared sensor, pressure sensor, or magnetic sensor such as a Reed switch.

One or more lowered position sensors (not shown) may detect when the playing card output receiver 506 is at the lowered position 522. The lowered position sensors may take a variety of forms including, but not limited to a proximity sensor, optical eye type sensor, and/or positional or rotational encoder. The lowered position sensors 235 may sense the position of the playing card output receiver 506, or the linkage 529 or shaft of elevator motor 531.

Some embodiments may employ an interlock or lockout feature. The lockout feature prevents the card elevator mechanism 508 from moving the playing card output receptacle 506 to the raised position until the playing card output receptacle 506 is loaded with a sufficient number of randomized playing cards 518. For example, the lockout feature may keep the playing card output receptacle 506 in the lowered position 522 until at least one hundred and twelve cards (e.g., two standard decks) have been loaded in the playing card output receptacle 506.

The playing card handling system 120*a* may include a control subsystem 550 (FIG. 5A). The control subsystem 550 may include one or more controllers, processors, ASIC and/or memories. For example, the control subsystem 550 may include a microprocessor 552, ROM 554 and RAM 556 coupled via one or more buses 557. The microprocessor 552 may employ signals 553 received from one or more sensors or actuations of the playing card handling system 120*a*.

The control subsystem 550 may also include one or more motor controllers 560 to send control signals 561 to control operation of the various motors and/or actuators of the playing card handling system 120*a*.

The control subsystem 550 may also include one or more user interfaces 562 to provide information to, and/or receive information from a user, for example the dealer 114 (FIGS. 1 and 2). Any known or later developed user interface may be suitable, for example a touch screen display, keyboard, and/or keypad, voice activated, etc.

The control subsystem 550 may include one or more network controllers 564 and/or communications ports 566 for providing communications via communications channels, for example LANs 408 (FIG. 4) and/or WANs 410.

The control subsystem 550 may also include one or more random number generators 558. While illustrated as a dedicated device, in some embodiments the random number generator functionality may be implemented by the microprocessor 552. As discussed in detail below, the random number generator 558 produces a random numbers or virtual playing card values based at least in part on the selected payout or house odds and/or house advantage.

Figure 6A:
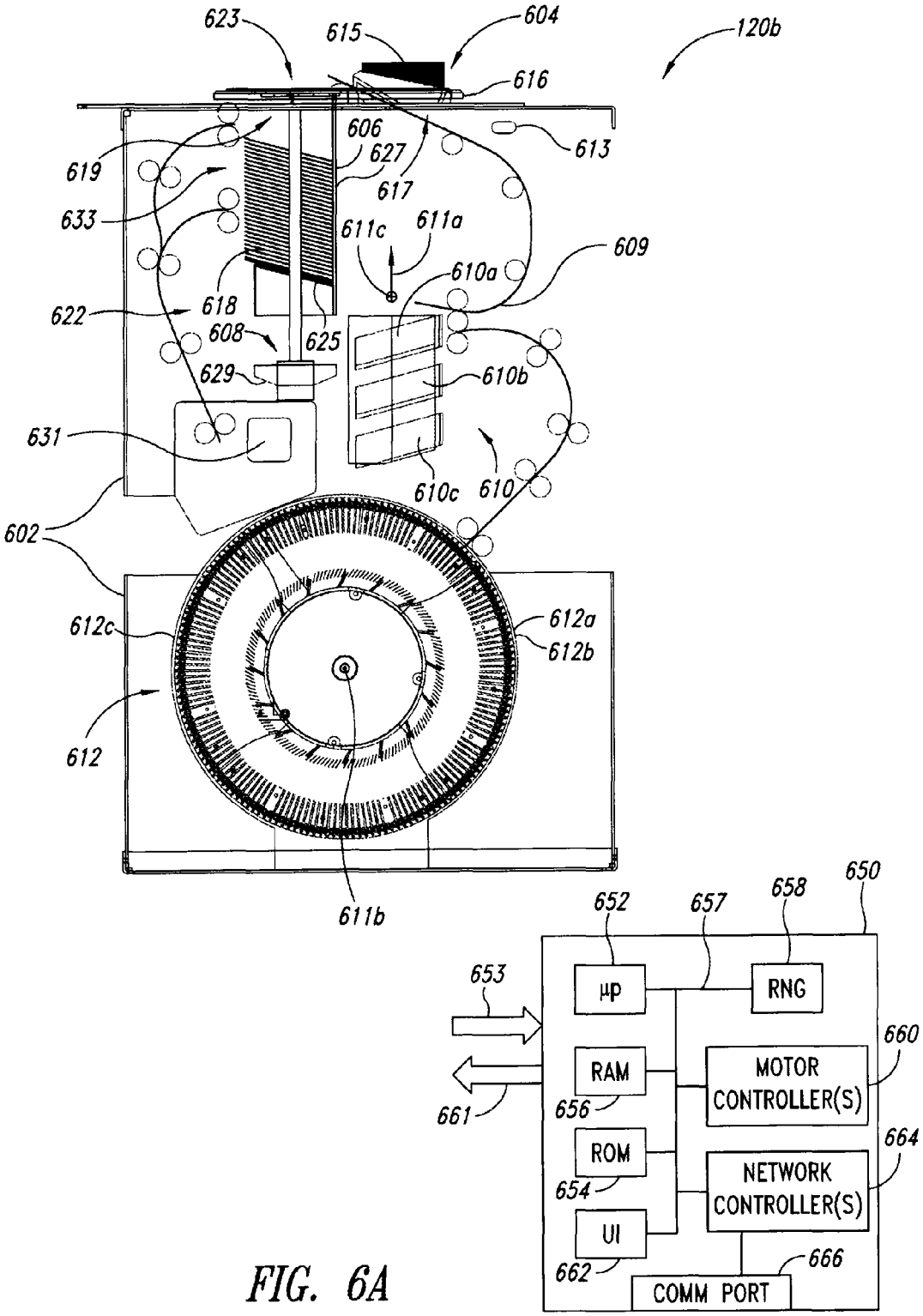
FIG. 6A is a side elevational view of a playing card handling system according to another illustrated embodiment.

FIG. 6A shows a playing card handling system 120*b* for handling playing cards according to another illustrated embodiment. As explained in detail below, the playing card handling system 120*b* is operable to provide one or more sets of randomized playing cards for use in a card game, based at least in part on selected payout or house odds and/or house advantage.

The playing card handling system 120*b* can be coupled to or installed with or near the gaming table 102 (FIGS. 1-3). In one embodiment, the playing card handling system 102*b* is installed away from the gaming table 102, for example, in a restricted area of a casino where decks of playing cards are received and shuffled.

The playing card handling system 120*b* includes a structural frame 602, a playing card input receiver 604, a playing card output receiver 606, a card elevator mechanism 608, a first intermediary playing card receiver 610, and a second intermediary playing card receiver 612. The playing card handling system 120*b* may be partially or fully enclosed by a housing (not shown) and/or by the gaming table 102 (FIGS. 1-3).

At least one playing card reading sensor 613 is positioned between the playing card input receiver 604 and the playing card output receiver 606. The playing card reading sensor is operable to read identifying information form the playing cards. The information allows the playing cards to be identified, for example by rank and/or suit, or other values such as a point value of the playing card. The playing card reading sensor 613 may, for example, take the form an optical machine-readable symbol reader, operable to read machine-readable symbols (e.g., barcode, matrix or area codes, or stacked codes) from the playing cards. The playing card reading sensor 613 may be operable to read standard playing card markings (e.g., rank, suit, pips). Such optical machine-readable symbol readers may take the form of a scanner or an imager. The playing card reading sensor 613 may take the form of a magnetic strip reader or inductive sensor to read magnetic stripe or other indicia carried on or in the playing cards. The playing card reading sensor 613 may take the form of an radio frequency reader, for example an radio frequency identification (RFID) interrogator where the playing cards carry RFID tags or circuits. The playing card reading sensor 613 may, for example, read playing cards one at a time as the playing cards pass the playing card reading sensor 613 while traveling along the playing card transport path 609.

The playing card reading sensor 613 may be positioned between the input card receiver 604 and the intermediary playing card receivers 610, 612. This allows the playing card handling system to sort playing cards into appropriate ones of the first and/or the second intermediary playing card receivers 610, 612, or card receiving compartments or receptacles therein.

The playing card input receiver 604 is sized and positioned to receive playing cards collected at the end of a hand or game (i.e., collected playing cards 615), which are to be randomized or otherwise handled. The collected playing cards 615 may be collected from the gaming table 102 during play or after a card game or round has been played. The playing card input receiver 604 may be carried or formed by a plate 616, which may be in turn be carried by, coupled to, or otherwise connected to the gaming table 102. The playing card input receiver 604 may include a card input ramp (not shown) on to which the collected playing cards 615 may be fed by a dealer or other person, as individual cards or as a group of cards. An input passage 617 extends through the plate 616 and the playing surface of the gaming table 102 (FIGS. 1-3) to allow passage of the collected playing cards 615 from the playing card input receiver 604 to the playing card transport path of the playing card handling system 120*b*.

The first intermediary playing card receiver 610 may take the form of one or more (e.g., three) distinct playing card receiving compartments 610*a*, 610*b*, 610*c*, each sized to receive a plurality of playing cards therein. The first intermediary playing card receiver 610 may be moveable with respect to a playing card input path 609 that extends from the playing card input receiver 604. As illustrated, the first intermediary playing card receiver 610 may be translatable along a vertical axis 611*a* with respect to the playing card transport path 609. Alternatively, the first intermediary playing card receiver 610 may be rotatable or pivotally moveable about a horizontal axis 611*c* (cross illustrating axis going into page of drawing sheet) with respect to the playing card transport path 609. In such an embodiment, the first intermediary playing card receiver 610 may have an approximately annular profile.

The second intermediary playing card receiver 612 may take the form of a carousel, pivotally mounted about a horizontal axis 611*b*. Carousels may advantageously employ bidirectional rotational motion, in contrast to racks or trays, which typically require translation. The second intermediary playing card receiver 612 may include a plurality of card receiving compartments, each of the card receiving compartments sized to hold a respective playing card. For example, there may be sufficient compartments to hold two or more decks of playing cards. For example, the first intermediary playing card receiver 610 may include three playing card receiving compartments each sized to hold a plurality of playing cards (e.g., 110 playing cards each). Also for example, the second intermediary playing card receiver 612 may include a plurality of playing card receiving compartments (e.g., 180) each sized to hold a respective playing card.

The number of card receiving compartments, as well as the number of inventory playing cards (i.e., playing cards in the playing card handling system 120*a*) can be greater or lesser than the illustrated embodiment. In addition, the number of intermediary playing card receivers 610, 612 may be greater or lesser than that shown in the illustrated embodiment.

In one embodiment, playing cards are loaded from the playing card input receiver 604 to one of the intermediary playing card receivers 610, 612 based on when the particular playing card will be required to build a set of playing cards based on a random sequence of virtual playing card values. Thus, for example, a set of virtual playing card values may be generated or otherwise formed. The set may be divided into two or more subsets. For example, where the first intermediary playing card receiver has three distinct card receiving compartments 610*a*-610*c*, the set may be divided into four subsets, one for each of the playing card compartments 610*a*-610*c* of the first intermediary playing card receiver 610, and one for the second intermediary playing card receiver 612. The resulting subsets do not necessarily have to be of equal size. Playing cards that will required the earliest (e.g., those in the first quarter of the set of virtual playing card values) will be transported directly to the second intermediary playing card receiver 612. Playing card required next (e.g., those in the second quarter of the set of virtual playing card values) may be loaded into a first one of the compartments 610*a* of the first playing card receiver 610. Playing card required next (e.g., those in the third quarter of the set of virtual playing card values) may be loaded into a second one of the compartments 610*b* of the first playing card receiver 610, while playing cards required last (e.g., those in the fourth quarter of the set of virtual playing card values) may be loaded into a third one of the compartments 610*c* of the first playing card receiver 610.

After, or while the second intermediary playing card receiver 612 is being emptied, playing cards from the first card receiving compartment 610*a*, then from the second card receiving compartment 610*b* and finally from the third card receiving compartment 610*c* may be loaded into compartments of the second playing card receiver 612. During this process, the playing card handling system 120*b* knows or tracks the position or location of each playing card, having initially identified the playing cards with the playing card reading sensor 613, and tracking the various destinations of the playing cards. In some embodiments, playing cards are loaded concurrently with unloading of the playing cards.

This multiple intermediary card receiver approach allows the playing card handling system 120*b* to handle a very large number of playing cards without incurring unacceptable delays in providing randomized playing card to the gaming table 102. The first and/or the second intermediary playing card receivers 610, 612 may be removable allowing fresh playing cards to be loaded into the playing card handling system 120*b*. Loading of fresh playing cards may occur while the playing card handling system 120*b* is building a set of playing cards in the output receiver from the previously loaded intermediary playing card receiver 610, 612.

The playing card output receiver 606 is sized to receive a plurality of randomized playing cards 618 (e.g., 2-8 decks or 110-416 playing cards). As illustrated, the playing card output receiver 606 may take the form of a cartridge or rectangular box with a floor 625, and open, for example, on one or more sides to allow placement and removal of the randomized playing cards 618. The floor 625 may be sloped to upward from a closed side or rear 627 of the playing card output receiver 606 to a front or opened side 633 of the playing card output receiver 606. Such may advantageously retain the plurality of randomized playing cards 618 in the playing card output receiver 606 as the playing card output receiver 606 moves and/or as when the playing card output receiver 606 is above the surface of the gaming table 102. The playing card output receiver 606 may pass through an output passage 619 that extends through the plate 616 and the playing surface of the gaming table 102 (FIGS. 1-3), to allow the card elevator mechanism 608 to deliver the randomized playing cards 618 to the gaming table 102.

In one embodiment, the playing card handling system 120*b* is located completely below the playing surface of the gaming table 102. In another embodiment, the top portions of the playing card input receiver 604 and the output passage 619 may be flush with or extend just a little bit above the playing surface of the gaming table 102 (FIGS. 1-3). Still other embodiments may not locate the card handling system 120*b* under the playing surface of the playing table 102, thus such embodiments may omit the passages 617, 619 through the gaming table 102. To conserve space, in one embodiment the playing card input receiver 604 and the output passage 619 are positioned adjacent to one another.

Depending upon the embodiments and/or the type of card game, the randomized playing cards 618 may be delivered individually or as a group of cards. Embodiments of the playing card handling system 120*b* may be user configurable to provide randomized playing cards 618 having any specified number of playing cards, and/or any specified suit of cards, and/or any specified rank(s) of cards, and/or other cards such as bonus cards or the like.

As discussed in reference to the embodiment of FIGS. 5A and 5B, the playing card handling system 120*b* may include a cover 621 that is manually moved from a closed position 623 to an opened position (not shown in FIG. 6A), where in the closed position 623 the cover 621 is disposed over the output passage 619 so as to limit or preclude access or a view into the output passage 619, and where in the opened position the cover 621 is spaced from the output passage 619 so as to not limit nor preclude access or a view into the output passage 619. The cover 621 may be pivotally or slideably coupled to the frame 602, plate 616 or other portion of the playing card handling system 120*b*. Alternatively, the cover 621 may be slideably or pivotally coupled directly to the gaming table 102.

As discussed in reference to the embodiment of FIGS. 5A and 5B, the playing card handling system 120*b*, the playing card output receiver 606 is moveable between a lowered position 622 and a raised position (not shown). In the raised position, at least a portion of the playing card output receiver 606 is positioned to permit the randomized playing cards 618 to be withdrawn from the playing card output receiver 606 by a dealer 114 (FIGS. 1 and 2) or another person at the gaming table 102. In the lowered position 622, the playing card output receiver 606 is positioned such that the randomized playing cards 618 cannot be withdrawn from the playing card output receiver 606.

The card elevator mechanism 608 moves the playing card output receiver 606 between the raised and the lowered positions. The card elevator mechanism 608 may, for example, comprise a linkage 629 and an elevator motor 631 coupled to drive the linkage 629. FIG. 6A employs a partially exploded view, showing the playing card output receiver 606 spaced from linkage 629 to better illustrate the components. In use, the playing card output receiver 606 will be physically connected or coupled to the linkage 629. The elevator motor 631 may take the form of a DC stepper motor or alternatively a servo-motor.

After the playing card output receiver 606 delivers the randomized playing cards 618 to the gaming table 102, the card elevator mechanism 608 returns the playing card output receiver 606 to the lowered position 622. The lowered position 622 may be aligned with an elevator branch.

As discussed in reference to the embodiment of FIGS. 5A and 5B, in some embodiments of the playing card handling system 120*b*, one or more external switches (not called out) are positioned to be accessible from an exterior of the playing card handling system 120*b*. The external switches may, for example, be carried by the plate 616, the playing surface of the gaming table 102, or a housing (not shown) of the playing card handling system 102*a*. The external switches may be selectively activated to cause the card elevator mechanism 608 to move the playing card output receiver 606 to the lowered position 622. Additionally, or alternatively, the external switches may be selectively activated to cause the card elevator mechanism 608 to move the playing card output receiver 606 to the raised position. In some embodiments, a cover switch (not called out) is responsive to movement and/or a position of the cover 621 to cause the card elevator mechanism 608 to automatically move the playing card output receiver 606 upward from the lowered position 622 to the raised position. Additionally or alternatively, the cover switch is responsive to movement and/or a position of the cover 621 to cause the card elevator mechanism 608 to automatically move the playing card output receiver 606 downward from the raised position to the lowered position 622. The cover switch 233 may be employed in addition to, or in place of, the external switches 231. The cover switch 233 may take the form of a contact switch or sensor such as a proximity sensor, light sensor, infrared sensor, pressure sensor, or magnetic sensor such as a Reed switch.

One or more lowered position sensors (not shown) may detect when the playing card output receiver 606 is at the lowered position 622. The lowered position sensors may take a variety of forms including, but not limited to a proximity sensor, optical eye type sensor, and/or positional or rotational encoder. The lowered position sensors may sense the position of the playing card output receiver 606, or the linkage 629 or shaft of elevator motor 631.

Some embodiments may employ an interlock or lockout feature. The lockout feature prevents the card elevator mechanism 608 from moving the playing card output receiver 606 to the raised position until the playing card output receiver 606 is loaded with a sufficient number of randomized playing cards 618. For example, the lockout feature may keep the playing card output receiver 606 in the lowered position 622 until at least one hundred and twelve cards (e.g., two standard decks) have been loaded in the playing card output receiver 606.

The playing card handling system 120*b* may include a control subsystem 650. The control subsystem 650 may include one or more controllers, processors, ASIC and/or memories. For example, the control subsystem 650 may include a microprocessor 652, ROM 654 and RAM 656 coupled via one or more buses 657. The microprocessor 652 may employ signals 553 received from one or more sensors or actuations of the playing card handling system 120*b*.

The control subsystem 650 may also include one or more motor controllers 660 to send control signals 661 to control operation of the various motors and/or actuators of the playing card handling system 120*b*.

The control subsystem 650 may also include one or more user interfaces 662 to provide information to, and/or receive information from a user, for example the dealer 114 (FIGS. 1 and 2). Any known or later developed user interface may be suitable, for example a touch screen display, keyboard, and/or keypad.

The control subsystem 650 may include one or more network controllers 664 and/or communications ports 666 for providing communications via communications channels, for example LANs 408 (FIG. 4) and/or WANs 410.

The control subsystem 650 may also include one or more random number generators 658. While illustrated as a dedicated device, in some embodiments the random number generator functionality may be implemented by the microprocessor 652. As discussed in detail below, the random number generator 658 produces a random numbers or virtual playing card values based at least in part on the selected payout odds or house advantage.

Figure 6B:
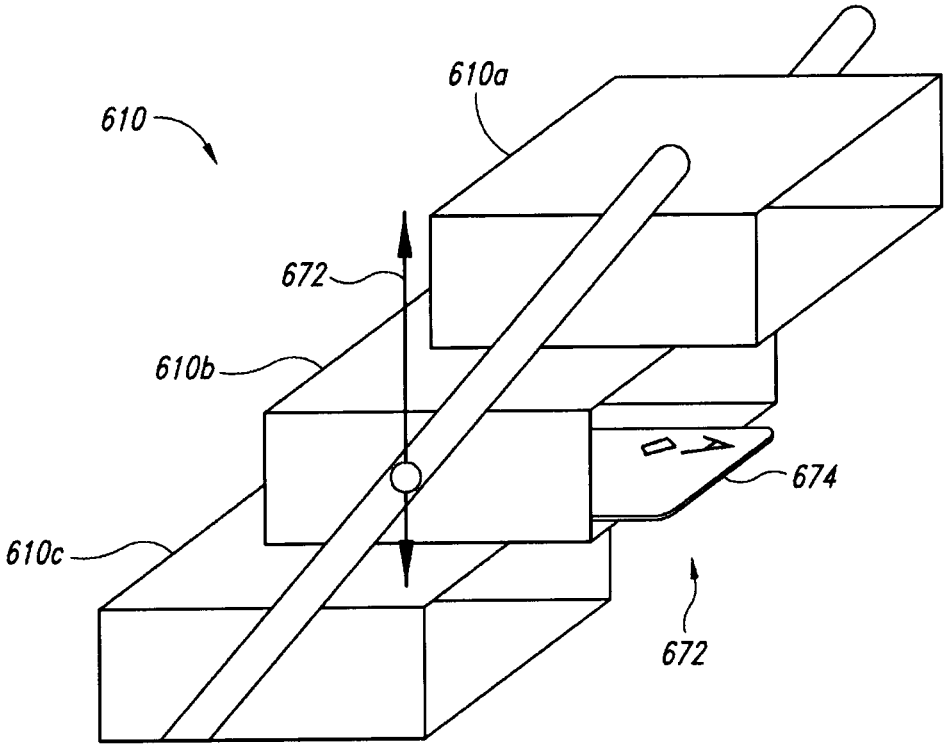
FIG. 6B is an isometric view of an intermediary playing card receiver according to an alternative illustrated embodiment, including a diagonal array of playing card receiving compartments.

FIG. 6B shows the first playing card receiver 610 according to another illustrated embodiment.

The first playing card receiver 610 includes a diagonal array 670 of playing card receiving compartments 610*a*-610*c*, which are physically coupled to move as a unit. For example, the diagonal array 670 may be mounted for bi-directional translation along a vertical axis (double headed arrow 672), which is approximately vertical with respect to the gravitational effect of the planet. Each of the playing card receiving compartments 610*a*-610*c* is sized and dimensioned to hold a plurality of playing cards 674 (only one shown).

Figure 6C:
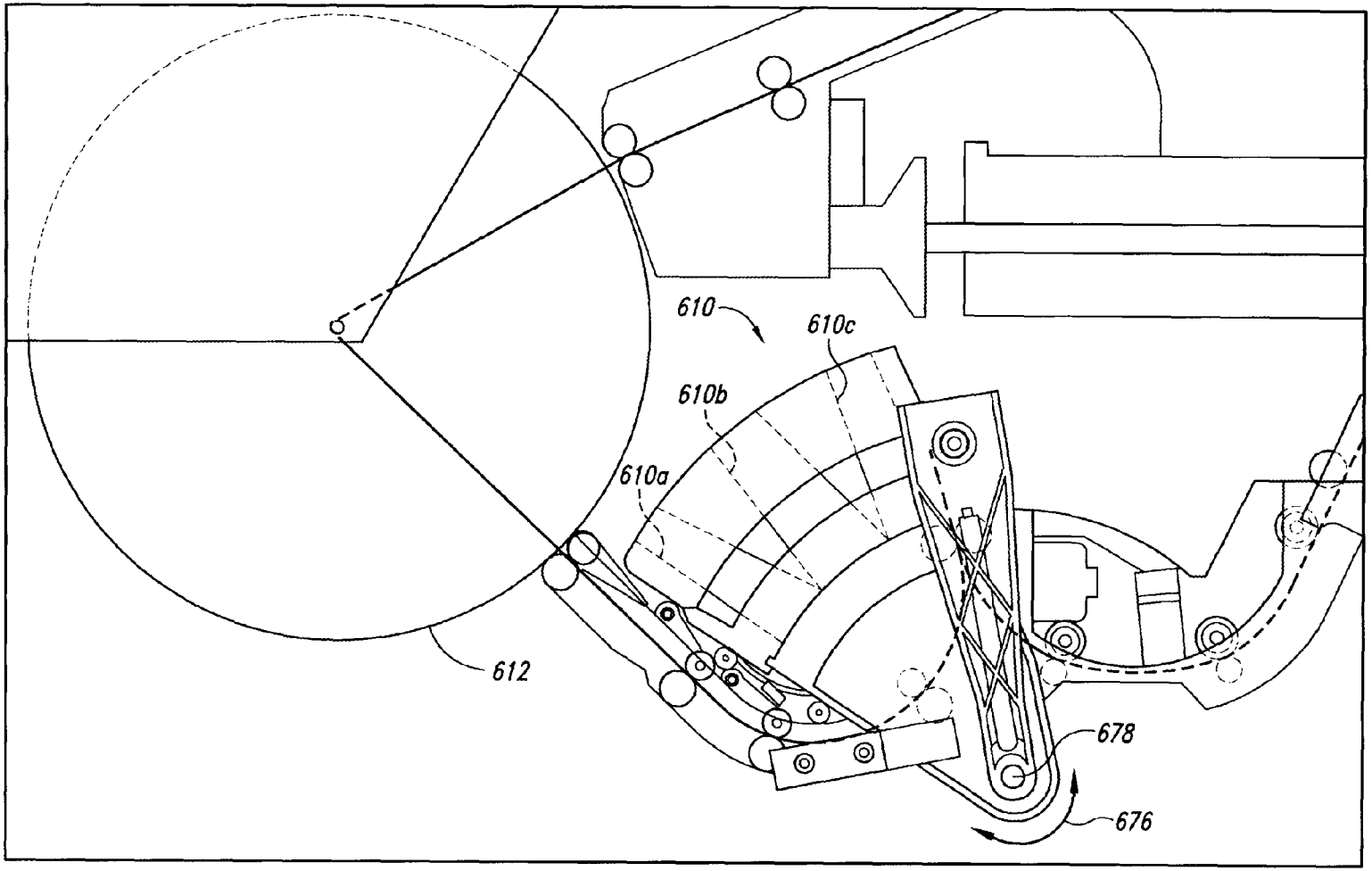
FIG. 6C is a side elevational view of an intermediary playing card receiver according to another alternative illustrated embodiment, including an array of playing card receiving compartments having an annular profile.

FIG. 6C shows the first playing card receiver 610 according to a further illustrated embodiment.

The first playing card receiver 610 includes a plurality of playing card receiving compartments 610*a*-610*c*, which are physically coupled to move as a unit. The playing card receiving compartments may be mounted for bi-directional pivotal movement (double headed arrow 676) about a horizontal axis (circle enclosing X 678), which is approximately horizontal with respect to the gravitational effect of the planet. The first playing card receiver 610 has an annular profile. Each of the playing card receiving compartments 610*a*-610*c* is sized and dimensioned to hold a plurality of playing cards (not shown).

Figure 7:
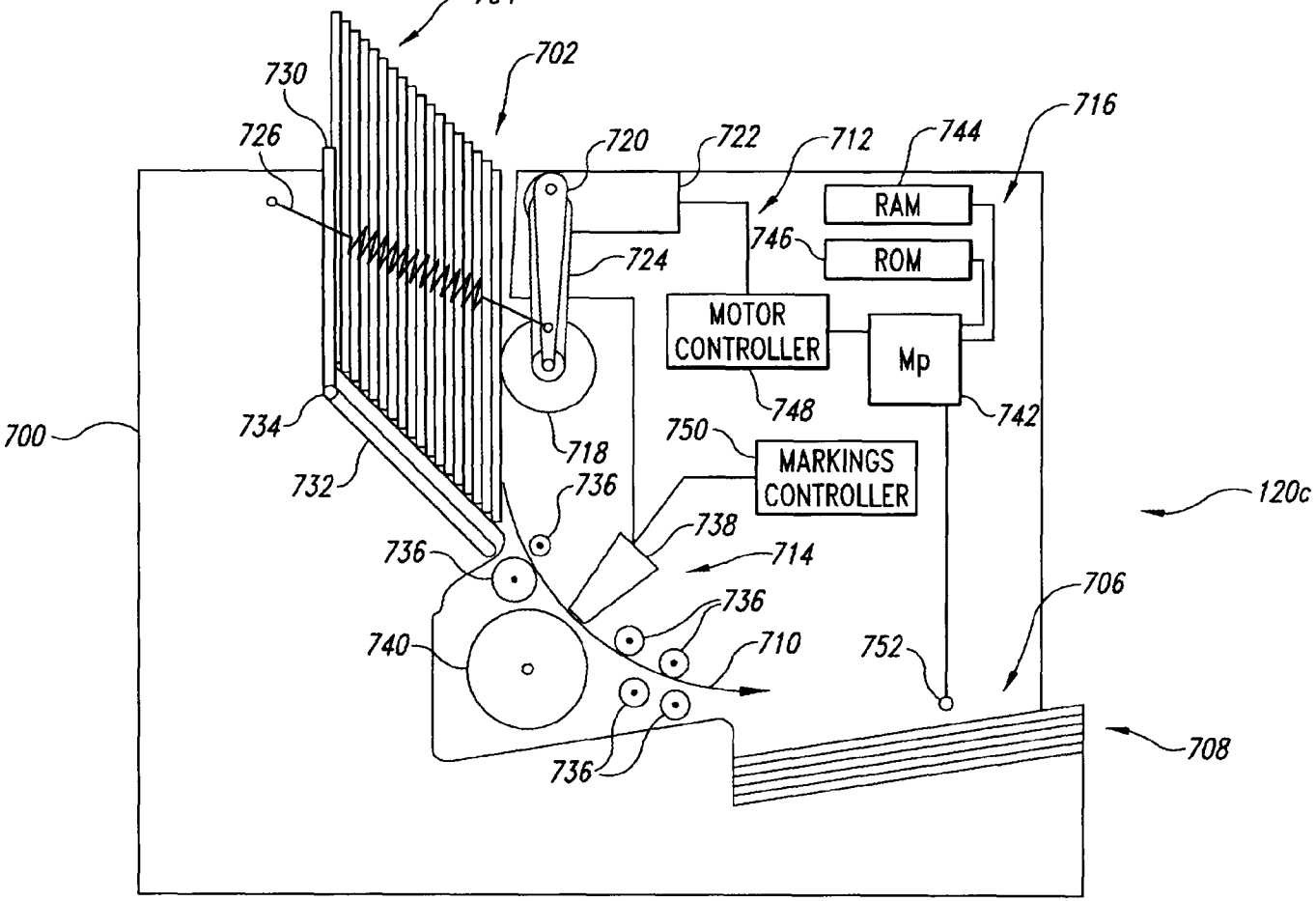
FIG. 7 is a schematic diagram of a playing card handling system according to a further illustrated embodiment.

FIG. 7 shows a playing card handling system 120*c*, according to another illustrated embodiment. As explained in detail below, the playing card handling system 120*c* is operable to provide one or more sets of randomized playing cards 718 for use in a card game, based at least in part on selected payout or house odds and/or house advantage.

The playing card handling system 120*c* includes a housing 700 having a playing card input receiver 702 for receiving playing card media 704, a playing card output receiver 706 for delivering randomized playing cards 708. A card path identified by arrow 710 extends between the playing card input receiver 702 and playing card output receiver 706. The playing card handling system 120*c* generally includes a drive mechanism 712, a markings forming mechanism 714 (e.g., print mechanism) and a control mechanism 716.

In some embodiments, the playing card media takes the form of playing card blanks without any markings. In other embodiments, the playing card media takes the form of playing card blanks with some playing card designs, but without playing card value markings (e.g., rank and/or suit symbols). Thus, the playing media may include identical ornamental designs on the backs of the playing card blanks, with the faces left blank for the playing card value markings. In still other embodiments, the playing card media may take the form of existing playing cards, from which the playing card value markings will be erased, prior to being reformed or otherwise generated. In some embodiments, the playing card media may take the form of a fiber based media, for example card stock, vellum, or polymer based media. In some embodiments, the playing card media takes the form of an active media, for example a form of electronic or "e-paper", smart paper, and/or ink code, which allows the formation and erasure of markings via electrical, magnetic, or electromagnetic radiation.

Smart paper is a product developed by Xerox Palo Alto Research Center, of Palo Alto, Calif. The smart paper consists of a flexible polymer containing millions of small balls and electronic circuitry. Each ball has a portion of a first color and a portion of a second color, each portion having an opposite charge from the other portion. Applying a charge causes the balls to rotate within the polymer structure, to display either the first or the second color. Charges can be selectively applied to form different ones or groups of the balls to from the respective markings 154-160 on the playing cards 108. The markings 154-160 remain visible until another charge is applied. Alternatively, the playing card handling system 120*c* can be adapted to employ color-changing inks such as thermochromatic inks (e.g., liquid crystal, leucodyes) which change color in response to temperature fluctuations, and photochromatic inks that respond to variations in UV light.

As illustrated in FIG. 7, the drive mechanism 712 includes a drive roller 718 rotatably mounted at the end of a pivot arm 720 and driven by a motor 722 via a drive belt 724. The motor 722 can take the form of a stepper motor, that drives the drive roller 718 in small increments or steps, such that the playing card media 704 is propelled incrementally or stepped through the card path 710 of the playing card handling system 120*c*, pausing slightly between each step. Stepper motors and their operation are well known in the art. A spring 726 biases the pivot arm 720 toward the playing card media 704 to maintain contact between the drive roller 718 and an outermost one of the playing card media 704 in the playing card input receiver 702. Thus, as the drive roller 718 rotates (counterclockwise with respect to the Figure), the outermost playing card media 704 is propelled along the card path 710. Additionally, or alternatively, a card support 730 positioned behind the playing card media 704 is supported along an inclined plane such as a guide channel 732 by one or more rollers 734. The weight of the card support 730 and or an additional attached weight (not shown) biases the card support 730 and the playing card media 704 toward the card path 710. The drive mechanism 712 also includes a number of guide rollers 736 to guide the playing card media 704 along the card path 710. Typically the guide rollers 736 are not driven, although in some embodiments one or more of the guide rollers 736 can be driven where suitable. For example, one or more guide rollers 736 may be driven where the card path 710 is longer than the length of the playing card media 704. While a particular drive mechanism 712 is illustrated, many other suitable drive mechanisms will be apparent to those skilled in the art of printing. Reference can be made to the numerous examples of drive mechanisms for both various types of printers, for example impact and non-impact printers.

The markings forming mechanism 714 may include a marking forming head 738 and a platen 740. In one embodiment, the markings forming mechanism 714 takes the form of a printing mechanism, and the marking forming head 738 take the form of a print head. The print head can take any of a variety of forms, such as a thermal print head, ink jet print head, electrostatic print head, or impact print head. The platen 740, by itself or with one or more of the guide rollers 736 (i.e., "bail rollers"), provides a flat printing surface positioned under the markings forming head 738 for the playing card media 704. While illustrated as a platen roller 740, the playing card handling system 120*c* can alternatively employ a stationary platen diametrically opposed from the markings forming head 738, where suitable for the particular playing card media 704. In an alternative embodiment, the platen roller 740 may be driven by the motor 722, or by a separate motor. In other embodiments, marking forming head 738 may take the form of a magnetic write head, similar to those employed to encode information into magnetic stripes. In other embodiments, marking forming head 738 may take the form of an inductive write head, an radio frequency transmitter, or transmitter of other frequencies of electromagnetic radiation, including but not limited to optical magnetic radiation (e.g., visible light, ultraviolet light, and/or infrared light).

The control mechanism 716 includes a microprocessor 742, volatile memory such as a Random Access Memory ("RAM") 744, and a persistent memory such as a Read Only Memory ("ROM") 746. The microprocessor 742 executes instructions stored in RAM 744, ROM 746 and/or the microprocessor's 742 own onboard registers (not shown) for generating a random playing card sequence, and printing the appropriate markings on the playing cards in the order of the random playing card sequence. The control mechanism 716 also includes a motor controller 748 for controlling the motor 712 in response to motor control signals from the microprocessor 742, and a markings controller 750 for controlling the marking forming head 738 in response to marking forming control signals from the microprocessor 742.

The control mechanism 716 may further include a card level detector 752 for detecting a level or number of playing cards in the playing card output receiver 706. The card level detector 752 can include a light source and receiver pair and a reflector spaced across the playing card holder from the light source and receiver pair. Thus, when the level of playing cards 708 in the playing card output receiver 706 drops below the path of the light, the card level detector 752 detects light reflected by the reflector, and provides a signal to the microprocessor 742 indicating that additional playing cards 708 should be formed (e.g., printed or otherwise encoded). The playing card handling system 120*c* can employ other level detectors, such as mechanical detectors.

In operation the microprocessor 742 executes instructions stored in the RAM 744, ROM 746 and/or microprocessor's registers to computationally randomly generate virtual playing card values from a domain of playing card values, based at least in part on the selected payout or house odds and/or house advantage.

The microprocessor 742 generates markings forming data based on the computationally generated virtual playing card values. The markings forming data consists of instructions for forming playing card value markings, and optionally non-value markings, on respective ones of the playing card media 704 that correspond to respective virtual playing card values from the random playing card sequence. For example, the markings forming data can identify which elements of the markings forming head 738 to activate at each step of the motor 722 to form a desired image. During each pause between steps of the motor 722, a small portion of one of the playing card media 704 is aligned with the markings forming head 738 and selected elements of the markings forming head 738 are activated to produce a portion of an image on the portion of the playing card media 704 aligned with the markings forming head 738. The image portion is a small portion of an entire image to be formed. The entire image typically is produced by stepping the card blank 704 past the markings forming head 738, pausing the playing card media 704 after each step, determining the portion of the image corresponding to the step number, determining which elements of the markings forming head 738 to activate to produce the determined portion of the image, and activating the determined elements to produce the determined portion of the image on the playing card media 704. The microprocessor 742 provides the markings forming data as motor commands to the motor controller 748 and as markings forming commands to the markings forming controller 750, for respectively synchronizing and controlling the motor 722 and markings forming head 738. The markings may take a non-visible form, and/or may take the form of magnetically detectable markings, for example magnetic orientations in a magnetic stripe.

Thus, the playing card handling system 120*c* of FIG. 7 provides a standalone card distribution device for providing playing cards in a pseudo-random fashion based at least in part on the selected payout or house odds and/or house advantage, which may be used at any gaming position. Since the playing card handling system 120*c* includes a microprocessor 742 which may implement the RNG function, the playing card handling system 120*c* is particularly suited for the manually monitored gaming table 18 of FIG. 2, where the playing card handling system 120*c* operates in a standalone mode. However, the playing card handling system 120*c* can operate as an integral portion of the automated table game system, or in conjunction with such a system.

In another embodiment, the playing card handling system 120*c* may include at least one playing card reading sensor positioned between the playing card input receiver and the playing card output receiver, identical or similar to that of the previously discussed embodiments. Additionally, or alternatively, the playing card handling system 120*c* may include an erase mechanism (not shown) positioned between the playing card input receiver and the print mechanism. The erase mechanism is operable to erase marking from previously used playing cards. Erasing may include removing previously printed markings physically, chemically and/or via electromagnetic radiation. Alternatively, erasing may include electrically, inductively, or magnetically removing previously encoded markings, for example where the playing card characters or symbols were formed using smart or electronic paper media, ink code or other active media.

Brief Overview of the Operation of Playing Card Handling Systems

Each of the playing card handling systems 120*a*, 102*b*, 120*c* (collectively 120) provide randomized playing cards 518, 618, 718 at the playing card output receiver 506, 606, 706, respectively, based at least in part on a selected set of payout or house odds and/or house advantage.

In various embodiments, the randomized playing cards 518, 618, 718 may be delivered individually (e.g., one at a time), as multiple subsets (e.g., individual hands), or as one set (e.g., multiple hands). Such variations are discussed immediately below.

Figure 8:
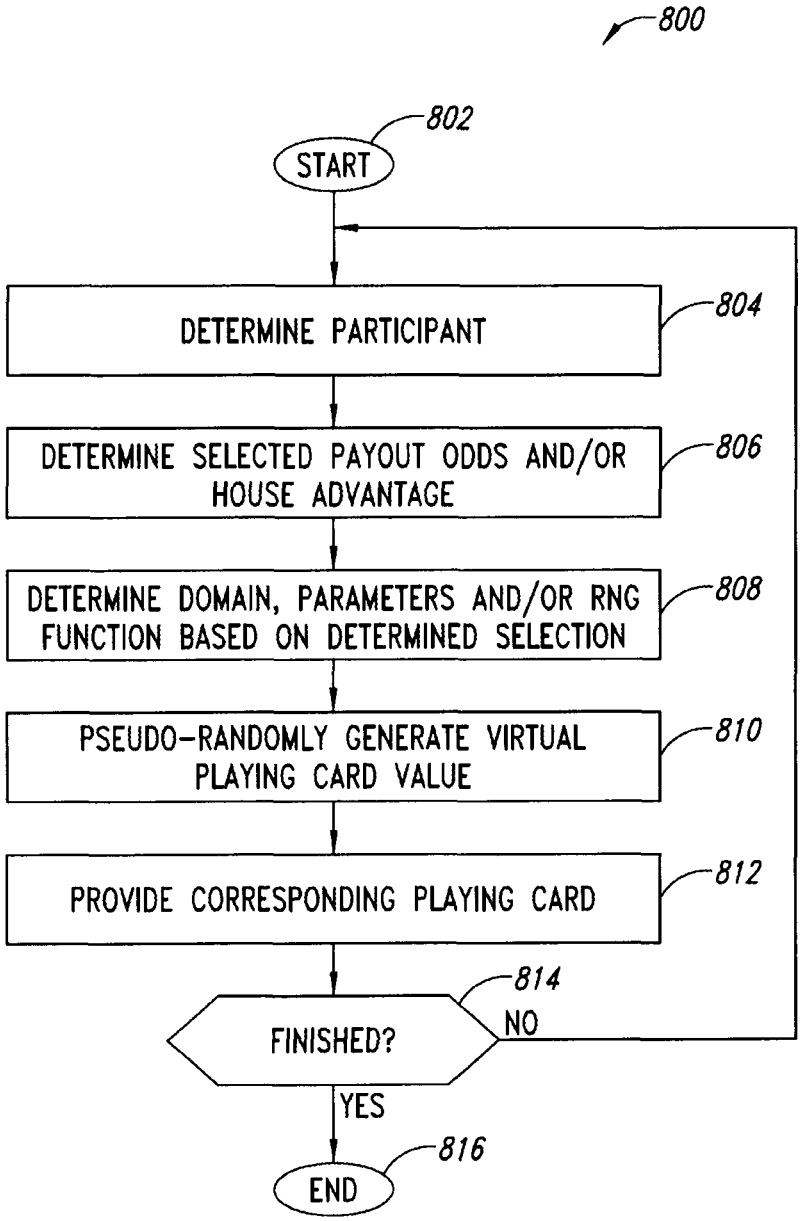
FIG. 8 is a flow diagram of a method of operating a playing card handling system such as that illustrated in FIGS. 5A, 5B, 6A, and 7 according to one illustrated embodiment, to provide playing cards one at a time.

For example, the randomized playing cards 518, 618, 718 may be delivered to the output playing card receiver one at a time, as illustrated in FIG. 8. Thus, a playing card may be selected or generated that corresponds to a virtual playing card value that has been randomly generated based on the payout or house odds and/or house advantage selected for the particular player position 104 (FIGS. 1 and 2) to which the playing card will be dealt.

This approach advantageously requires little computational overhead with respect to positioning or interleaving the playing cards for various participant positions (e.g., player positions 104 and dealer position 106) with respect to one another in a set or stack of playing cards.

In particular, a method 800 of delivering playing cards one at a time starts at 802. At 804, the playing card handling system 120 determines a participant 110, 114 (FIGS. 1 and 2) or participant position 104, 106 to which the playing card will be dealt. Such may be based on the rules of the game and/or on information received from the players 110, the dealer 114, or various other gaming systems 404 (FIG. 4).

At 806, the playing card handling system 120 determines the selected payout or house odds and/or house advantage for the participant 110, 114 or participant position 104, 106. Such is based on the selection received by the playing card handling system 120.

At 808, the playing card handling system 120 determines a domain of playing card values, parameters for a Random Number Generator (RNG) function and/or a particular RNG function, for pseudo-randomly generating virtual playing card values. The playing card handling system 120 may determine a total number of playing card values composing the domain to achieve or partially achieve particular payout or house odds and/or house advantage. Alternatively, or additionally, the playing card handling system 120 may select the playing card values composing the domain to achieve or partially achieve particular payout or house odds and/or house advantage. For example, the playing card handling system 120 may omit certain playing card values (e.g., those corresponding to one or more Aces), or may over represent certain playing card values (e.g., fives). Such may be used to control the probability of a bonus hand occurring (e.g., five Queen of hearts in a single hand), for which a bonus or progressive payout is made. Alternatively, or additionally, the playing card handling system 120 may select parameters that weight the RNG function to increase and/or decrease the probability of generating certain virtual playing card values. For example, the playing card handling system 120 may select parameters that increase, or alternatively, decrease the probability of generating a virtual playing card value corresponding to playing cards having a value of ten (e.g., tens and face cards). Alternatively, or additionally, the playing card handling system 120 may select between a plurality of RNG functions, each designed to produce on average a respective payout or house odds and/or house advantage.

At 810, the playing card handling system 120 pseudo-randomly generates a virtual playing card value using the determined domain, parameters and/or RNG function. At 812, the playing card handling system 120 provides a playing card corresponding to the pseudo-randomly generated virtual playing card value. At 814, the playing card handling system 120 determines whether there are additional playing card to be dealt. If so, control returns to 804, otherwise the method 800 terminates at 816.

Figure 9:
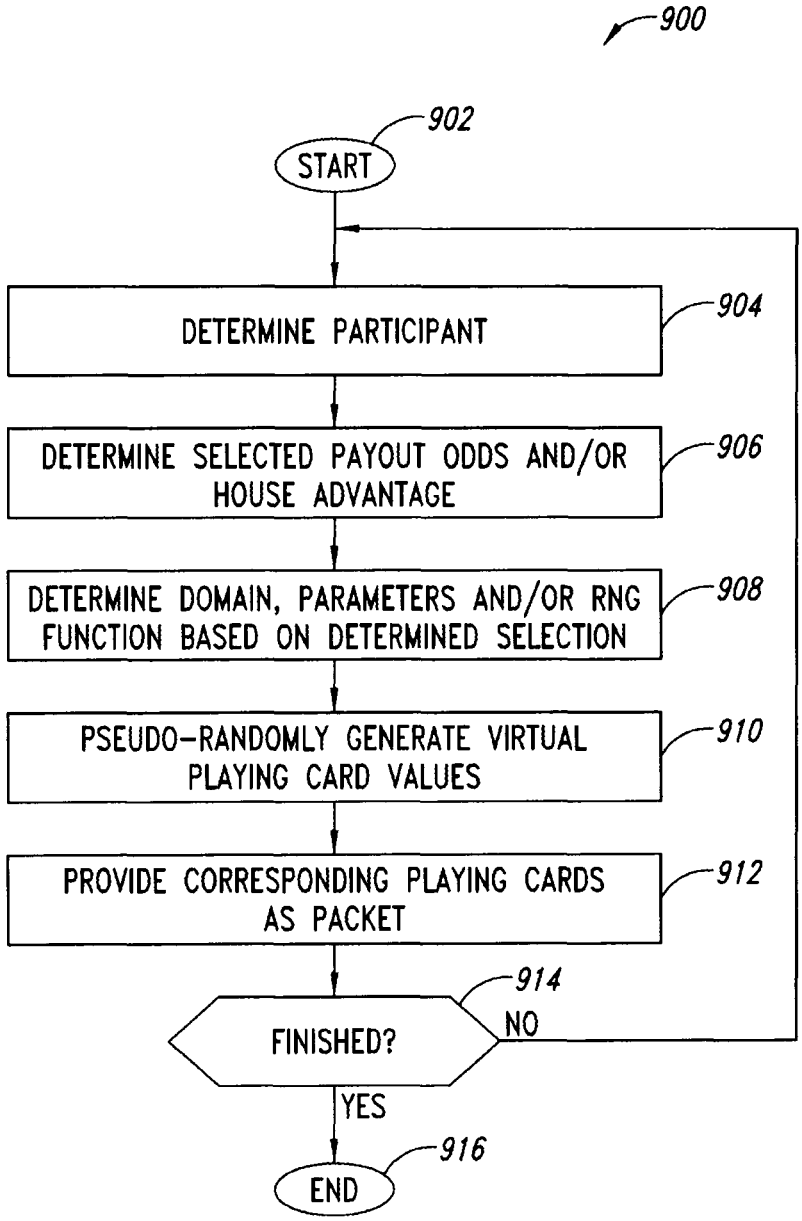
FIG. 9 is a flow diagram of a method of operating a playing card handling system such as that illustrated in FIGS. 5A, 5B, 6A and 7, according to one illustrated embodiment, to provide playing cards in subsets or packets.

Also for example, the randomized playing cards 518, 618, 718 may be delivered to the output playing card receiver 506, 606, 706 as subsets or packets of playing cards, as illustrated in FIG. 9. For example, each subset of playing cards may form a hand of playing cards intended for a respective one of the participant positions (e.g., player positions 104 and dealer position 106). Thus, playing cards may be selected or generated that correspond to a number of virtual playing card values that have been randomly generated based on the payout odds or house advantage selected for the particular player position 104 (FIGS. 1 and 2) to which the subset or packet of playing cards will be dealt. In such embodiments, it may be advantageous for the playing card output receiver 506, 606, 706, to have multiple card receiving compartments.

This approach may be particularly suitable for card games that deal complete hands to players at the start of the game. This approach may be particularly suitable for card games that deal partial hands to players 110 at the start of the game, and which employ later dealt common cards that are shared by the various participants 110, 114 to complete the participant's respective hands.

This approach again advantageously requires little computational overhead with respect to positioning or interleaving the playing cards for various participant positions (e.g., player positions 104 and dealer position 106) with respect to one another in a set or stack of playing cards. However, to the extent that participants 110, 114 share common cards, such will need to be taken into account in determining the actual payout odds and/or house advantage since these later dealt cards must correspond to a common probability. This will increase the computational complexity to some degree, over the immediately preceding embodiment.

In particular, a method 900 of delivering playing cards as subsets or packets of playing cards starts at 902. At 904, the playing card handling system 120 determines a participant 110, 114 (FIGS. 1 and 2) or participant position 104, 106 to which the playing card will be dealt. Such may be based on the rules of the game and/or on information received from the players 110, the dealer 114, or various other gaming systems 404 (FIG. 4).

At 906, the playing card handling system 120 determines the selected payout or house odds and/or house advantage for the participant 110, 114 or participant position 104, 106. Such determination is based on the selection received by the playing card handling system 120.

At 908, the playing card handling system 120 determines a domain of playing card values, parameters for an RNG function and/or a particular RNG function for pseudo-randomly generating virtual playing card values. The playing card handling system 120 may determine the domain, parameters, and/or a particular RNG function in the same or similar fashion as discussed above in reference to FIG. 8. Such operation is not repeated in the interest of brevity.

At 910, the playing card handling system 120 pseudo-randomly generates virtual playing card values using the determined domain, parameters and/or RNG function. At 912, the playing card handling system 120 provides playing cards corresponding to the pseudo-randomly generated virtual playing card values as a packet or subset. At 914, the playing card handling system 120 determines whether there are additional playing card to be dealt. If so, control returns to 904, otherwise the method 900 terminates at 916.

Figure 10:
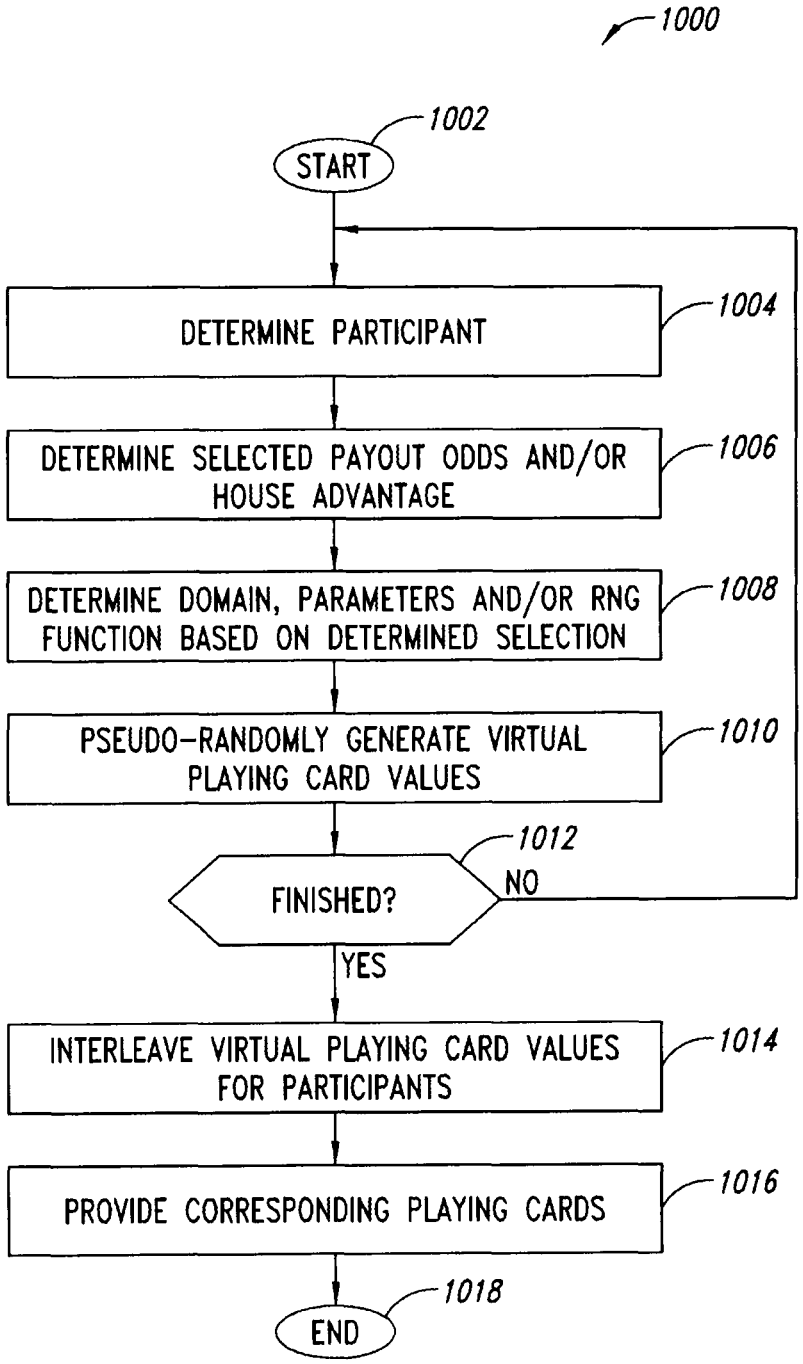
FIG. 10 is a flow diagram of a method of operating a playing card handling system such as that illustrated in FIGS. 5A, 5B and 6A, according to one illustrated embodiment, to provide playing cards as a set of interleaved or intermingled playing cards.
Figure 11:
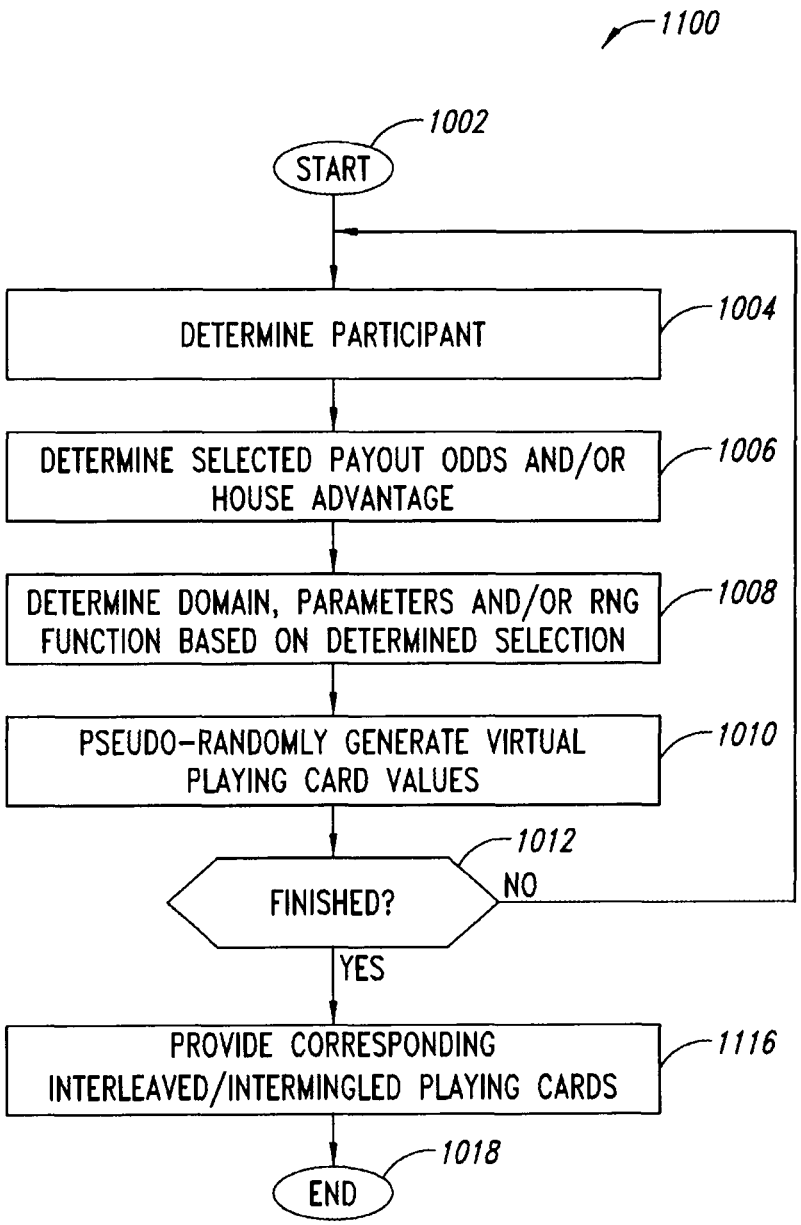
FIG. 11 is a flow diagram of a method of operating a playing card handling system such as that illustrated in FIGS. 5A, 5B and 6A, according to one illustrated embodiment, to provide playing cards as a set of interleaved or intermingled playing cards.

As a further example, the randomized playing cards 518, 618, 718 may be delivered to the output playing card receiver 506, 606 706 as a set for dealing multiple hands of playing cards to various participant positions (e.g., player positions 104 and dealer position 106), as illustrated in FIG. 10. Thus, playing cards may be selected or generated that correspond to a number of subsets of virtual playing card values that have been randomly generated based on the payout or house odds and/or house advantage selected for the particular player position 104 (FIGS. 1 and 2) to which the playing cards will be dealt. Alternatively, a number of subsets of virtual playing card values may be randomly generated based on the payout or house odds and/or house advantage selected for the particular player position 104 (FIGS. 1 and 2), the virtual playing card values of the subsets may be positioned or interleaved with one another based on the relative order of the participant positions 104, 106 to form a set of virtual playing card values, and then the playing cards corresponding to the set of virtual playing card values may be selected or generated.

This approach may be particularly suitable for card games that deal complete hands to players at the start of the game. This approach may be suitable for card games that deal partial hands to players at the start of the game, and which employ later dealt common cards that are shared by the various participants 110, 114 to complete the participant's respective hands. This approach may be particularly suitable for card games where the rules dictate the number of playing cards that will be selected by, or dealt to, each participant position. For example, the rules of baccarat dictate when each of the participants (e.g., player and bank) must take additional playing cards (e.g., hit cards). This approach may advantageously simplify the dealing of playing cards to the various participants 110, 114. However, this approach may require extra computational overhead with respect to positioning or interleaving the playing cards for various participant positions (e.g., player positions 104 and dealer position 106) with respect to one another in a set or stack of playing cards as compared to the two most immediately described approaches. In games where participants share common cards, such will need to be taken into account in determining the actual payout or house odds and/or house advantage since these later dealt cards must correspond to a common probability. As discussed above, this will increase the computational complexity to some degree.

In particular, a method 1000 of delivering a set of playing cards for dealing multiple hands of playing cards to various participant positions 104, 106 (FIGS. 1 and 2) starts at 1002. At 1004, the playing card handling system 120 determines a participant 110, 114 (FIGS. 1 and 2) or participant position 104, 106 to which the playing card will be dealt. Such may be based on the rules of the game and/or on information received from the players 110, the dealer 114, or various other gaming systems 404 (FIG. 4).

At 1006, the playing card handling system 120 determines the selected payout or house odds and/or house advantage for the participant 110, 114 or participant position 104, 106. Such determination is based on the selection received by the playing card handling system 120.

At 1008, the playing card handling system 120 determines a domain of playing card values, parameters for an RNG function and/or a particular RNG function for pseudo-randomly generating virtual playing card values. The playing card handling system 120 may determines the domain, parameters, and/or a particular RNG function in the same or similar fashion as discussed above in reference to FIG. 8. Such operation is not be repeated in the interest of brevity.

At 1010, the playing card handling system 120 pseudo-randomly generates virtual playing card values using the determined domain, parameters and/or RNG function. At 1012, the playing card handling system 120 determines whether there are additional participants 110, 114 to process. If so, control returns to 1004 to determine the next participant 110, 114, otherwise the method 900 passes control to 1014.

At 1014, the playing card handling system 120 interleaves the virtual playing card values of the various participants 110, 114. The playing card handling system 120 may advantageously employ information regarding the relative position in an order of dealing of the various participant positions 104, 106 with respect to one another. At 1016, the playing card handling system 120 provides playing cards corresponding to the pseudo-randomly generated virtual playing card values as a set of interleaved or intermingled subsets. The method 1000 terminates at 1018.

Also in particular, a method 1100 of delivering a set of playing cards for dealing multiple hands of playing cards to various participant positions 104, 106 (FIGS. 1 and 2) employs many of the same or similar acts as the method 1000. Such acts are denominated with the same references numbers. Only significant differences are discussed below.

Instead of interleaving or intermingling the virtual playing card values, the playing card handling system 120 physically interleaves or intermingles the actual playing cards at 1116 in method 1110. Such may be done by selectively inserting playing cards into the intermediary playing card receivers 510, 512, 610, 612. Such may alternatively be done by selectively removing playing cards into the intermediary playing card receivers 510, 512, 610, 612.

Figure 12:
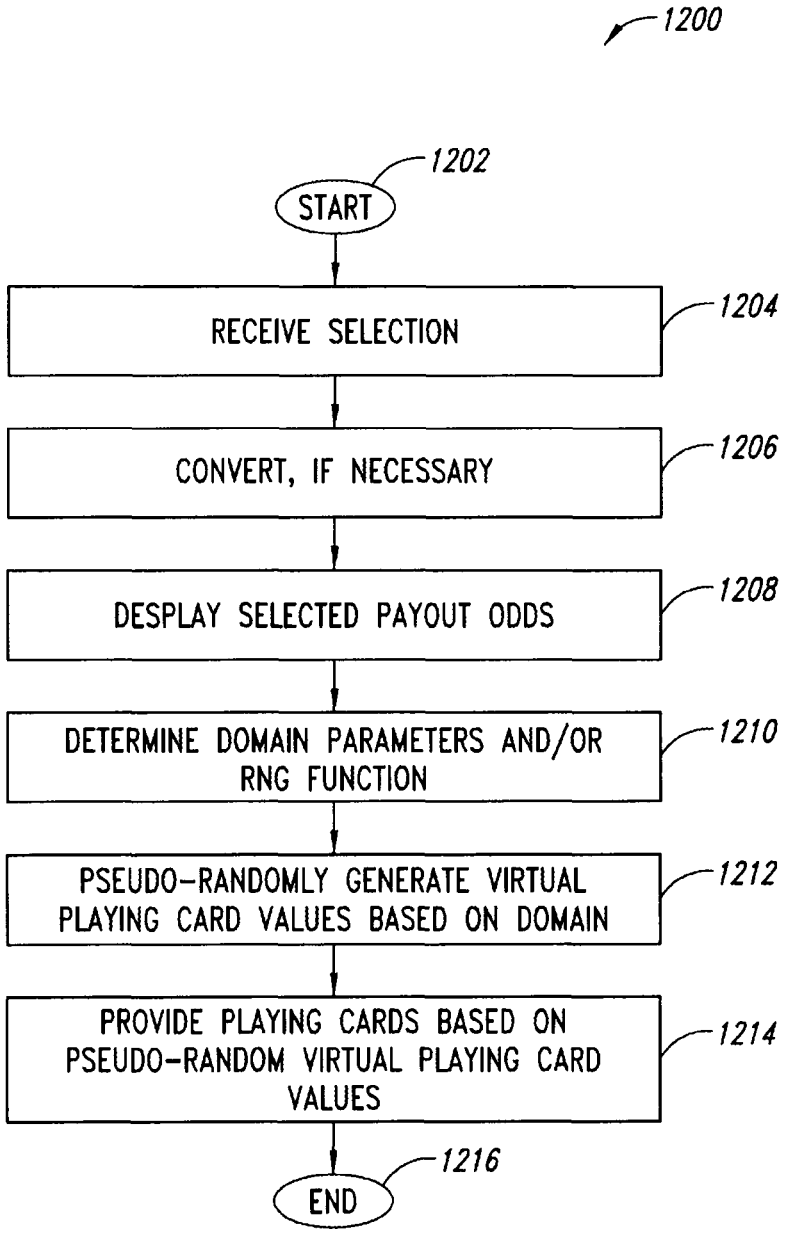
FIG. 12 is a flow diagram of a method of operating a gaming environment to allow selection and display of theoretical and/or payout odds, according to one illustrated embodiment.

FIG. 12 shows a method 1200 of operating a gaming environment according to one illustrated embodiment, starting at 1202.

At 1204, the host computing system 124 (FIGS. 1-4) and/or playing card handling system 120 receives selection from a player 110 or dealer 114 indicative of a set of payout or house odds and/or house advantage. At 1204, the host computing system 124 and/or playing card handling system 120 converts the received, if necessary. For example, the host computing system 124 and/or playing card handling system 120 may convert player defined payout or house odds to an acceptable value, for example an pair of integer values, and/or may convert payout or house odds to a house advantage. At 1208, the host computing system 124 and/or playing card handling system 120 causes one or more displays 126 to display the payout or house odds and/or house advantage to at least one of the participants 110, 114.

At 1210, the host computing system 124 and/or playing card handling system 120 determines a domain, parameters and/or RGN function based on the payout or house odds and/or house advantage. The host computing system 124 and/or playing card handling system 120 may, for example, employ a mathematical function, algorithm or lookup table.

The randomization of playing cards employs an RNG function to produce random virtual playing card values, based at least in part on the selected payout or house odds and/or house advantage. Performance of RNG on computers is well known in the computing arts. Mathematicians do not generally consider computer generated random numbers to be truly random, and thus commonly refer to such numbers as being pseudo-random. However such numbers are sufficiently random for most practical purposes, such as distributing playing cards to players. Hence, while we typically denominate the computer generated values as being random and the playing cards as being randomized, such terms as used herein and in the claims encompasses pseudo-random numbers and ordering, and includes any values or ordering having a suitable random distribution or probability of occurrence based on a selected set of odds or probabilities, whether truly mathematically random or not.

In some embodiments, the virtual playing card values may be computationally generated (e.g., via an RNG algorithm) executed by a suitable controller. In some embodiments, the virtual playing card values may be determined from predefined data that is randomly selected, such as from one or more lookup tables. For example, the virtual playing card values may comprise a sorted order, such as the order of playing cards in a new deck, prior to shuffling.

In order to reflect the selected payout or house odds and/or house advantage, the playing card handling system 120 may select or form a suitable domain of playing card values on which the RNG will operate. Thus, for example, the playing card handling system 120 may select or adjust the size of the domain, and/or the composition of the domain of playing card values before or while executing the RNG algorithm. Additionally, or alternatively, in order to reflect the selected payout or house odds and/or house advantage, the playing card handling system 120 may select suitable parameters for the RNG algorithm from a number of parameters, the parameters weighting or biasing the RNG algorithm towards or away from generating certain virtual playing card values. Additionally, or alternatively, in order to reflect the selected payout or house odds and/or house advantage, the playing card handling system 120 may select a suitable RNG algorithm from a number of RNG algorithms, the RNG algorithms weighted or biased towards or away from generating certain virtual playing card values.

As discussed above, the virtual playing card values may be generated one at a time, for example on an as needed basis. Alternatively, the virtual playing card values may be generated as subsets, or sets formed of two or more subsets. The particular approach may depend on the rules of the card game and whether playing cards will be dealt individual in groups such as packets.

The virtual playing card values may take a variety of forms. The virtual playing card values may take the form of electronic or other data that represent or are otherwise indicative of a playing card value (e.g., rank) or identity (e.g., rank and suit). The electronic data may, for example, take the form of an ordered list of virtual playing card values. The virtual playing card values may be generated from a domain of playing card values. The domain may include playing card values representative of respective ones of the playing cards in a standard, fifty-two (52) card deck. For example, the domain of playing card values consist of the integers 0-51, each associated with a respective rank and suit combination. Alternatively, the domain of playing card values may, for example, take the form of two integers, a first integer representing a rank (e.g., 0-12) and a second integer representing a suit (e.g., 0-13).

The domain of playing card values may comprise a fewer or greater number of playing cards than the number of playing cards in a standard, fifty-two (52) card deck. For example, the domain of playing card values may take the form of set of identifiers (e.g. serial) numbers that are each uniquely associated with a playing card from a set of playing cards greater than a standard deck of 52 playing cards. Thus, there may be two or more playing cards of the same rank and suit, each of which is identified by a unique identifier in the domain of playing card values. Alternatively, the domain may include fewer than an integer multiple of a standard fifty-two playing card deck.

Additionally or alternatively, the virtual sequence 120 may be determined from predefined data such as one or more lookup tables, for example a sorted order that corresponds to the order of cards, un-shuffled, from a new playing deck.

At 1212, the provides one or more playing cards based on one or more pseudo-randomly generated virtual play card values. The method 1200 may terminate at 1216, until the occurrence of another trigger event, or may continually repeat as a loop.

Detailed Discussion of Operation of Various Playing Card Handling Systems

The specific operation of the various playing card handling systems 120 to provide the randomized playing cards 518, 618, 718 is discussed in detail below.

Figure 13:
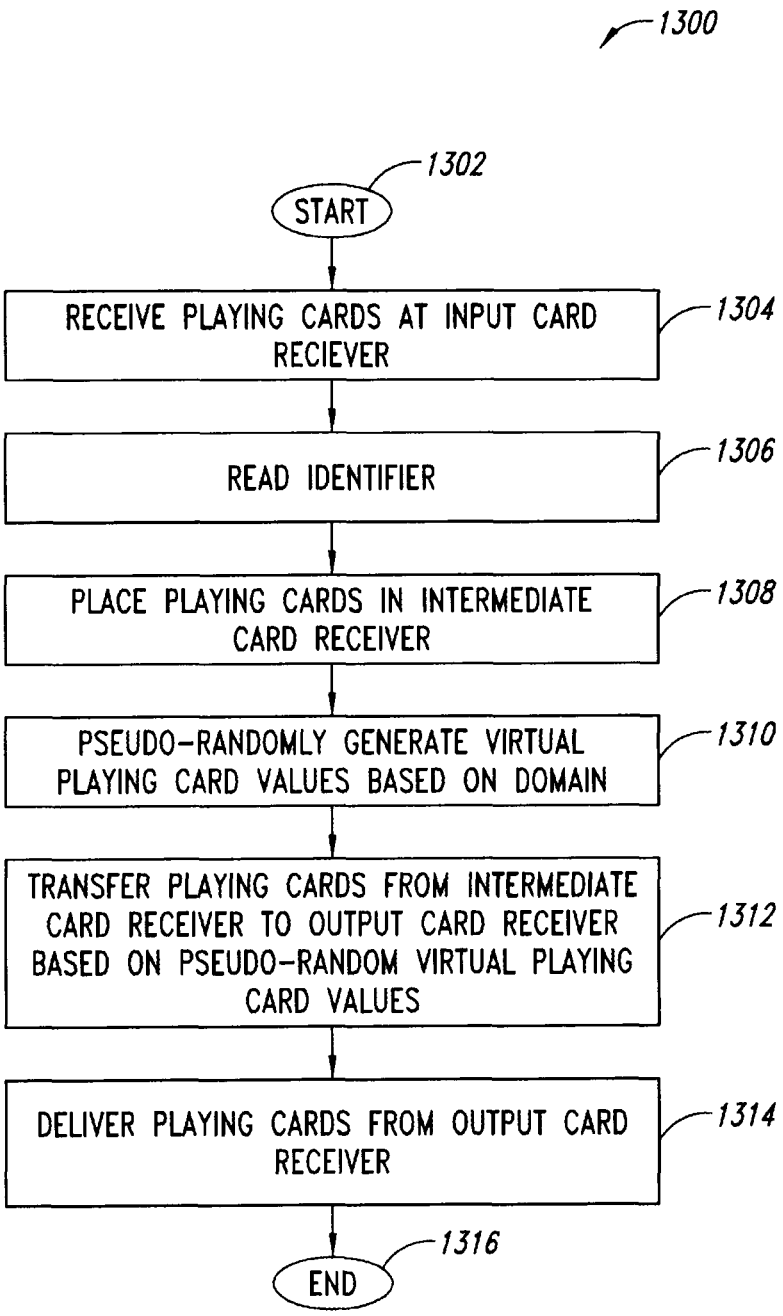
FIG. 13 is a flow diagram of a method of operating a playing card handling system such as that illustrated in FIGS. 5A, 5B and 6A, according to one illustrated embodiment.

FIG. 13 shows a method 1300 of operating one of the playing card handling systems 120*a*, 120*b*, according to one illustrated embodiment starting at 1302.

At 1304, the playing card handling system 120*a*, 120*b* (FIGS. 5A, 5*b*, 6A) receives collected playing cards 515, 616 at the playing card input receiver 504, 604. At 1306, the playing card reading sensor 513, 613 reads identifying information from the playing cards. At 1308, the playing card handling system 120*a*, 120*b* places the playing cards in one or more of the intermediary playing card receivers 510, 512, 610, 612. The playing card handling system 120*a*, 120*b* may advantageously place each playing card in a closest empty card receiving compartment of the intermediary playing card receiver 510, 512, 610, 612. The most immediate empty card receiving compartment may be the card receiving compartment that is nearest the playing card transport path based on movement of the intermediary playing card receiver 510, 512, 610, 612 in either of two directions of movement (e.g., clockwise/counterclockwise, or up/down). This advantageously reduces the time to load the intermediary playing card receivers 510, 512, 610, 612. The playing card handling system 120*a*, 120*b* keeps track of the identity of the playing cards in the respective card receiving compartments.

At 1310, the playing card handling system 120*a*, 120*b* randomly or pseudo-randomly generates one or more virtual playing card values based on a domain, parameters, and/or RNG function. Such has been discussed in detail above.

At 1312, the playing card handling system 120*a*, 120*b* transfers playing cards from the intermediary playing card receiver 510, 512, 610, 612 to the output card receiver 506, 606, based on the random or pseudo-random virtual playing card values. Thus, the playing card handling system 120*a*, 120*b* may advantageously select and/or otherwise remove playing cards from the intermediary playing card receivers 510, 512, 610, 612 in a random order.

At 1314, the playing card handling system 120*a*, 120*b* delivers the playing cards from the output card receiver 506, 606. The method 1300 terminates at 1316.

Figure 14:
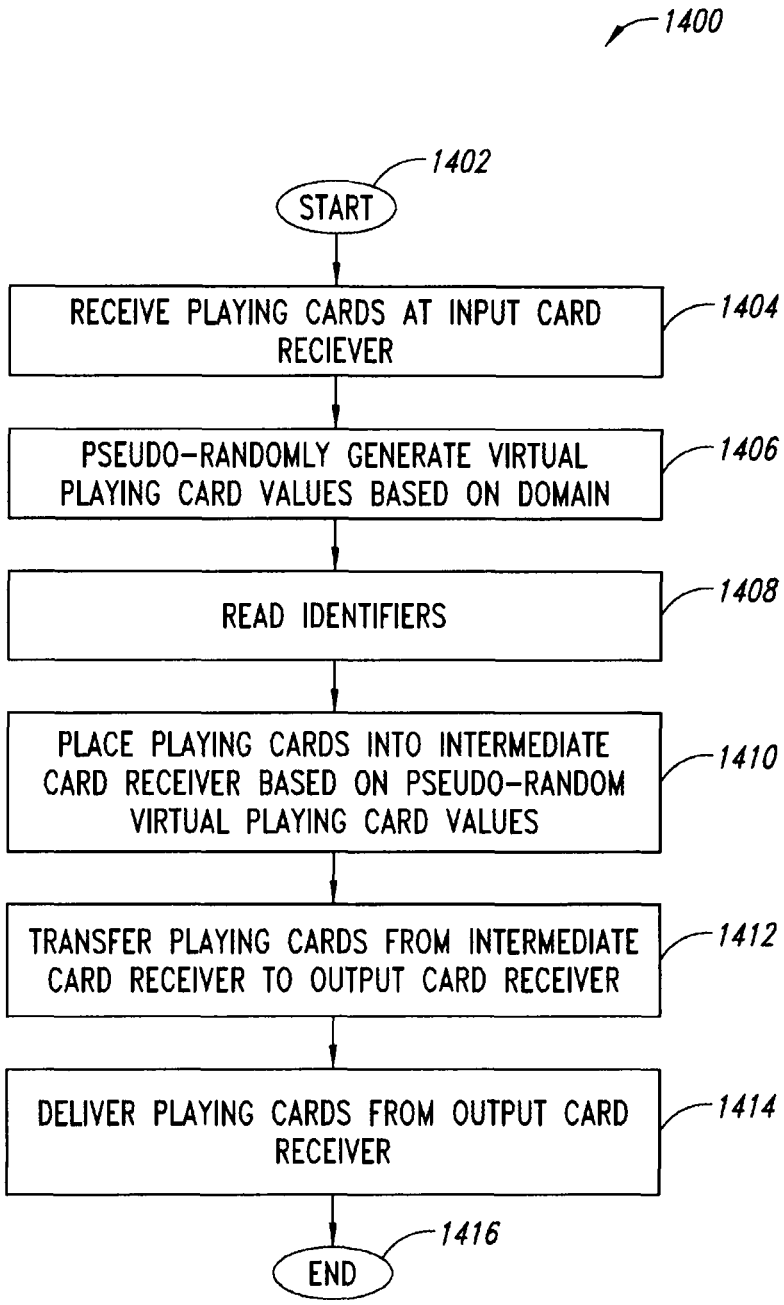
FIG. 14 is a flow diagram of a method of operating a playing card handling system such as that of FIGS. 5A, 5B and 6A, according to one illustrated embodiment.

FIG. 14 shows a method 1400 of operating a playing card handling system 120*a*, 120*b* according to another illustrated embodiment, starting at 1402.

At 1404, the playing card handling system 120*a*, 120*b* receives collected playing cards 515, 616 at the playing card input receiver 504, 604. At 1406, the playing card handling system 120*a*, 120*b* randomly or pseudo-randomly generates virtual playing card values based on a domain, parameters, and or RNG function. Such has been described in detail above and will not be repeated in the interest of brevity. At 1408, the playing card reading sensor 513, 613 reads identifiers from the playing cards.

At 1410, the playing card handling system 120*a*, 120*b* places playing cards into one or more of the intermediary playing card receivers 510, 512, 610, 612 based at least in part on the random or pseudo-random virtual playing card values. The playing card handling system 120*a*, 120*b* keeps track of the identity of the playing cards in the respective card receiving compartments. At 1412, the playing card handling system 120*a*, 120*b* transfers playing cards from the intermediary playing card receiver 510, 512, 610, 612 to the output card receiver 506, 606. At 1414, the playing card handling system 120*a*, 120*b* delivers playing cards from the output card receiver 506, 606. The method 1400 terminates at 1416.

Figure 15:
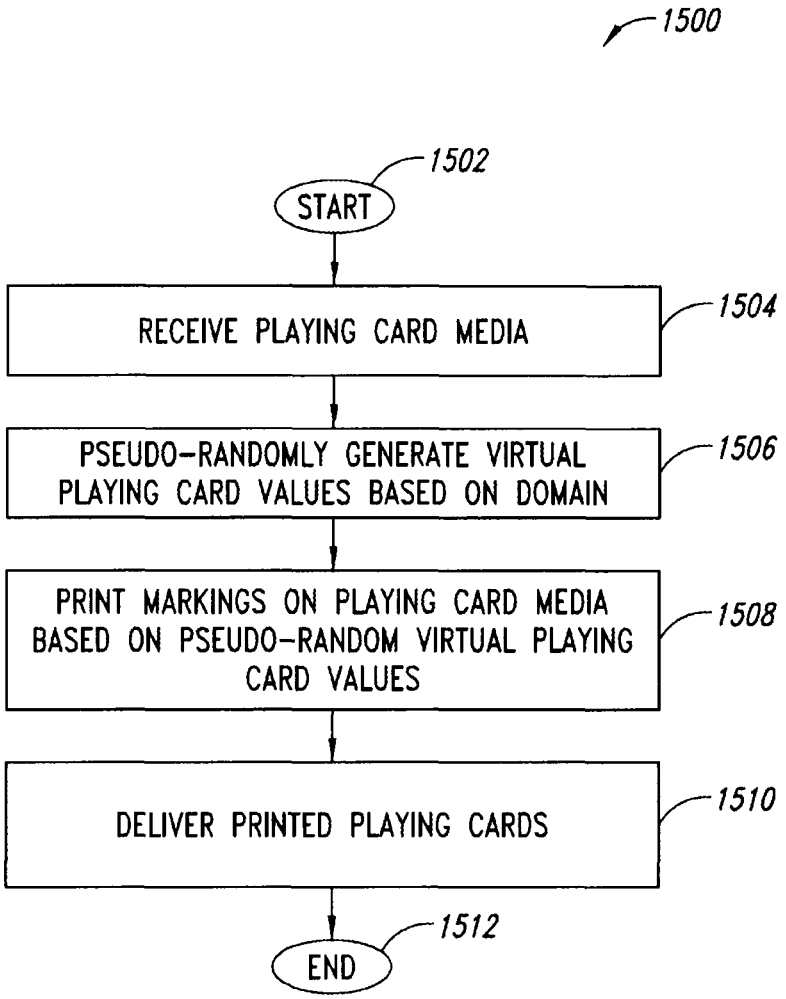
FIG. 15 is a flow diagram of a method of operating a playing card handling system such as that of FIG. 7, according to one illustrated embodiment.

FIG. 15 shows a method 1500 of operating a playing card handling system 120*c* (FIG. 7), according to one illustrated embodiment.

The method 1500 starts at 1502, for example, in response to activation of a switch by a user, detection of playing card media 702 at the playing card media input receiver 704 or detection of a lack of playing cards at the playing card output receiver 706. At 1504, the playing card handling system 120*c* receives playing card media 702 at a playing card input receiver 704. At 1506, the playing card handling system 120*c* randomly or pseudo-randomly generates virtual playing card values based on a domain, parameters, and/or RNG function. The determination or selection of the domain, parameters, and/or RNG function is discussed above and is not repeated here in the interest of brevity.

At 1508, the playing card handling system 120*c* forms markings on the playing card media based on the random or pseudo-random virtual playing card values. The markings may take the form of one or more markings indicative of a playing card value (e.g., rank, suit, and/or point value). The markings may include additional indicia, for example, pips, traditional indicia such as drawings of jacks, queens, kings, ornamental designs, or nontraditional value markings.

At 1510, the playing card handling system 120*c* delivers playing cards at the playing card output receiver 706. The method 1500 terminates at 1512.

Operation of the Card Management Processing System

Figure 16:
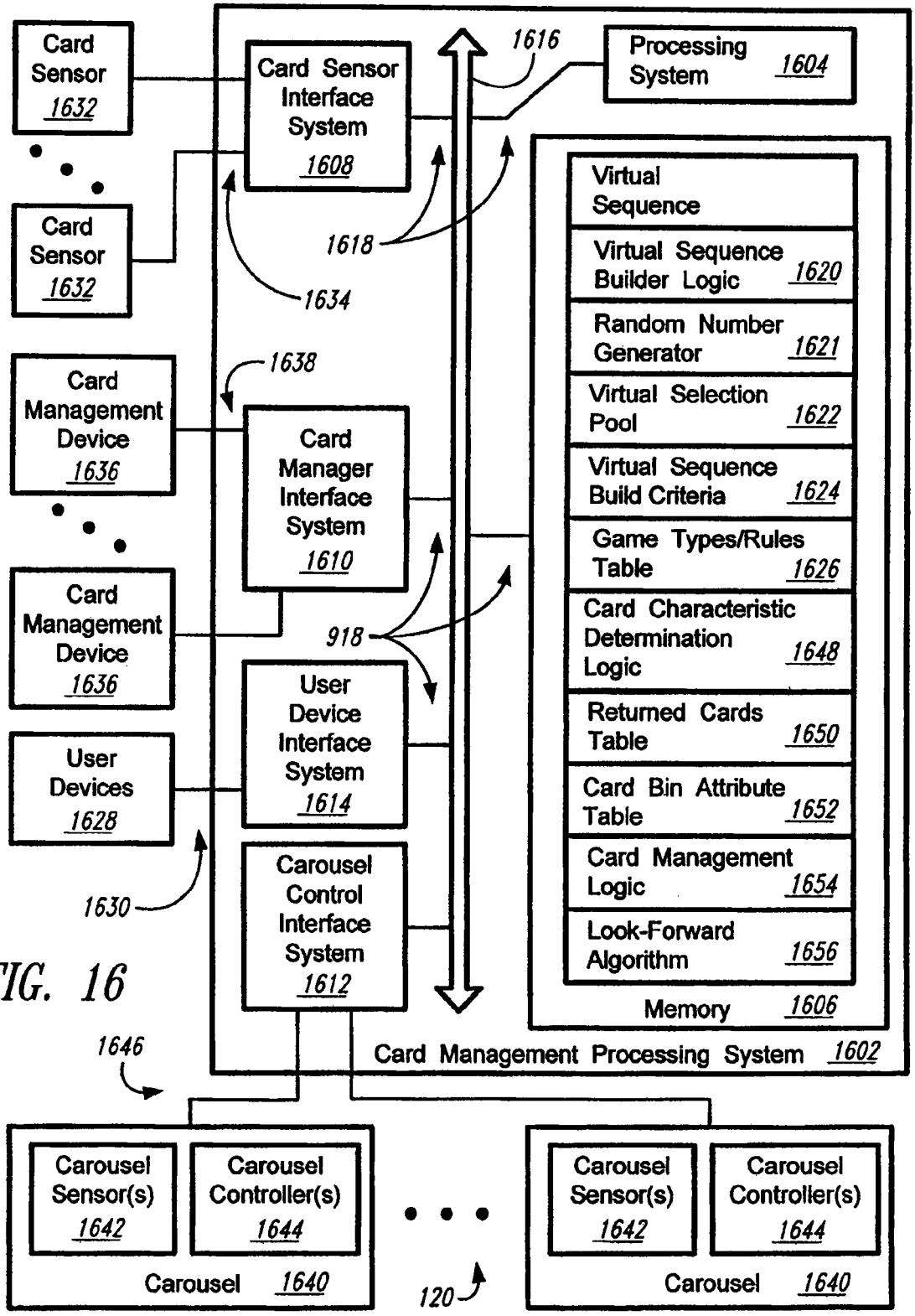
FIG. 16 is a simplified block diagram illustrating an embodiment of a processing system which controls various operating functions of a card handling system, according to one illustrated embodiment.

FIG. 16 is a simplified block diagram illustrating an embodiment of a card management processing system 1602 which controls various operating functions of the playing card handling system 120*a*, 120, according to one illustrated embodiment. The card handling processing system 1602 comprises a processing system 1604, a memory 1606, a card sensor interface system 1608, a card manager interface system 1610, a carousel control interface system 1612 and a user device interface system 1614.

For convenience, processing system 1604, memory 1606, card sensor interface system 1608, card manager interface system 1610, carousel control interface system 1612 and user device interface system 1614 are illustrated as communicatively coupled to each other via communication bus 1616, via connections 1618, thereby providing connectivity between the above-described components. In alternative embodiments of the card management system 104, the above-described components are connectively coupled in a different manner than illustrated in FIG. 16. For example, one or more of the above-described components may be directly coupled to each other or may be coupled to each other via intermediary components (not shown).

A plurality of logic and data modules, described in greater detail hereinbelow, reside in memory 1606. Such logic and data modules are retrieved by processing system 1604 as required during the various operations.

The interface systems, described in greater detail hereinbelow, communicate information to and from the processing system 1604 in a format suitable for the processing system 1604, and communicate information to and from various external devices, also described in greater detail hereinbelow, in a format suitable for such external devices.

For convenience, the interface systems described below are illustrated by a single block. However, such interface systems may be a plurality of individual interface devices, each interface coupled to one or more related external devices. Furthermore, the interface systems are illustrated as residing within the card management processing system 1602. The interface systems, or individual interface devices associated with one of the described interface systems, may reside external to the card management processing system 1602. For example, a sensor may be configured to sense a characteristic of a card (e.g., standard or non-standard rank and/or suit markings or other identifiers, whether optical, electrical, magnetic or otherwise). Output of the sensor may be an analog signal, such as a voltage or a current, that corresponds to the detected card characteristic. A device coupled to the sensor may convert the analog signal from the sensor into a signal that is communicated directly to the card management processing system 1602. All such modifications and variations of sensors and/or card management devices, and modifications and variations of interface systems and/or devices, are intended to be included within the scope of this disclosure and intended to be protected by the accompanying claims.

The virtual card builder logic 1620 residing in memory 1606 determines a plurality of virtual cards that are used to build a virtual sequence 120 (see also FIG. 1). A random number generator (RNG) 1621 or the like may define a sequential order of virtual cards, wherein the virtual cards have values and/or characteristics that correspond to the resulting dealable cards 118 and inventory cards 112 that are used to play the card game. As previously discussed, a standard 52-card deck of playing cards has a value that is determined by the card rank and the card suit. In one embodiment, a virtual selection pool 1622 is generated with values that correspond to the standard 52-card deck of playing cards. The virtual cards from the virtual selection pool 1622 are generated by the virtual card builder logic 1620 based upon the particulars of the algorithms used by the random number generator 1621 to generate the virtual sequence 120, which may be stored in memory 1606.

A virtual sequence criteria 1624 is used to define parameters that the virtual card builder logic 1620 uses to generate the virtual sequence 120. An exemplary parameter may be a specified number of standard 52-card decks that are to be used to construct the virtual sequence 120. Individual, virtual cards are removed from the virtual selection pool 1622 and arranged according to a sequence, computationally generated with a random number generator 1621.

By way of example, the virtual sequence criteria 1624 may specify that eight (8) standard 52-card decks comprise the virtual selection pool 1622. Accordingly, the virtual card builder logic 1620 uses the virtual selection pool 1622 of four-hundred-sixteen virtual cards (corresponding to 8 decks of 52 physical cards each), where there are eight virtual cards of each particular value (e.g., rank/suit combination). Accordingly, in this example, there are initially eight aces-of-spade values (A♠), eight kings-of-spade values (K♠), eight queens-of-spade values (Q♠), and so on.

As the virtual sequence 120 is generated, the number of available virtual cards in the virtual selection pool 1622 is accordingly reduced. In the example above, if the first virtual card is the A♠, then the total population of available virtual cards in the virtual selection pool 1622 decreases from 416 to 415. The next virtual card is then selected from the remaining 415 cards, of which there are only seven A♠ remaining (along with eight each of the other values available in eight (8) standard 52-card decks). It is appreciated that subsequent virtual card selections will be made from only those virtual cards presently available in the virtual selection pool 1622. Consequently, the virtual sequence 120 is generated and stored in memory 1604. This virtual sequence 120 may be viewed to correspond to a randomly shuffled, actual group of playing cards. Returning to the above example, the virtual sequence 120 would correspond to eight standard 52-card decks that are physically shuffled together.

In another embodiment, the size of the virtual selection pool 1622 is not reduced as virtual cards are selected during generation of the virtual sequence 120. That is, for each selection of a virtual card, the probability of a particular card value being selected remains constant. For example, if a group of deliverable cards 114 is to be constructed from a standard 52-card playing deck, the probability of the first card having a value of the A♠ is 1/52. When the second virtual card (and subsequent virtual cards) is selected for the virtual sequence 120, the probability of the second virtual card (and virtual subsequent cards) having a value of the A♠ remains at 1/52. That is, the selection of virtual cards from the selection pool 120 is operating similar to the manner in which an electronic slot machine is operating (wherein the probability of a symbol occurrence on the payout line remains constant as reel spins are simulated). In this situation, the virtual selection pool 1622 could be simplified to correspond to one of each of the values of cards in the game. (For example, the virtual selection pool for a standard 52-card playing deck would be 52 virtual cards, wherein each virtual card uniquely corresponds to a unique rank and suit combination.) The virtual sequence criteria 1624 may also define other parameters that the virtual card builder logic 1620 uses to add, delete, or modify the value of at least one of the virtual cards in the virtual selection pool 1622. For example, one of the parameters may set a specified number of "wild" cards that are to be added into the virtual selection pool 1622. The "wild" cards could be the two Joker cards that typically accompany the standard 52-card deck. The wild cards may be used by the participants to augment or enhance their hand of cards.

In the above example where the initial virtual selection pool 1622 of virtual cards is based upon eight card decks, the sixteen Jokers (2 Jokers per deck times 8 decks of cards) could be added to the virtual selection pool 1622 to increase the total population of initially-available virtual cards to 432. Alternatively, any desired number of Jokers, or other specialty-type cards, could be added to the virtual selection pool 1622 in accordance with the rules (parameters) of the particular card game and/or casino rules. Specialty-type cards may be redeemable for prizes or bonuses, and may or many not have the identity of the prize displayed on the card. Such cards may also include unique identifiers to assist in redemption.

Other types of parameters may be specified in the virtual sequence criteria 1624. For example, different types of card games may be defined in the optional game type/rules table 1626. For example, rules for the card game UNO® may reside in the game type/rules table 1626. UNO® cards are defined by colors, text and/or numerals and do not resemble the cards of a standard 52-card deck. If the card management processing system 1602 is instructed to build a virtual sequence 120 for the card game of UNO®, information defining the UNO® cards can be retrieved from the optional game type/rules table 1626. This information may then be used to modify one or more of the parameters in the virtual sequence criteria 1624. For example, the characterization of a card may be changed from rank and suit to the colors, text and/or numerals of UNO® cards. Accordingly, the virtual selection pool 1622 would be constructed from the specified number of UNO® decks using UNO® virtual cards.

User device interface system 1614 provides an interface means to one or more external user devices 1628 configured to receive input or instructions from an individual such as a dealer, pit boss, or other casino employee. Any suitable user device 1628 may be configured to communicate with the card management processing system 1602, via connection 1630. Non-limiting examples of external user devices 1630 include key boards, memory media devices (such as flash cards, floppy disks, compact disks (CDs), micro disks, or the like), touch sensitive visual screens, or another processing system. Furthermore, connection 1630 is illustrated for convenience as a hardwire connection to the user device interface system 1614. In other embodiments, connection 1630 may be replaced with another suitable media, such as, but not limited to, a radio frequency media, an infrared media, or other wireless media. If another media is employed by alternative embodiments, the user device interface system 1614 could be configured to receive information from the external user device 1628 via the other media. The user device interface system 1614 would then reconfigure the information to a medium suitable for communication over communication bus 1616. Additionally, the user device interface system 1614 may be configured to receive information from a plurality of user devices 1628 in other embodiments. In yet other embodiments, the card management system 104 may output information of interest to various external devices, via the user device interface system 1614.

Card sensor interface system 1608 is configured to receive information from the various sensors of the card management system 104. For convenience, card sensor interface system 1608 is illustrated as being coupled to a plurality of card sensors 1632, via connections 1634. The card sensor interface system 1608 may be configured to receive information from other types of sensors. Such card sensors and other types of sensors are described in greater detail above. Thus, the card sensor interface system 1608 is configured to receive information from card sensors 1632, and then reconfigure the received information into a medium suitable for communication over the communication bus 1616. Furthermore, connections 1634 are illustrated for convenience as a hardwire connection to the card sensor interface system 1608. In other embodiments, one or more of the connections 1634 may be replaced with another suitable media, such as, but not limited to, a radio frequency media, an infrared media, or other wireless media.

Card manager interface system 1610 is configured to provide control signals or information to various devices of the card management system 104. For example, motor 226, described above, is operated to lift the elevator 208 (FIGS. 2A-D) such that the dealer or a card player may access the dealable cards 118. Motor 226 then retracts the elevator 208 after the dealable cards 118 are removed so that the card management process may continue to build another group of deliverable cards 114. The card manager interface system 1610 provides signals to the motor 226 to cause movement of the card elevator 208 relative to the structure 202.

For convenience, the card manager interface system 1610 is illustrated as being communicatively coupled to a plurality of card management devices 1636, via connections 1638. The card management devices 1636 are generally electromechanical devices that are actuatable by an electrical signal. The card manager interface system 1610 is configured to receive instructions for the card management devices 1636 from processing system 1604, and is configured to generate and communicate the electrical signal to a card management device 1636 using a suitable signal format. In some situations, the electrical signal may directly control an electromechanical devices, such as when a suitable operating voltage and/or current is provided. In other situations, the electrical signal may be a digital or analog control signal communicated to another controller which actuates the electromechanical device. Furthermore, connections 1638 are illustrated for convenience as a hardwire connection to the card manager interface system 1610. In other embodiments, one or more of the connections 1638 may be replaced with another suitable media, such as, but not limited to, a radio frequency media, an infrared media, or other wireless media.

Storage device control interface system 1612 is configured to receive information from the various storage device sensors 1642 and to provide electrical signals to the various controllers 1644, via connections 1646, residing in the plurality of carousels 1640. In one embodiment, carousels 1640 correspond to the two carousels 510, 512 (FIGS. 5A, 5B) or another suitable storage device. Sensors 1642 and controllers 1644 are described in greater detail below (see, for example, FIG. 12). Connections 1646 are illustrated for convenience as a hardwire connection to the card manager interface system 1610. In other embodiments, one or more of the connections 1646 may be replaced with another suitable media, such as, but not limited to, a radio frequency media, an infrared media, or other wireless media.

In accordance with the various embodiments described herein, sensor devices are employed to determine the characteristics and/or value of an individual card. For example, in the game that employs a standard 52-card deck, each card is uniquely identifiable by a unique value, its rank and suit symbols. Sensor means are employed to detect information from each card that may be used to identify the card. For example, one embodiment employs machine-readable symbol reader systems such as a bar code reader system to read machine-readable symbols such as bar code information printed on each card (typically using a non-visible medium such as ultraviolet sensitive ink or the like). As the card passes in proximity to the sensor configured to detect the information on the card, the sensor communicates the information corresponding to the detected bar code to the above-described card sensor interface system 1608. The card sensor interface system 1608 then formats and communicates the information to processing system 1604.

Processing system 1604 retrieves and executes the card characteristic determination logic 1648 to analyze the detected attributes and/or characteristics of the sensed card. Accordingly, the physical card is uniquely identifiable. For example, if a bar code reader system is employed to read barcode information on a sensed card, the card characteristic determination logic 1648 can determine the unique character of the card. Thus, if a traditional 52-card deck is being used for a card game, the sensed physical card can then be uniquely identified by its rank and suit symbols (for example, the A♠ card is uniquely identifiable by the letter "A" and the symbol "♠" and have a machine-readable symbol residing thereon indicating this value). Alternatively, each playing card may carry an identifier that is unique over more than fifty-two cards.

Other types of sensors may be used to sense attributes and/or characteristics of a sensed physical card. For example, a sensor sensitive to color may be used to determine the color of the playing surface of the sensed cars, such as a color-coded UNO® card. A character recognition sensor such as, but not limited to a charge coupled device (CCD) array, may be used to sense information corresponding to characters on the playing surface of the card. The card characteristic determination logic 1648 may then interpret the sensed information using one or more character recognition algorithms to determine a text and/or character attribute of the sensed card. For example, if a traditional 52-card deck is being used for a card game, the sensed text and/or character attribute of the sensed card can then be uniquely identified by its rank and suit symbols (for example, the A♠ card is identifiable by the letter "A" and the symbol "♠"). Or, if a color-coded UNO® card with text is sensed, the UNO® card can be uniquely identified through a combination of text recognition and color recognition (for example, a yellow colored "Skip" card is identifiable by its yellow color and the printed text "Skip").

As noted above, the dealer or other player returns collected cards 108 (FIG. 1) to the card management system 104. As a collected card 108 passes in proximity to and is sensed by the above-described sensors such that the card characteristic determination logic 1648 determines the unique identifier of the sensed card 108, the identifying information for the sensed collected card 108 is stored in the returned cards table 1650. Accordingly, a log of the sequence of collected cards 108 is generated and stored in the returned cards table 1650. Such information may be useful for security purposes, player tracking, card usage data, etc.

For example, the identity and location of each card in the deliverable cards 114 (FIG. 1) are known. As in-play cards 106 are placed in play, the processing system 1604 (FIG. 16) may anticipate which cards are expected to be in play at the gaming table 102. Accordingly, the processing system 1606 may execute logic to anticipate what playing cards may be expected to be discarded during the current card game. If a player mistakenly or purposefully retains one of the in-play cards 106, the retained card will not end up in the group of collected cards 108. The processing system 1606 may then recognize that one of the in-play cards 106 was not returned, which may result in some form of communication to the dealer or another authority. Similarly, an imposter card inserted during or after the card game can also be recognized by the processing system 1604. The processing system 1606 may then generate and communicate an appropriate signal to the dealer or another authority indicating the presence of the imposter card.

As noted herein, the plurality of card receiving compartments 302 of the carousels 210, 212 (FIG. 2) are uniquely associated with a card value. For example, one of the card receiving compartments 302 may be uniquely associated with the A♠. When the A♠ is returned to the card management system 104 as a collected card 108, the processing system 1604 executes the card characteristic determination logic 1648 to identify the collected card 108. For example, if the A♠ card is the collected card 108 and is identified accordingly, the A♠ card is returned to the appropriately assigned card receiving compartment 302. After the A♠ card is returned to the appropriate card receiving compartment 302, that A♠ card is now referred to as an inventory A♠ card 112. Thus, the card receiving compartment attribute table 1652 is a definable table wherein card receiving compartments 302 (FIG. 3) are uniquely assigned a particular card type or card value. It is appreciated that any characteristic of a card may be used to associate a card and its assigned card receiving compartment 302. Since the information corresponding to the associated card characteristic and the card receiving compartment 302 is stored in the card receiving compartment attribute table 1652, any card may be identified and stored and/or retrieved from its assigned card receiving compartment 302 by the various embodiments as described herein. If not all card receiving compartments 302 are assigned in a game, those card receiving compartments 302 may be later defined as needed and/or not used during game play.

As noted above, embodiments of the card management system 104 perform various operations on the physical cards using a variety of electro-mechanical devices. Also, various sensors provide information to the card management processing system 1602. The various logical processes, comprising software and/or executable code, are generally represented by the card management logic 1654. The card management logic 1654 may be comprised of a plurality of unique logic segments or programs, and/or may be comprised of a multi-function, integrated logic segment or program, as described herein.

When logic 1608 is implemented as software and stored in memory 1606, one skilled in the art will appreciate that logic 1620, 1648, 1654 and/or 1656, or that the information of 1622, 1624, 1626, 1650 and or 1652, can be stored on any computer readable medium for use by or in connection with any computer and/or processor related system or method. In the context of this document, a memory 1606 is a computer readable medium that is an electronic, magnetic, optical, or other another physical device or means that contains or stores a computer and/or processor program. Logic 1620, 1648, 1654, and/or 1656, and/or the information of 1622, 1624, 1626, 1650 and or 1652 can be embodied in any computer readable medium for use by or in connection with an instruction execution system, apparatus, or device, such as a computer-based system, processor-containing system, or other system that can fetch the instructions from the instruction execution system, apparatus, or device and execute the instructions associated with logic 1620, 1648, 1654, and/or 1656, and/or the information of 1622, 1624, 1626, 1650 and or 1652. In the context of this specification, a "computer readable medium" can be any means that can store, communicate, propagate, or transport the program associated with logic 1620, 1648, 1654, and/or 1656, and/or the information of 1622, 1624, 1626, 1650 and or 1652 for use by or in connection with the instruction execution system, apparatus, and/or device. The computer readable medium can be, for example, but not limited to, an electronic, magnetic, optical, electromagnetic, infrared, or semiconductor system, apparatus, device, or propagation medium. More specific examples (a nonexhaustive list) of the computer readable medium would include the following: an electrical connection having one or more wires, a portable computer diskette (magnetic, compact flash card, secure digital, or the like), a random access memory (RAM), a read-only memory (ROM), an erasable programmable read-only memory (EPROM, EEPROM, or Flash memory), an optical fiber, and a portable compact disc read-only memory (CDROM). Note that the computer-readable medium, could even be paper or another suitable medium upon which the program associated with logic 1620, 1648 and/or 1654, and/or the information of 1622, 1624, 1626, 1650 and or 1652 is printed, as the program can be electronically captured, via for instance optical scanning of the paper or other medium, then compiled, interpreted or otherwise processed in a suitable manner if necessary, and then stored in memory 1606.

The above-described card processing management system 1602 may, in one embodiment, reside within the card handling system 120 as an internal, integrated component. In another embodiment, the card processing management system 1602 may be external to the card management system 104 as a stand alone device. Or, if external, the card processing management system 1602 may be part of another system having other functionality. In such embodiments, the 1634, 1634, 1638 and/or 1646 could include suitable convenient plug-in connector devices to facilitate coupling between the external card processing management system 1602 and the card management system 104.

Processing system 1604 (FIG. 16) is illustrated for convenience as residing in the various embodiments of the card management processing system 1602. It is understood that any suitable processor system 1604 may be employed. Processing system 1604 may be a specially designed and/or fabricated processing system, or a commercially available processor system. Non-limiting examples of commercially available processor systems include, but are not limited to, an 80x86 or Pentium series microprocessor from Intel Corporation, U.S.A., a PowerPC microprocessor from IBM, a Sparc microprocessor from Sun Microsystems, Inc., a PA-RISC series microprocessor from Hewlett-Packard Company, or a 68xxx series microprocessor from Motorola Corporation.

Figure 17:
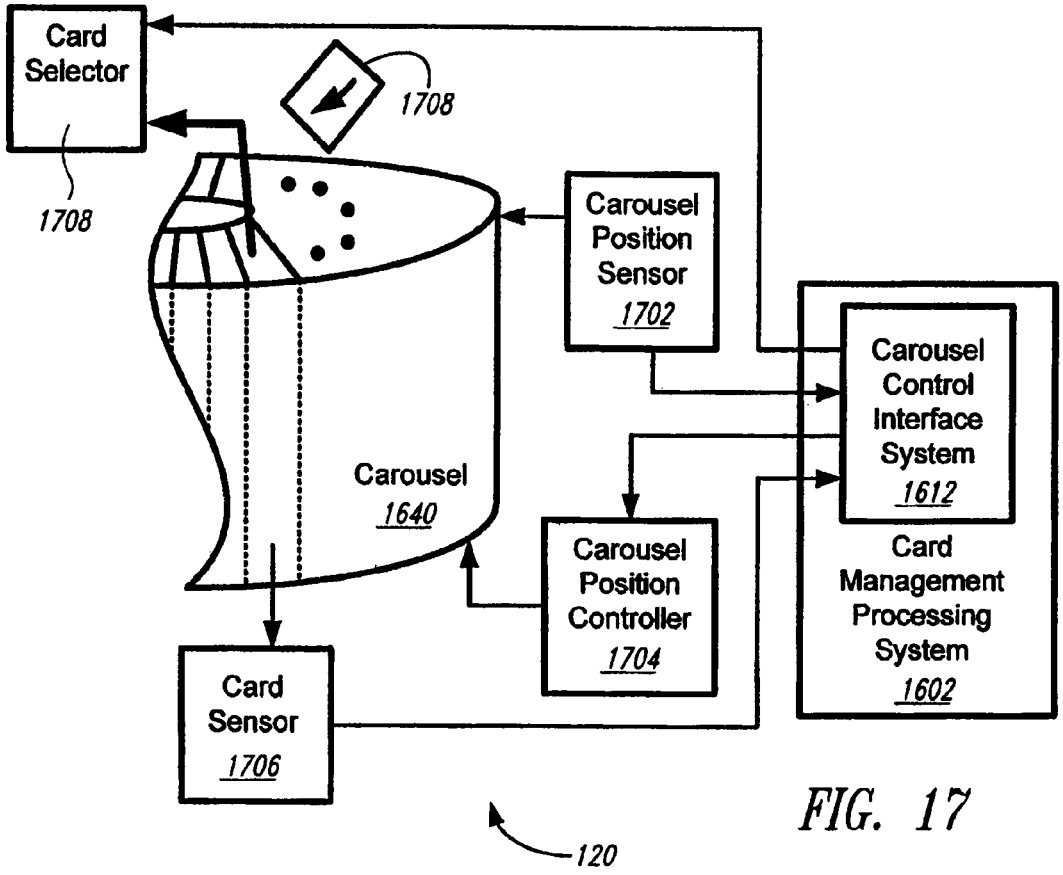
FIG. 17 is a simplified block diagram of the carousel control interface system communicatively coupled to an exemplary carousel.

FIG. 17 is a simplified block diagram of the carousel control interface system 1612 communicatively coupled to an exemplary carousel 1640. Carousel 1640 may correspond to the above-described carousels 510, 512, 610, 612. As noted herein, inventory cards are drawn from the playing card receiving compartments by the card selector 1708 to construct the set of randomized playing cards 518, 618. Similarly, collected cards 515, 615, which are then referred to as transitional cards (as they travel through the above described card paths) are inserted to their associated card receiving compartment (now referred to as transitional inventory cards) such that the card receiving compartments are restocked.

To select inventory cards from an appropriate playing card receiving compartment, the carousel is rotated into alignment with the card selector 1708. Carousel position sensor 1002 detects position of the carousel 1640. In another embodiment, upon initialization of the card handling system 120 or at another suitable time, carousel position sensor 1002 detects at least one fixed point on the carousel 1640. As the carousel subsequently rotates, the position of any card receiving compartment relative to the carousel position sensor 1702 is computationally determinable (in accordance with code instructions or logical instructions of the card management logic 1654, FIG. 16).

To select any particular inventory card, that particular inventory card is determined based upon the current virtual playing card value of the sequence of virtual playing card values 1900 that is to be constructed. Once identified, the inventory card needs to be selected from its corresponding card receiving compartment. The card management logic 1654, using information in the card receiving compartment attribute table 1652, determines the relative location of card receiving compartment associated with the desired inventory card. Carousel position controller 1704 (which may correspond to the above-described motor coupled to the carousel gear in one exemplary embodiment) is configured to rotate the carousel 1640 such that the appropriate playing card receiving compartment is moved into alignment with the card selector 1708. Then, card selector 1708 may select the desired inventory card from the playing card receiving compartment. (One exemplary above-described embodiment employs a friction roller, residing in the selector body and which is rotationally fixed to a portion of the shaft. Friction roller is rotated by the shaft, wherein the rotation of the friction roller selects the desired inventory card from the playing card receiving compartment. Other suitable card selecting devices, system or means may be used by other embodiments.)

In some situations, a desired inventory card may not reside in the corresponding playing card receiving compartment. Card sensor 1706 senses at least the presence or absence of an inventory card in its corresponding playing card receiving compartment. Information corresponding to the presence or absence of the inventory card in its respective playing card receiving compartment is communicated to the card management processing system 1602, via the carousel control interface system 1612. As described in greater detail hereinbelow, the card management system 1604 must then wait for the desired card to be returned into the system as a collected card.

To deliver a transitional card into the appropriate playing card receiving compartment the carousel 1640 is rotated into alignment with the card transport path or branch 1708. The current transitional card is identified based upon detected characteristics of the transitional card. Once identified, the transitional card needs to be inserted into its corresponding playing card receiving compartment. The card management logic 1654, using information in the card receiving compartment attribute table 1652, determines the relative location of playing card receiving compartment associated with the incoming transitional card. Carousel position controller 1704 (which may correspond to the above-described motor coupled to the carousel gear in one exemplary embodiment) is configured to rotate the carousel 1640 such that the appropriate playing card receiving compartment is moved into alignment with the carousel branch 1708 which will deliver the transitional card into the appropriate playing card receiving compartment.

In one embodiment, the carousel position controller 1704 is a motor or the like configured to rotate the carousel 1640, where a suitable electrical signal such as a voltage or a current is received from the carousel control interface system 1612. In another embodiment, the carousel position controller 1704 is a motor and a controller, where a suitable control signal is received from the carousel control interface system 1612. A gear, chain or belt system may be used to couple the carousel position controller 1704 to the carousel 1640 in some embodiments. On other embodiments a shaft of a motor of the carousel position controller 1704 is coupled to a shaft of the carousel 1640 (or may be the same shaft). Any suitable coupling means, system or method may be used to couple the carousel position controller 1704 with the carousel 1640 to effect rotation of the carousel 1640.

It is appreciated that with embodiments having a plurality of card carousels 1640, each of the plurality of card carousels 1640 are simultaneously and independently controllable by the look-forward algorithm 1656. For example, a "next" inventory card 112 to be retrieved from a first carousel may be retrieved by adjusting the position of the carousel 1640 such that the card selector 1708 is in proximity to the card receiving compartment 302 wherein the "next" inventory card 112 resides. Concurrently, another carousel 1640 may have the "next+1" inventory card in one of its playing card receiving compartments, wherein the "next+1" inventory card is to be selected after the above-described "next" inventory card is selected and transported to the set of randomized playing cards 518, 618. While the position of the carousel having the "next" inventory card is adjusted, the card management system 1602 may concurrently and/or independently cause the position of the other carousel having the "next+1" inventory card to be adjusted. Then, shortly after the "next" inventory card is selected, the "next+1" inventory card can be selected since the other carousel 1640 having that playing card is already in position for selection of the "next+1" inventory card.

Alternatively, a collected card 515, 615 (now a transitional card), that is being transported to its designated playing card receiving compartment, has its value read by one of the card sensors 1632. Upon identification of the value, the position of the destination carousel 1640 may be adjusted so that its card receiving compartment is in proper position so that the collected card 515, 615 may be deposited into the appropriate playing card receiving compartment (now referred to as an inventory card). Concurrently, another carousel 1640 may have its position adjusted for operation on an inventory card in one of its playing card receiving compartments, or may have its position adjusted to receive another identified transitional card (previously a collected card).

Summarizing, the look-forward algorithm 1656 (FIG. 16) is configured to monitor physical cards in the various stages of transport over paths or branches, and coordinate the transport of physical cards with positioning of carousels and/or with construction of the set of randomized playing cards 518, 618. That is, when a transitional card is available for redirecting to the playing card output receiver 506, 606 for inclusion as a member of the set of randomized playing cards 518, 618, the transitional card may be said to be in a "window of opportunity" for diversion from its destination carousel 1640 (where it would otherwise be an inventory card 112) to the playing card output receiver 506, 606.

Figure 18:
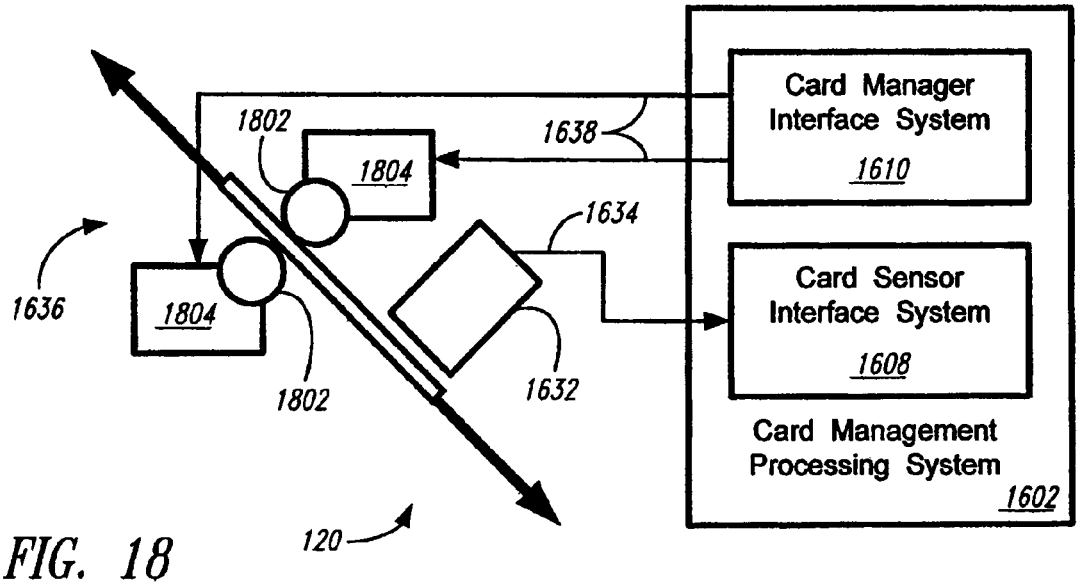
FIG. 18 is a simplified block diagram of the card manager interface system communicatively coupled to an exemplary card management device and a card sensor interface system coupled to an exemplary cards sensor.

FIG. 18 is a simplified block diagram of the card manager interface system 1612 communicatively coupled to an exemplary card management device 1636 and a card sensor interface system 1608 coupled to an exemplary cards sensor 1632. As noted herein, collected cards 515, 615 are received after they have been played, and are transported (now referred to as transitional cards) along various playing card transport paths or branches to be inserted to their associated playing card receiving compartment (thereby referred to as inventory cards) such that the card receiving compartments are restocked. (In some situations, the transitional card may be redirected directly to the set of randomized playing cards 518, 618 if that value of that particular transitional card corresponds to the value of the next card to be added into the set of randomized playing cards 518, 618.)

Card sensor 1632 detects attributes and/or characteristics of the sensed physical transitional card as it moves along intermediate branch or another branch. Information corresponding to the detected attributes and/or characteristics is communicated to the card management processing system 1602, via the card sensor interface system, such that the unique identity of the current transitional card is determined.

Card management device 1636 is illustrated as a roller device for convenience. Two rollers 1802 control movement of the transitional card along various card transport paths or branches. Movement of the rollers 1802 are controlled by motors 1804, by electrical signals from the card management processing system 1602, via the card manager interface system 1610. Thus, the transitional card may be moved along the card sensor 1632 such that information may be read from the transitional card. If the information is not correctly read and/or interpreted, the card management device 1636 may draw back the transitional card across the card sensor 1632 for another sensing of the attributes and/or characteristics of the transitional card.

In other embodiments, the card management device 1636 may be any suitable device, system or means that controls movement of a transitional card such that card sensor 1632 sensed the attributes and/or characteristics of the transitional card. For example, a single roller 1802 and motor 1804 could be employed in another embodiment. Another embodiment may use a conveyor system or the like.

FIG. 12 is a conceptual diagram facilitating an explanation of the generation of a sequence of virtual playing card values 1900 and the subsequent construction of a corresponding set of randomized playing cards 518, 618. Processing system 1604 (see also FIG. 16) retrieves and executes the virtual card builder logic 1620 to first generate or determine a virtual selection pool 1622 based upon parameters in the virtual sequence build criteria 1624.

Other parameters may be used to generate the virtual selection pool 1622. For example, the game rules table may specify the type of card game that is to be played using the set of randomized playing cards 518, 618. The selected game may influence the types and/or number of virtual playing card values 1904 used in the virtual selection pool 1622.

Then, in one embodiment, processing system 1604 uses a random number generator 1621 or the like to randomly select virtual playing card values 1904 in a serial fashion. These selected virtual playing card values 1904 are serially organized into the sequence of virtual playing card values 1900.

In another embodiment, processing system uses a random number generator 1621 to sequentially order virtual playing card values 1904 by generating a series of random numbers, the largest random number corresponding to the number of virtual playing card values 1904 in the virtual selection pool 1622, each number corresponding to the value of a virtual card. A data table or the like uniquely associating each virtual playing card values 1904 with one of the numbers enables the processing system 1604 to sequence the virtual playing card values 1904 into sequence of virtual playing card values 1900.

In yet another embodiment, virtual playing card values are selected from an unmodified virtual selection pool 1622 each time a virtual card is selected. Similar to an electronic slot machine, the probability of any particular value being selected for a virtual card remains constant for each selection.

In some embodiments, a portion of the sequence of virtual playing card values 1900 (referred to as the virtual sequence portion 1902) may be selected from the sequence 120. The portion 1902 is used to identify physical playing cards 1906 that will be selected from the inventory cards 1910 and/or the transitional cards as the set of randomized playing cards 518, 618 are constructed.

For example, but not limited to, one of the parameters used to generate the virtual selection pool 1622 may specify that eight (8) standard 52-card decks are to be used to create a virtual selection pool 1622, Accordingly, the generated virtual selection pool 1622 will initially comprises 416 virtual playing card values 1904.

Another parameter may, in this example, specify that set of randomized playing cards 518, 618 contain a total of 208 physical playing cards 1906 (corresponding to four standard 52-card decks). Thus, 208 virtual playing card values 1904 from the virtual selection pool 1622 will be used to generate the portion of the sequence of virtual playing card values 1902. The generated portion 1902 will then be used to construct the set of randomized playing cards 518, 618.

In some embodiments, the number of virtual playing card values 1904 of the portion of the sequence of virtual playing card values 1902 may be the same as the number of virtual playing card values 1904 of the sequence of virtual playing card values 1900. This may occur if the parameter defining the number of card decks used to construct the virtual selection pool 1622 is the same as the number of decks specified for the portion 1902. Casino rules, governmental regulatory rules and/or game rules may stipulate this condition.

In yet other embodiments, the virtual selection pool 1622 is based upon virtual playing card values identified by value or another indicator. As virtual playing card values 1904 are sequentially selected during generation of the sequence of virtual playing card values 1900, the likelihood or probability of selecting one of a particular virtual card from the virtual selection pool remains constant. For example, if a set of randomized playing cards 518, 618 is to be constructed from a standard 52-card playing deck, the probability of the first card having a value of the A♠ is 1/52. When the second virtual card (and subsequent virtual cards) is selected for the sequence of virtual playing card values 1900, the probability of the second virtual card (and virtual subsequent cards) having a value of the A♠ remains at 1/52.

Alternatively, processing system 1604 may generate the virtual selection pool 1622 using a first parameter (corresponding to a first number of virtual cards 1602) and then generate another number of virtual playing card values 1904 (from the virtual card values 1904 of the virtual selection pool 1622) to construct the sequence of virtual playing card values 1900, stopping the construction of the sequence of virtual playing card values 1900 when the number of virtual playing card values 1904 specified for the set of randomized playing cards 518, 618 equals the number of selected virtual playing card values 1904.

After generation of the portion of a sequence of virtual playing card values 1902, physical playing cards 1906 are retrieved from the inventory playing cards 1910 residing in a carousel 1640 and/or from an identified collected playing card 515, 615. Each of the sequentially retrieved physical playing cards 1906 correspond to a respective one of the virtual playing card values 1904 in the portion of the sequence of virtual playing card values 1902. The retrieved physical playing cards 1906 are transported (generally denoted by the line 1914) in serial fashion to construct the set of randomized playing cards 518, 618.

Figure 19:
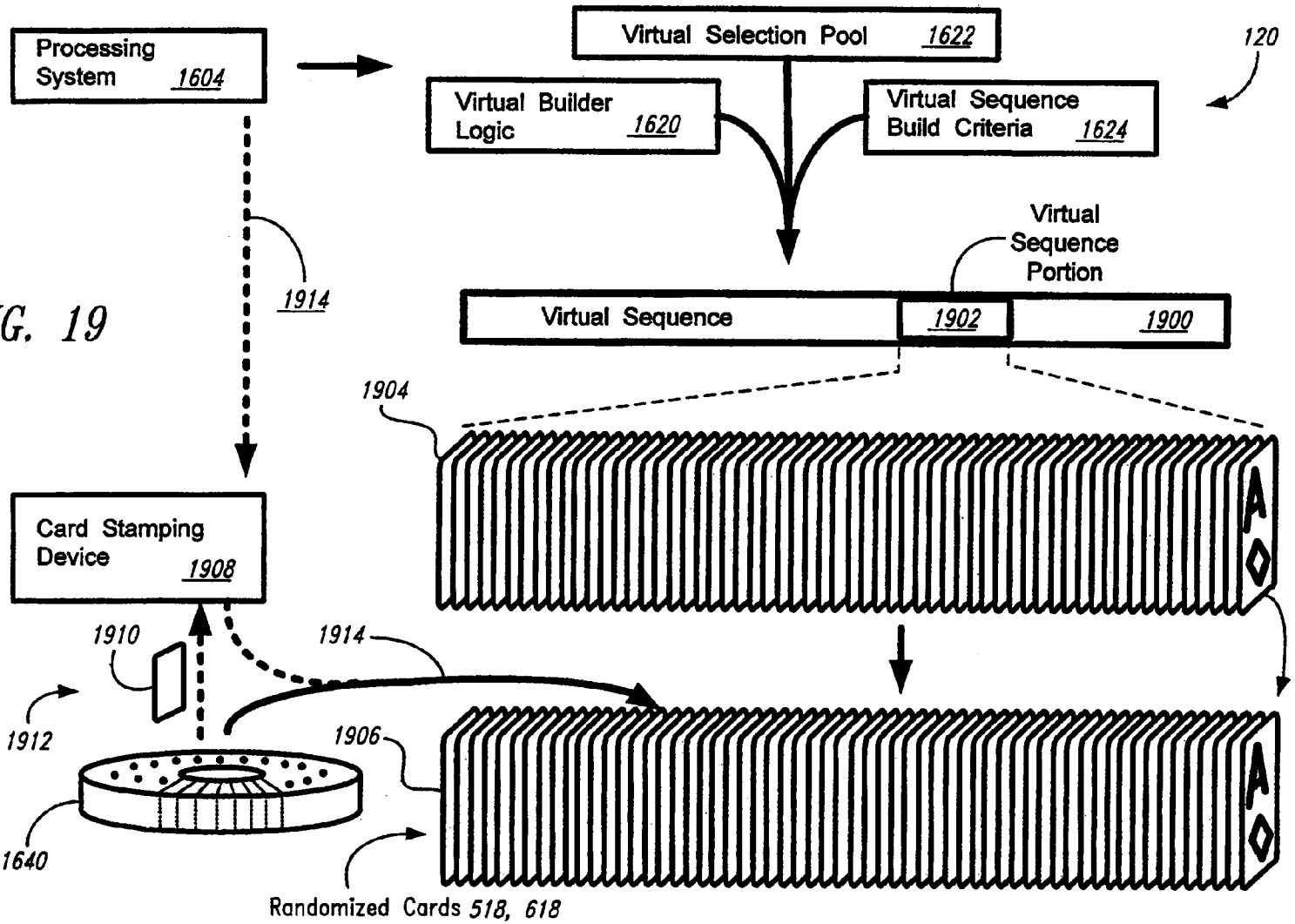
FIG. 19 is a conceptual diagram facilitating an explanation of the generation of a virtual card sequence and the subsequent construction of a corresponding group of deliverable cards, according to one illustrated embodiment.

For example, in FIG. 19 the first card of the portion of the sequence of virtual playing card values 1902 is illustrated as the Ace of Diamonds (A♦). The virtual A♦ playing card value 1904 is used to define the first physical playing card 1906 of the set of randomized playing cards 518, 618.

Accordingly, one of the available physical A♦ cards is selected from the carousel receiving compartments and placed in a suitable receptacle, such as the playing card output receiver 506, 606, as the first physical playing card 1906. The process of sequentially retrieving physical playing cards 1906 based upon a specified virtual playing card value 1904 of the portion of the sequence of virtual playing card values 1902 continues until the set of randomized playing cards 518, 618 has been constructed. Then, the set of randomized playing cards 518, 618 are transported to a location where the dealer or another participant or casino employee may access the set of randomized playing cards 518, 618.

In some situations, after generation of the portion of the sequence of virtual playing card values 1902, the virtual playing card values 1904 may be additionally processed again in accordance with another parameter. In one exemplary embodiment, an optional card stamping device 1908 is configured to intercept (generally denoted by the dashed-line 1912) a physical playing card 1910 that is being transported to the set of randomized playing cards 518, 618. Instructions for printing a message and/or symbol on the intercepted physical card 1910 are communicated from the processing system 1604 (generally denoted by the dashed-line 1914) to the card stamping device 1908. Then, after stamping or otherwise marking the intercepted physical playing card 1910 with an ink or the like, the intercepted playing card 1910 can be returned to the card path 1214 for insertion into the set of randomized playing cards 518, 618 in its proper sequenced location.

For example, one of the parameters of the virtual card builder logic 1620 or the virtual sequence build criteria 1624 (or another parameter residing elsewhere) may specify that one or more of the physical cards are to be made a "bonus" card. The bonus card may reward a player with a desirable gift or the like (e.g., a free hotel room, a complimentary dinner, etc.) Accordingly, information indicating to the player receiving the bonus card is stamped onto the bonus card. The information may be in any suitable format, including textual information and/or a special symbol. It is appreciated that the number of, and types of, rewards gifted to a player(s) receiving a bonus card are unlimited. All such variations are intended to be within the scope of this disclosure.

The physical playing cards 1906, that are to referred to as bonus cards (and marked by the card stamping device 1908), may be identified by specifying a virtual card value 1904 in the generated portion of the virtual sequence of playing card values 1902 and/or the generated virtual selection pool 1622 based upon a specified criteria or based upon a random criteria. Or, physical playing cards 1906 may be selected as they are being transported to the set of randomized playing cards 518, 618 based upon a specified criteria or based upon a random criteria. It is appreciated the number of possible methods of identifying and selecting a physical playing card 1906 for stamping is limitless. All such variations are intended to be within the scope of this disclosure.

Furthermore, selection of virtual playing card values 1904 and/or physical playing cards 1906 may be comprised of one or more sub-portions of generated portion of the sequence of virtual playing card values 1902 and/or the set of randomized playing cards 518, 618, respectively. For example, a last sub-portion of the generated portion of the sequence of virtual playing card values 1902 and/or the set of randomized playing cards 518, 618 may have selected virtual playing card values 1904 or selected physical playing cards 1906, respectively, to entice a player(s) to continue playing in hopes of receiving one of the bonus cards.

In some embodiments, during generation of the portion of the sequence portion of virtual playing card values 1902 and/or the generated virtual selection pool 1622, parameters which establish the selection criteria used by the random number generator 1621 (or the like) of the virtual card builder logic 1620 are changed during the generation process. That is, parameters impacting the probability of card selection, and thus affecting game odds, may be modified. For example, in a game played by a plurality of players, one of the players may optionally select to receive cards having a higher or lower odds of winning than the odds for the other players. (Of course, payout would likely be adjusted accordingly.) For example, Player A may wish to play a hand and/or a game based upon a virtual selection pool 1622 constructed under a criteria of eight (8) traditional 52-card desks. Player B may wish to play a hand and/or a game based upon a virtual selection pool 1622 constructed under a criteria of one (1) traditional 52-card desk. As another example, Player C may wish to have the opportunity to have wild cards introduced into his hand. Accordingly, various embodiments of the card handling system 120 are configured to accommodate special parameters during the above-described processes that result in a constructed set of randomized playing cards 518, 618.

In some situations, the virtual sequence of playing card values 1900 may have a limited number of a particular value of a virtual card. For example, but not limited to, the virtual sequence 120 may be limited to having only eight A♠ card values, even if the virtual selection pool 1622 was based upon ten standard 52-card playing decks. Or, the virtual sequence of playing card values 1900 may be limited to having only a particular rank or suit. For example, but not limited to, the virtual sequence of playing card values 1900 may be limited to having only eight A card values (of the four suits). Or, virtual sequence of playing card values 1900 may be limited to having at most one half of the virtual cards hiving the ♠ suit.

In some of the above-described embodiments, the processing system 1604, may selectively modify selected ones of the above-described parameters as a plurality of virtual card sequence portions 1902 are generated. The plurality of virtual playing card sequence portions 1902, one designated for each different player, may be joined, thereby creating a sequence of virtual playing card values 1904 that is used to construct a set of randomized playing cards 518, 618. The group of deliverable cards 114 would then have a plurality of sub-groups therein, each sub-group designated for a particular player based upon the selected modified parameter. In some embodiments, a divider card (such as, but not limited to, an unmarked and/or colored card) may be selected from a card receiving compartment and placed between successive sub-groupings of physical cards to ensure that players receive hands based upon the selected modified parameter.

The above-described process of building a set of randomized playing cards 518, 618 [which may be generally described as generating a virtual sequence 1900 from the virtual selection pool 1622, defining a virtual sequence portion 1902 from the virtual sequence 1900, and then retrieving inventory cards 1910 and/or transitional cards to construct the set of randomized playing cards 518, 618, and the above-described process of returning collected cards 515, 615 to the carousel receiving compartments of the carousels 1640 (FIGS. 16 and 19), were described as separate processes for convenience. In most embodiments, the processes of building a set of randomized playing cards 518, 618 and transporting collected cards 515, 615 to the playing card receiving compartments of the carousels 1640 operate concurrently. That is, the card management processing system 1602 is configured to control flow of a plurality of physical cards along the playing card transport paths or branches in an integrated manner. Thus, embodiments may be configured to simultaneously build groups of set of randomized playing cards 518, 618, restock carousels 1640 with inventory cards 1910, receive collected cards 515, 615, sense and/or evaluate transitional playing cards, operate on transitional playing cards, etc. Such operational flexibility is enabled because the transport of physical playing cards over the various paths or branches, and/or card transport at individual points along the paths or branches, and/or control of the carousel(s) 1640, are independently controllable. Accordingly, processing system 1604, when executing the various logic 1620, 1648, 1654, and/or 1656, and/or operating on the information of 1622, 1624, 1626, 1650 and or 1652, may concurrently perform a plurality of different operations.

For example, a collected playing card 515, 615 may be input into an input branch (thereby becoming a transitional card). Concurrently, a selected inventory card 1910 (referred to now as a transitional card) may be in transport along one of the playing card transport paths or branches as it is being selected (removed from the corresponding playing card receiving compartment) from the carousel 1640 (FIG. 17) by that playing card receiving compartment's card selector 1708. Thus, two physical cards are being transported concurrently in this simplified example. Various card sensors 1632 (FIG. 16) communicate information to the card management processing system 1602 such that the processing system 1604 tracks location of the two physical cards on a real-time (or near real-time) basis.

In other embodiments, a plurality of physical cards may be concurrently tracked and/or transported along the various the branches or playing card transport paths. For example, a third physical playing card may concurrently be transported in an exit branch for deposit into a trash receiving compartment or the like. Or, another physical playing card may concurrently be transported in an intermediate branch having cards sensors 1632 and card management devices 1636 configured to detect that two or more transitional playing cards are in contact with each other (i.e., stuck together) and need separation from each other so that further processing of the transitional playing cards may occur. Or, a transitional playing card may be in proximity to one of a number of playing card diverters in the playing card transport path(s), wherein actuation of a diverter may divert the transitional playing card from going into is assigned card receiving compartment such that the transitional playing card is transported to, for example, the set of randomized playing cards 518, 618. In various embodiments, these above-described scenarios, and other card tracking and/or transport scenarios, may all occur concurrently.

As another example of concurrently managing transportation of physical cards over the various branches or playing card transport paths, a "look-forward" algorithm 1656 may be included in memory 1606 (FIG. 16). Processing system 1604 determines a "next" virtual card of the virtual sequence portion 1902 (FIG. 19), which defines the "next" physical card 1906 that is to be added to the set of randomized playing cards 518, 618. As noted herein, the "next" physical card 1906 may be retrieved from one of the playing card receiving compartments, or may be a transitional card that may be diverted. During transport of a transitional card to its assigned playing card receiving compartment, when the transitional card is in proximity to one of a number of playing card diverters in the playing card transport path(s), the transitional playing card may be considered to be within a "window of opportunity" such that the transitional playing card may be successfully diverted to the set of randomized playing cards 518, 618 being constructed.

Diverting the transitional playing card directly to the set of randomized playing cards 518, 618 may be done more quickly than retrieving the "next" physical card from one of the carousel receiving compartments because the diverted transitional playing card is readily available and may have a relatively short distance to travel to the playing card output receiver 506, 508. In comparison, if an inventory card 1910 is retrieved from a playing card receiving compartment, it is likely that the position of the playing card receiving compartment must be changed to bring the card selector into position such that the inventory playing card can be selected out of the appropriate playing card receiving compartment. Then, the selected inventory card 1910 (now referred to as a transitional playing card) must be transported all the way to the playing card output receiver 506, 606. Thus, the process of retrieving an inventory card 1910 may take longer that diverting a suitable transitional playing card. By diverting the transitional playing card to the playing card output receiver 506, 606 so that the transitional playing card may be used as the "next" card of the set of randomized playing cards 518, 618, the overall process of managing cards by the card handling system 120 may be quickened.

Additionally, virtual card operations may be concurrently performed by various embodiments. For example, one or more virtual selection pools 1622 (FIG. 16) may be concurrently generated based upon different parameters. Or, processing system 1604 may be operating in a parallel mode wherein one or more virtual sequences 1900 are being constructed from one or more one or more virtual selection pools 1622. Processing system 1604 may be generating a plurality of virtual sequence portions 1902 from one or more virtual sequences 1900. Or, all of, or some of, the above-described virtual card operations may be occurring concurrently.

It is appreciated that the various possibilities of concurrently managing, tracking or transporting physical cards through the card handling system 120, and/or concurrently performing virtual card operations, are too numerous to describe in detail herein. Such embodiments performing a plurality functions are intended to be within the scope of this disclosure and be protected by any accompanying claims.

As noted herein, carousels or storage devices having card compartments may be interchangeable. Thus, the card handling system 120 may be adding physical cards to and/or removing physical cards from some of the carousels or storage devices, which other carousels or storage devices are being removed and/or replaced with other carousels or storage devices.

The above-described "random number generator" which constructs the virtual sequence 1900 may be implemented by a variety of algorithms. In one embodiment, the random number generator 1621 (FIG. 16) may computationally generate virtual cards of the virtual sequence 1900 or the virtual sequence portion 1902 (FIG. 19). That is, a number associated with a value of a physical card may be directly generated in a random manner. In another embodiment, the random number generator 1621 may generate a random series of numbers, wherein the range of numbers that may be generated may correspond to the total number of virtual cards of the virtual selection pool. Such virtual cards could be associated with the generated numbers through the use of a look-up table or the like. In another embodiment, a random number generator 1621 could generate values corresponding to characteristics which identify a physical card. For example, in the case of a standard 52-card deck, a first value corresponding to a card suit, and another value corresponding to card rank could be separately generated, thereby defining a card having a particular value. It is appreciated that other algorithms, commonly referred herein as "random number generator" algorithms for convenience, may be used to generate, process and/or define virtual cards 1904 as described herein, and that such algorithms are too numerous and/or too complex to describe in detail herein. All such algorithms are intended to be included within the scope of this disclosure and to be protected by any accompanying claims. While referred to herein and in the claims as being a random number or random number generator, such terms encompass numbers and generators that are not truly random in the mathematical sense, such as those often referred to as being pseudo-random.

Other embodiments of a card handling system 120 are configured to operate on physical cards 1906 (FIG. 19) without the use of the random number generator 1621 (FIG. 16). For example, one or more predefined virtual sequences 1900 and/or virtual sequence portions 1902 may be used to construct a set of randomized playing cards 518, 618. Thus, predefined virtual sequences 120 and/or virtual card sequence portions 1202 can be specified so that a corresponding set of randomized playing cards 518, 618 may be constructed at will. The predefined sequence may be stored in a look-up table or the like. Also, the set of randomized playing cards 518, 618 may be constructed repetitively.

For example, in certain types of card tournaments, such as in a duplicate bridge tournament, players at a gaming table 102 play predefined hands. As that game is completed, the players move to the next gaming table 102 and each player plays the same respective hand that was previously played at that gaming table 102. That is, all gaming tables 102 at the duplicate bridge tournament have a unique set of hands (groups of cards) that all of the tournament players and/or teams play. Accordingly, embodiments of the card handling system 120 may repeatedly construct and deliver the necessary hands which must be identical from game to game. The definition of the hands (corresponding to four virtual card sequence portions 1902) may be determined as virtual cards by a remote device. The information determined by the remote device would provided to one or more of the card management processing systems 1602, via the user device interface 1612 (FIG. 16). Alternatively, the hands may be defined and/or generated by the management processing systems 1602 such that the unique hands are repetitively constructed for tournament play.

As another hypothetical example wherein a card handling system 120 may be configured to operate on physical cards 1906 (FIG. 19) without the use of the random number generator 1621 (FIG. 16), the card handling system 120 may be used to create sorted groups of playing cards. That is, the physical playing cards may be directly sorted in a predefined manner. For example, one or more sorted standard 52-card decks may be created from a plurality of collected cards 515, 615. Consider a hypothetical scenario wherein 520 mixed playing cards are input to the card handling system 120. Up to ten sorted groups of set of randomized playing cards 518, 618 corresponding to sorted standard 52-card decks could then be created from the 520 mixed playing cards.

As another hypothetical example wherein a card handling system 120 may be configured to operate on physical cards 1906 (FIG. 19) without the use of the random number generator 1621 (FIG. 16), the card handling system 120 may be used to inspect groups of physical cards. For example, a standard 52-card deck could be provided to embodiments of the card handling system 120 such that various card sensors to sense physical characteristics of the playing cards. Non-limiting examples of physical characteristics include, but are not limited to, card appearance, card quality and/or card value. As physical cards are individually inspected, the card may then be transported directly to the playing card output receiver 505, 606 (FIGS. 5A, 5B, 6A). If the assembled and inspected set of randomized playing cards 518, 618 created from the inspected cards is acceptable, the playing card output receiver 506, 606 could return the set of randomized playing cards 518, 618 to the user. In other embodiments, problem cards could be identified and/or removed, and if removed, replaced by an acceptable inventory playing card. Reports providing information relating to the inspected physical cards may be output to a user device 1628 (FIG. 16) by some embodiments. It is appreciated that such an inspection process may be completed relatively quickly since in some embodiments the carousels 1640 or other card compartment structures may not be in use.

It is appreciated that the various types of scenarios wherein a card handling system 120 is configured to operate on physical cards 1906 (FIG. 19) without the use of the random number generator 1621 are too numerous and complex to describe herein. Any such scenarios, methods and or systems are intended to be included within the scope of this disclosure and to be protected by any accompanying claims.

FIGS. 20, 21, 22 and 23 are flow charts showing methods 2000, 2100 2200, and 2300, respectively, illustrating possible operation of the logic modules 1620, 1648 and/or 1654 of FIG. 16 as related to the various functions relating to card management. The methods 2000, 2100, 2200 and 2300 illustrated by the respective flow charts show the architecture, functionality, and operation of a possible implementation of the software for implementing the logic modules 1620, 1648, 1654, and/or 1656. In this regard, each block may represent a module, segment, or portion of code, which comprises one or more executable instructions for implementing the specified logical function(s). It should also be noted that in some alternative implementations, the functions noted in the blocks may occur out of the order noted in FIGS. 20-23 or may include additional functions. For example, two blocks shown in succession in FIGS. 20-23 may in fact be executed substantially concurrently, the blocks may sometimes be executed in the reverse order, or some of the blocks may not be executed in all instances, depending upon the functionality involved, as will be further clarified hereinbelow. Furthermore, some blocks or acts of one of the methods 2000, 2100 2200, and 2300 may be interchanged with the blocks of one of the other methods and/or may be added to one of the other methods. All such modifications and variations are intended to be included herein within the scope of this disclosure.

Furthermore, it is appreciated that the simplified illustrative method 2000, 2100, 2200 and 2300 of FIGS. 20-23, respectively, describe only selected ones of the many above-described processes for card management. Because of the numerous variations described herein, specific flow charts are not provided for each of the various alternative embodiments and methods described herein.

Figure 20:
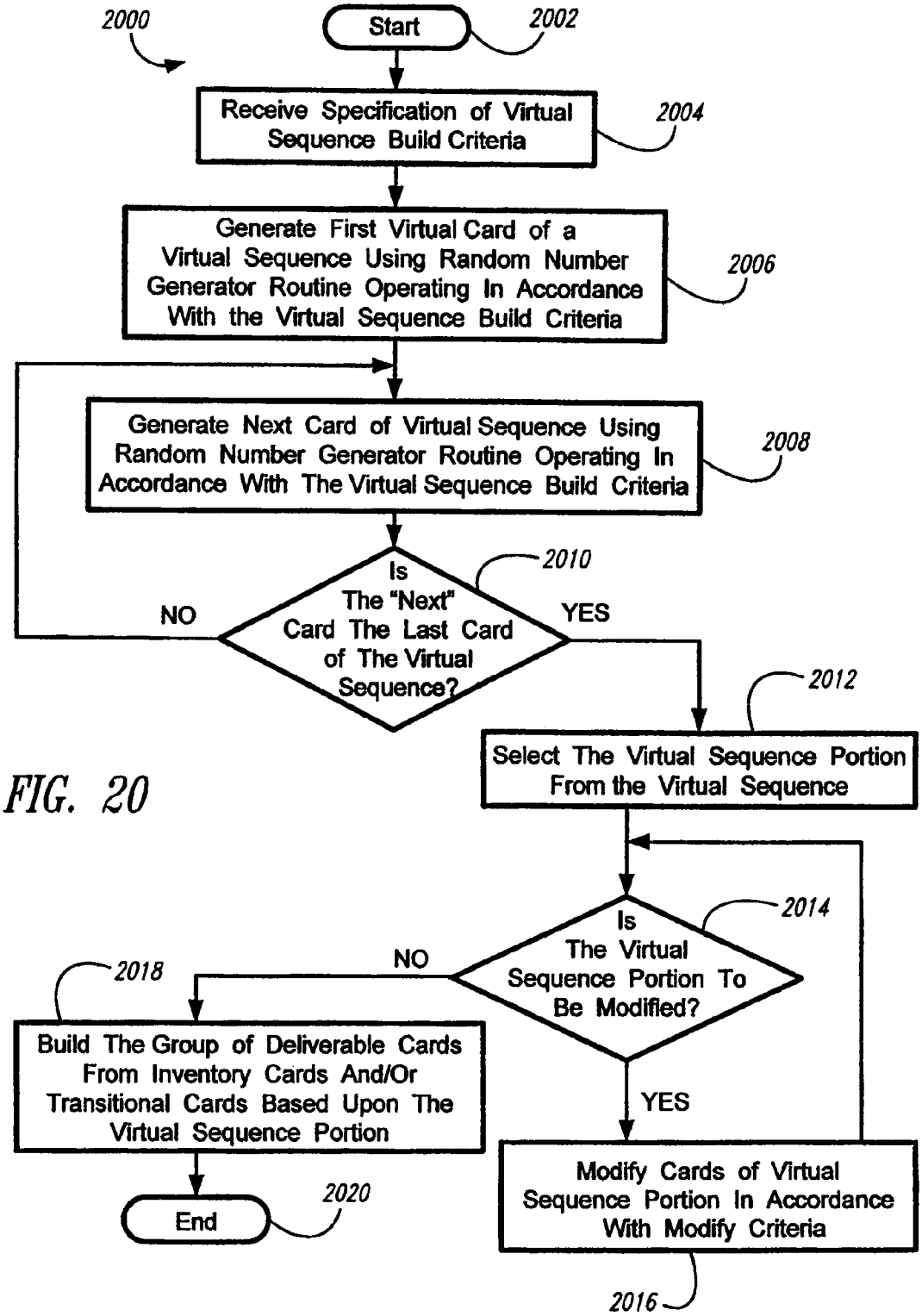
FIG. 20 is a flow chart illustrating a process of the generation of a group of deliverable cards, according to one illustrated embodiment.

FIG. 20 shows a method 2000 illustrating a process of the above-described generation of a set of randomized playing cards 518, 618. The process starts at block 2002. At block 2004, the card management logic 1654 (FIG. 16) receives specifications corresponding to the virtual sequence build criteria 1624. Such criteria and/or parameters are described hereinabove.

At block 2006 the random number generator 1621 generates a first virtual card of the virtual sequence 1900 in accordance with the virtual sequence build criteria. This first virtual card is selected from one of the virtual cards available from the above-described virtual selection pool 1622. Any of the above-described random number generator algorithms 1621 may be used by various embodiments. Alternatively, the virtual sequence may not be random, but rather may be a sorted sequence, for example one from a look-up table.

At block 2008 the random number generator 1621 generates the next virtual card of the virtual sequence 1900 in accordance with the virtual sequence build criteria 1624. This next virtual card is selected from one of the remaining virtual cards available from the above-described virtual selection pool 1622. Thus, the first virtual card selected at block 2006 is not available for selection at block 2008.

At block 2010, a determination is made whether the generated next virtual card is the last card of the virtual sequence 1900. If not (the NO condition), the process loops back and selects another "next" card. This looping continues until the last card of the virtual sequence 1900 has been generated. As noted above, the last virtual card may correspond to a selected size (total number of virtual cards) of the virtual sequence 1900. The size of the virtual sequence 1900 may be equal to the total number of virtual cards available form the virtual selection pool 1622, or may be a lesser number of virtual cards.

If, at block 2010, the last card of the virtual sequence 1900 has been generated (the YES condition), the process continues to block 2012. At block 2012 the virtual sequence portion 1902 (FIG. 12) is selected from the virtual sequence 1900. As noted above, the virtual sequence portion 1902 may correspond to all of the virtual sequence 1900, or a selected portion of the virtual sequence 1900. If a portion is selected, the portion may be drawn from anywhere in the virtual sequence 1900 at random or based upon some specified parameter. Furthermore, a plurality of virtual sequence portions 1902 may be selected from the virtual sequence 1900. In some situations, the plurality of selected portions may overlap virtual cards of the virtual sequence 1900, or may be contiguous with virtual cards of the virtual sequence 1900, and/or may be separated by unselected virtual cards of the virtual sequence 1900. In some embodiments, blocks 2010 and 2012 may be combined so that the virtual sequence portion 1902 is directly selected from the virtual selection pool 1622.

After the virtual sequence portion(s) 1902 have been determined, the process may end in some embodiments. In such embodiments, the process proceeds to block 2018, described below.

In other embodiments, it may be desirable to perform other operations on the determined virtual sequence portion(s) 1902. Thus, the process continues to block 2014 where a determination is made whether one or more of the virtual cards of the virtual sequence portion 1902 are to be modified (the YES condition).

For example, but not limited to, bonus cards may be selected to be marked as described above. In some embodiments, such operations may be performed at a virtual level. If a virtual card of the virtual sequence pool is to be modified, the corresponding physical card 1910 may be modified as the group of deliverable cards are being constructed. Accordingly, the process continues to block 2014.

At block 2014, a determination is made whether one or more of the virtual cards of the virtual sequence portion 1902 are to be modified in accordance with at least one criteria and/or parameter. For convenience, the process then returns to block 2014 in the event that additional modifications are desired.

The process continues to block 2018 when the determination is made that one or more of the virtual cards of the virtual sequence portion 1902 are not to be modified (the NO condition), or if it is determined that no other modifications are to be performed. Based upon the modified virtual sequence portion (or the unmodified virtual sequence portion if no modifications are performed), the card handling system 120 constructs the set of randomized playing cards 518, 618. The set of randomized playing cards 518, 618 is constructed by selecting physical inventory playing cards and/or transitional cards as described hereinabove. The process then ends at block 2020.

It is appreciated that the logic of blocks 2014 and 2016 may be performed separately as a separate process to modify physical cards. For example, rather than selecting a virtual card for modification at block 2016, a physical card may be modified at block 2016 in accordance with blocks 2014 and 2016, or another suitable logical process.

Figure 21:
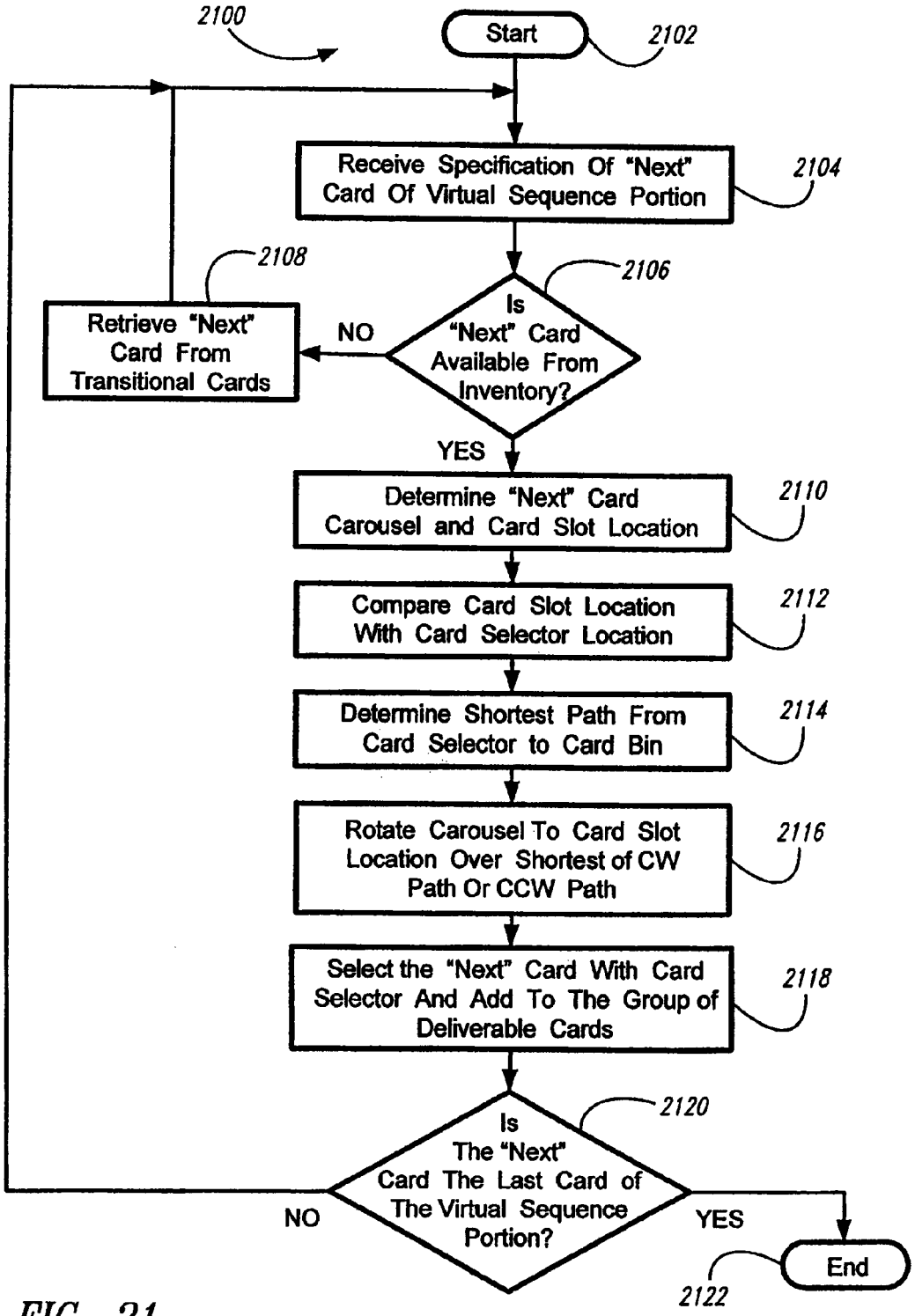
FIG. 21 is a flow chart illustrating a process of the selection of the inventory cards of FIG. 1 from the card storage devices, according to one illustrated embodiment.

FIG. 21 shows a method 2100 illustrating a process of the above-described selection of inventory cards from carousels 1640 (FIG. 16). The process starts at block 2102. At block 2104, the card management logic 1654 (FIG. 16) specifies a "next" card of the current virtual sequence portion 1202. At block 2108 a determination is made whether the specified "next" card can be selected from a card receiving compartment 302 of a carousel 1640 as described hereinabove. That is, can the "next" card be an inventory card? If not (the NO condition), the process continues to block 2108 wherein the "next" card is, at some point, selected from a transitional card as described hereinabove. If a transitional card is selected, the process proceeds back to block 2104 where the "next+1" card is specified.

At block 2106, if a determination is made that the specified "next" card may be selected from an inventory card residing in a card receiving compartment of a carousel 1640 (the YES condition), the process proceeds to block 2110. At block 2110, the card management processing system 1602 determines the location of the specified "next" card. If a plurality of carousels 1640 are employed, the carousel 1640 having the playing card receiving compartment assigned to the specified "next" card is identified. Also, the location of the playing card receiving compartment in the identified carousel 1604 is identified.

Then, at block 2112 the identified location of the playing card receiving compartment associated with the specified "next" card is compared with the relative location of the card selector 1708 that will select the specified "next" card. At block 1414 the shortest path for the card selector to access the identified playing card receiving compartment is determined.

At block 2116, in embodiments employing carousels 1640, the carousel 1640 is rotated in a counter-clockwise (CCW) or a clockwise (CW) direction such that the carousel 1640 movement is minimized. Accordingly, the selection of the shortest path results in the fastest alignment of the card selector 1708 and the playing card receiving compartment having the inventory card associated with the specified "next" card. In other embodiments employing racks, the rack may be translated in an appropriate direction (e.g., left, right, up, down, or forward, back).

As discussed herein, a variety of other card storage devices may be used for retaining inventory cards in their specified playing card receiving compartments. In such embodiments, the above-described blocks 2110-2116 would be modified as necessary to accommodate the particular structures of that embodiment. Furthermore, in some embodiments wherein the carousel 1640 remain stationary and the card selector 1708 moves to the identified card receiving compartment holding the identified inventory card, the above-described blocks 2110-2116 would be modified as necessary.

Once the card selector 1708 is in alignment with the identified card receiving compartment holding the identified inventory card (the "next" card), the inventory card is selected at block 2118 and is added (transported to) the set of randomized playing cards 518, 618. The process then proceeds to block 2120 where a determination is made whether the selected "next" card is the last card of the virtual sequence portion 1202. That is, the selected "next" card is the last card to be added to the set of randomized playing cards 518, 618. If so (the YES condition), the process proceeds to block 2122 and ends. If another card is to be identified and selected (the NO condition), the process returns to block 2104 for the "next+1" card.

It is appreciated that the above-described process of selecting an inventory card from a receiving compartment in accordance with the method 2000 may be modified to be applicable with the above described process of flow chart 1600 wherein the embodiment is using the look-forward algorithm 1656 to determine if the "next" card can more quickly be selected from a transitional card.

Figure 22:
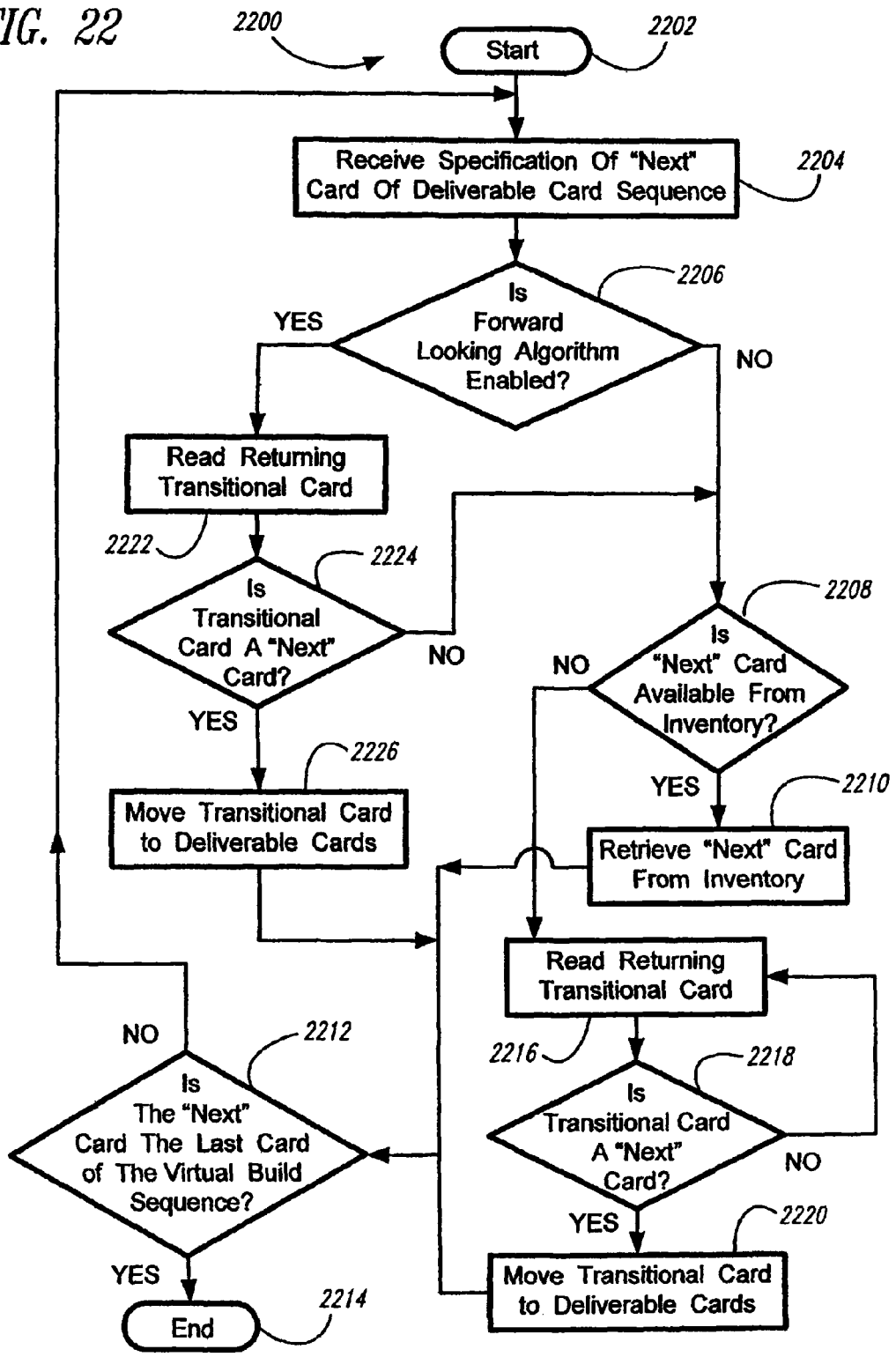
FIG. 22 is a flow chart illustrating a process of the look-forward algorithm, according to one illustrated embodiment.

FIG. 22 shows a method 2200 of executing the above-described look-forward algorithm 1656 (FIG. 16). The process starts at block 2202. At block 2204, the card management logic 1654 receives a specification for a "next" card of a deliverable card sequence. The specification may be based on the corresponding "next" card of the virtual sequence portion 1202 that is being used as the basis for the construction of the set of randomized playing cards 518, 618. At block 2206 a determination is made whether the look-forward algorithm 1656 is enabled. If not (the NO condition), the process proceeds to block 2208 where a determination is made whether the "next" card is available from the card inventory residing in the carousel(s) 940.

If an inventory card is available (the YES condition at block 2208), the "next" physical card is retrieved at block 2210 from the card receiving compartment having the requested inventory card (and is transported to and added to the set of randomized playing cards 518, 618.

Then, the process proceeds to block 2212 where a determination is made whether the retrieved "next" card is the last card of the virtual build sequence. If so (the YES condition), the process ends at block 2214 since the construction of the set of randomized playing cards 518, 618 has been completed. However, if a block 2212 the retrieved "next" card is not the last card of the virtual build sequence, the process returns to block 2204 wherein the "next+1" card is specified.

Returning now to block 2208, if a determination is made that the desired "next" card is not available as an inventory playing card, the process proceeds to block 2216 to read a returning collected card 515, 615, which may now, alternatively, be referred to as a transitional card. Then, at block 2218, the transitional card is read (sensed by a sensor and the information is analyzed by the card management processing system 1602) to determine the value of the sensed transitional card. At block 2218, a determination is made whether the current transitional card is the desired "next" card. If not (the NO condition), the process continuously loops back to block 2216 until a read transitional card corresponds to the desired "next" card (the YES condition). Then, at block 2220 the transitional card corresponding to the desired "next" card is transported to and added to the set of randomized playing cards 518, 618. The process then proceeds to block 2212 and continues as described above.

If at block 2206 the look-forward algorithm 1656 is enabled (the YES condition), the process proceeds to block 2222. At block 2222, the transitional card is read (sensed by a card sensor 1632 so that the information may be analyzed by the card management processing system 1602) to determine the value of the sensed transitional card. At block 2224, a determination is made whether the value of the current transitional card corresponds to the value of the desired "next" card. If not (the NO condition), the process proceeds to block 2208 and continues as described above.

If at block 2224 the value of the read transitional card corresponds to the value of the desired "next" card (the YES condition), the process proceeds to block 2226 where the transitional card corresponding to the desired "next" card is transported to and added to the set of randomized playing cards 518, 618. The process then proceeds to block 2212 and continues as described above.

Figure 23:
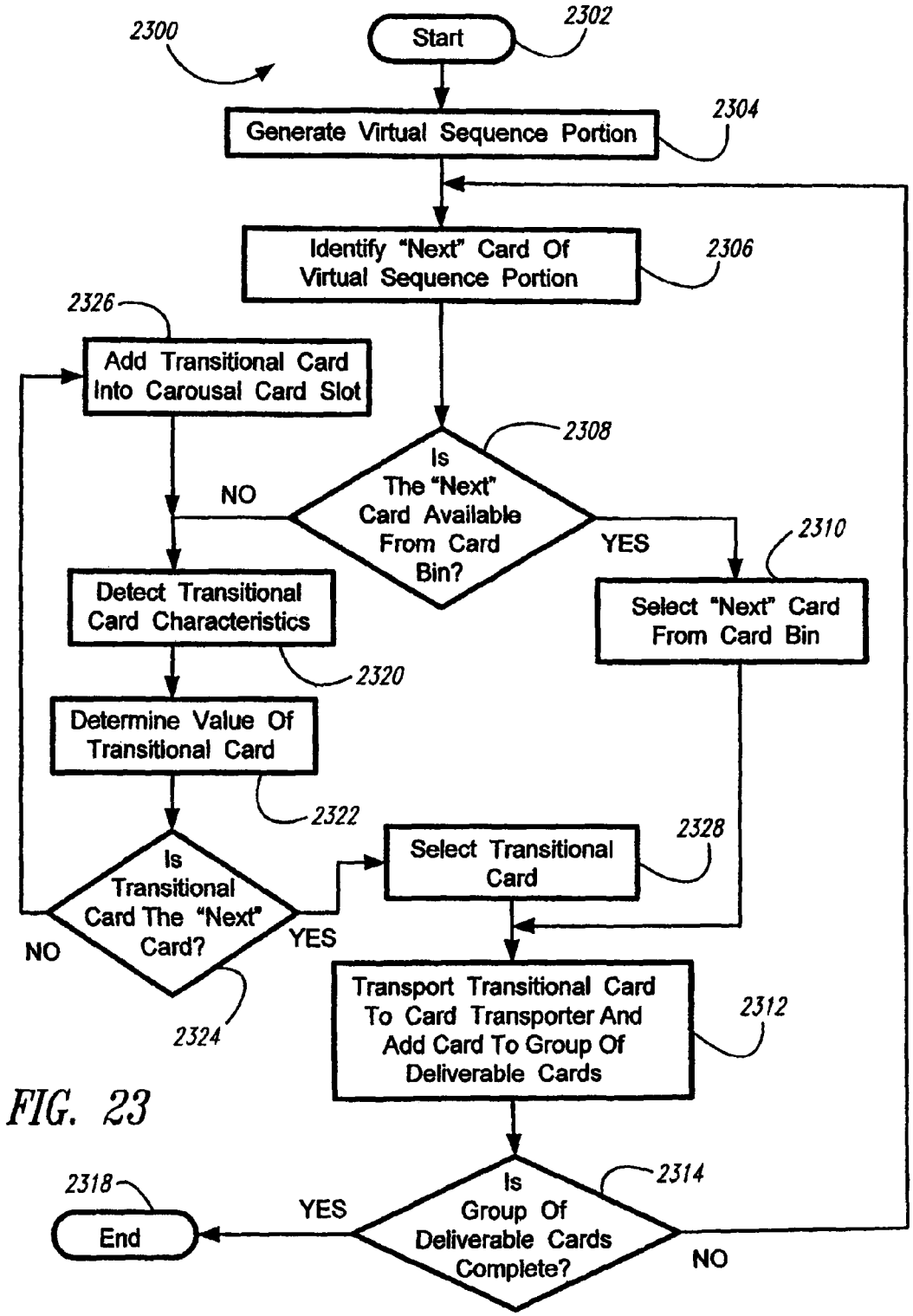
FIG. 23 is a flow chart illustrating a process of providing a group of randomized playing cards from the playing card receiving compartments of the intermediary card storage receiver, according to one illustrated embodiment.

FIG. 23 shows a method 2300 illustrating a process of the above-described generation of a group of randomized playing cards 518, 618 (FIGS. 5A, 5B, 6A) from the collected playing cards 515, 615 which may reside in carousels 940. This exemplary process is used by embodiments wherein the above-described look-forward algorithm 1656 is omitted.

The process starts at block 2302. At block 2304, the card management logic 1654 (FIG. 16) generates a virtual sequence portion 1902 under any of the above-described processes, parameters and/or criteria. After the virtual sequence portion 1902 has been defined, at block 2306, the value of the first virtual card of the specified virtual sequence is identified. For convenience, this first card is referred to as a "next" card in illustration of the method 2300. (As the process loops back to block 2306, as described in greater detail below, subsequently retrieved cards are then the "next" cards in the virtual sequence portion 1902).

At block 2308, a determination is made whether the value of the identified "next" card corresponds to the value of playing card 1910 that is available from a card receiving compartment. If playing card 1910 is available (the YES condition), the process proceeds to block 2310, wherein the playing card 1910 (corresponding to the "next" card) is selected from its card receiving compartment.

At block 2312, the selected playing card 1910 is added to the group of randomized playing cards 518, 618 by transporting the selected playing card 1910 to the playing card output receiver 506, 606 where the group of randomized playing cards 518, 618 is being constructed. (The selected playing card 1910, after it has been selected from its card receiving compartment, may be referred to as a transitional card since the selected playing card 1910 is now being transported to the playing card output receiver 506, 606.)

At block 2314, a determination is made whether construction of the set of randomized playing cards 518, 618 has been completed. If so (the YES condition), the process proceeds to block 2318 and ends. If additional cards are to be added to the set of randomized playing cards 518, 618 (the NO condition), the process returns to block 2306 wherein the "next" card is identified in accordance with the virtual sequence portion 1902. Thus, as long as inventory playing card 1910 are available to construct the set of randomized playing cards 518, 618, the above-described process loops through blocks 2306, 2308, 2310, 2312 and 2314 until the construction of the set of randomized playing cards 518, 618 has been completed.

However, if at block 2308, a determination is made that the value of the identified "next" card does not correspond to the value of an available inventory playing card 1910 (the NO condition), the process proceeds to block 2320. That is, a determination is made that there is no playing card 1910 available. Accordingly, at block 2320, characteristics of a transitional playing card are detected. At block 2322, based upon the detected characteristics, the value of the transitional playing card is determined. At block 2324, a determination is made whether the value of the transitional playing card corresponds to the value of the "next" card (as identified in accordance with the virtual sequence portion 1202 at block 2306).

If the value of the transitional playing card does not correspond to the value of the "next" card (the NO condition), the process proceeds to block 2326 wherein the transitional playing card is transported to the appropriate card receiving compartment. The process loops through blocks 2320, 2322, 2324 and 2326 until the value of the transitional playing card corresponds to the value of the "next" card (the YES condition).

Transitional playing cards are evaluated until the value of the transitional playing card corresponds to the value of the "next" card (the YES condition of block 2324). As noted above, these evaluated transitional playing cards correspond to an incoming stream of collected cards 515, 615. Then, the transitional playing card is selected at block 2328. The process then proceeds to block 2312. That is, when a collected playing card 515.615 is finally collected from the gaming table 102 that matches the identified "next" card in accordance with the virtual sequence portion 1902 at block 2306, that collected card (now referred to as a transitional playing card) is selected for transportation to the playing card output receiver 506, 606 so that the playing card can be added to the set of randomized playing cards 518, 618.

In some situations, such as at the end of a series of games or if construction of the set of randomized playing cards 518, 618 has been completed, collected cards 515, 615 may be returned to the playing card handling system 120 such that the collected playing cards 515, 615 are transported to their appropriate playing card receiving compartments, thereby restocking the carousels 940 with inventory cards. That is, the supply of available inventory cards may be restocked from collected cards 515, 615 by independently looping through the steps 2320, 2322, 2324 and 2326.

As noted above, as long as inventory cards are available to construct the set of randomized playing cards 518, 618, the above-described process loops through blocks 2306, 2308, 2310, 2312 and 2314 until the construction of the set of randomized playing cards 518, 618 has been completed. The process of the restocking the supply of available inventory cords from collected cards 515, 615 (by looping through the steps 2320, 2322, 2324 and 2326) may occur concurrently with the process of selecting inventory cards to construct the set of randomized playing cards 518, 618. That is, the two above-described processes may occur independently and/or concurrently (or serially, depending upon the embodiment). Then, if an inventory card is not available when needed, the card handling system 120 evaluates collected cards 515, 615 until the needed collected card is identified.

SUMMARY OF VARIOUS EMBODIMENTS

It is appreciated that concurrent provision of randomized playing cards 518, 618, 718, random generation of virtual playing cards values, and/or transportation of collected playing cards 515, 615 or playing card media 704 to through the playing card handling system 120 allows a series of card games to progress in an uninterrupted, or nearly uninterrupted, manner. That is, when the set of playing cards being dealt by hand or from the card shoe 118 is exhausted or nearly exhausted, one or more randomized playing cards 518, 618, 718 are readily available so that game play may continue.

The playing card handling system 120 may advantageously permit a payout or house odds and/or house advantage or theoretical hold to be set for individual participants 110, 114 at the gaming table 102.

The above description of illustrated embodiments, including what is described in the Abstract, is not intended to be exhaustive or to limit the claims to the precise embodiments disclosed. Although specific embodiments of and examples are described herein for illustrative purposes, various equivalent modifications can be made without departing from the spirit and scope of the teachings, as will be recognized by those skilled in the relevant art. The teachings provided herein can be applied to other playing card distributing systems, not necessarily the exemplary playing card handling systems generally described above.

For example, in some embodiments, the playing cards used are standard playing cards from one or more standard decks of fifty-two (52) playing cards. The standard playing cards have a uniform back and the faces each bear a respective combination of a first primary symbol and a second primary symbol. The first primary symbol is selected from a standard set of playing card rank symbols comprising: 2, 3, 4, 5, 6, 7, 8, 9, 10, J, Q, K, and A; and the second primary symbol is selected from a standard set of playing card suit symbols comprising: ♥, ♣, ♦, and ♠. One or more of the primary symbols may identify a value of the playing card under the rules of a specific card game. For example, in blackjack or twenty-one the ranks 2-10 are worth 2-10 points respectively, the ranks J-K are each worth 10 points, and the rank A is worth 10 or 1 point at the player's option. In other embodiments, the playing cards may have other symbols, graphics, backings, etc., and may even be modified within the playing card handling system 120 to add, enhance, or alter the value or significance of the playing card. In one embodiment, the playing cards are dual sided playing cards as described in U.S. patent application Ser. No. 10/902,436, which published on Jun. 2, 2005.

The foregoing detailed description has set forth various embodiments of the devices and/or processes via the use of block diagrams, schematics, and examples. Insofar as such block diagrams, schematics, and examples contain one or more functions and/or operations, it will be understood by those skilled in the art that each function and/or operation within such block diagrams, flowcharts, or examples can be implemented, individually and/or collectively, by a wide range of hardware, software, firmware, or virtually any combination thereof. In one embodiment, the present subject matter may be implemented via Application Specific Integrated Circuits (ASICs). However, those skilled in the art will recognize that the embodiments disclosed herein, in whole or in part, can be equivalently implemented in standard integrated circuits, as one or more computer programs running on one or more computers (e.g., as one or more programs running on one or more computer systems), as one or more programs running on one or more controllers (e.g., microcontrollers) as one or more programs running on one or more processors (e.g., microprocessors), as firmware, or as virtually any combination thereof, and that designing the circuitry and/or writing the code for the software and or firmware would be well within the skill of one of ordinary skill in the art in light of this disclosure.

In addition, those skilled in the art will appreciate that certain mechanisms of taught herein are capable of being distributed as a program product in a variety of forms, and that an illustrative embodiment applies equally regardless of the particular type of signal bearing media used to actually carry out the distribution. Examples of signal bearing media include, but are not limited to, the following: recordable type media such as floppy disks, hard disk drives, CD ROMs, digital tape, and computer memory; and transmission type media such as digital and analog communication links using TDM or IP based communication links (e.g., packet links).

The various embodiments described above can be combined to provide further embodiments. All of the above U.S. patents, U.S. patent application publications, U.S. patent applications, foreign patents, foreign patent applications and non-patent publications referred to in this specification and/or listed in the Application Data Sheet, including but not limited to: U.S. provisional patent application Ser. Nos. 60/130,368, filed Apr. 21, 1999; 60/259,658, filed Jan. 4, 2001; 60/296,866, filed Jun. 8, 2001; 60/300,253, filed Jun. 21, 2001; 60/716,538, filed Sep. 12, 2005; 60/791,549, filed Apr. 12, 2006; 60/791,554, filed Apr. 12, 2006; 60/791,398, filed Apr. 12, 2006; 60/791,513, filed Apr. 12, 2006; 60/716,538, filed Sep. 12, 2005; and 60/802,921, filed May 23, 2006; and U.S. nonprovisional patent application Ser. No. 09/474,858, filed Dec. 30, 1999, and issued as U.S. Pat. No. 6,460,848 on Oct. 8, 2002; Ser. No. 09/849,456, filed May 4, 2001, and issued as U.S. Pat. No. 6,652,379 on Nov. 25, 2003; Ser. No. 09/790,480, filed Feb. 21, 2001, and issued as U.S. Pat. No. 6,685,568 on Feb. 3, 2004; Ser. No. 10/017,276, filed Dec. 13, 2001; Ser. No. 10/885,875, filed Jul. 7, 2004; Ser. No. 10/902,436, filed Jul. 29, 2004; Ser. No. 10/981,132, filed Nov. 3, 2004; Ser. No. 10/934,785, filed Sep. 2, 2004; and Ser. No. 10/823,051, filed Apr. 13, 2004, filed are incorporated herein by reference, in their entirety.

From the foregoing it will be appreciated that, although specific embodiments have been described herein for purposes of illustration, various modifications may be made without deviating from the spirit and scope of the teachings. Accordingly, the claims are not limited to the embodiments disclosed.

We claim:

1. A gaming system, comprising:

an input device operable to receive selections indicative of at least one of a set of house odds or a house advantage for at least one hand to be played by at least one player of a card game; and a playing card handling system comprising a playing card input receiver, a playing card output receiver, at least one playing card transport path between the playing card input receiver and the playing card output receiver, and at least a first intermediary playing card receiver interposed in the at least one playing card transport path between the playing card input receiver and the playing card output receiver, the first intermediary playing card receiver having a plurality of playing card receiving receptacles, the playing card handling system responsive to the selections received at the input device to provide the at least one hand of playing cards as subsets of playing cards, each subset of playing cards forming a hand of playing cards, where the playing cards forming the at least one hand correspond to at least one set of virtual playing card values pseudo-randomly generated based at least in part on the received selections indicative of the at least one of the set of house odds or the house advantage, wherein the at least one of the set of house odds or the house advantage includes corresponding different house odds or a different house advantage for a particular player position to which the subset of cards is to be dealt during a round of play than another player position to which a different subset of the subsets of playing cards is to be dealt during the same round of play.

2. The gaming system of claim 1 wherein the selections received by the input device identify house advantages for respective hands of playing cards, and wherein the at least one set of virtual playing card values is pseudo-randomly generated based at least in part based on the respective house advantage.

3. The gaming system of claim 1 wherein the selections received by the input device are indicative of respective sets of house odds, and wherein the at least one set of virtual playing card values is pseudo-randomly generated at least in part based on a respective house advantage indicated by a respective one of the sets of house odds.

4. The gaming system of claim 1 wherein the input device is positioned at a gaming table within three feet of a dealer position.

5. The gaming system of claim 1 wherein the input device is positioned at a gaming table within two feet of a participant other than a dealer.

6. The gaming system of claim 1 wherein the playing card handling system comprises at least one processor configured to generate the sequences of virtual playing card values based at least in part on selections received at the input device and wherein the playing cards are removed from the playing card receiving compartments of the first intermediary playing card receiver in an order based at least in part on the sequence of virtual playing card values.

7. The gaming system of claim 1 wherein the playing card handling system comprises at least one processor configured to generate the sequence of virtual playing card values based at least in part on selections received at the input device and wherein the playing cards are placed in the compartments of the first intermediary playing card receiver in an order based at least in part on the sequence of virtual playing card values.

8. The gaming system of claim 1 wherein the playing card handling device further comprises at least a second intermediary playing card receiver having a plurality of playing card receiving compartments, at least a second playing card transport path extending from the second intermediary playing card receiver to the first intermediary playing card receiver.

9. A method of operating a gaming system, the method comprising:

receiving, by at least one computer processor, selections indicative of at least one of a set of house odds or a house advantage for at least one hand to be played by at least one player of a card game; and controlling, by at least one computer processor, transport of a plurality of playing cards with respect to at least one intermediary playing card receiver comprising a plurality of playing card receiving compartments to provide the at least one hand of playing cards as subsets of playing cards, each subset of playing cards forming a hand of playing cards, where the playing cards forming the at least one hand correspond to a set of virtual playing card values pseudo-randomly generated at least in part based on the received selection indicative of at least one of the set of house odds or the house advantage, wherein the at least one of the set of house odds or the house advantage includes corresponding different house odds or a different house advantage for a particular player position to which the subset of playing cards is to be dealt during a round of play than another player position to which a different subset of the subsets of playing cards is to be dealt during the same round of play.

10. The method of claim 9 wherein receiving selections indicative of at least one of a set of house odds or a house advantage for at least one hand to be played by at least one player of a card game includes receiving a set of house odds selected by a player.

11. The method of claim 9, further comprising:

determining a total number of playing card values from which the set of virtual playing card will be generated from based on the received selection; and pseudo-randomly generating the set of virtual playing card values from the number of playing card values.

12. The method of claim 11 wherein pseudo-randomly generating the set of virtual playing card values from the number of playing card values includes pseudo-randomly generating the set of virtual playing card values from an integer multiple of fifty-two playing card values corresponding to respective ones of playing cards in a standard deck of playing cards.

13. The method of claim 9, further comprising:

determining a domain of playing card values from which the set of virtual playing card values will be generated from based on the received selection; and pseudo-randomly generating the set of virtual playing card values from the domain of playing card values.

14. The method of claim 13 wherein pseudo-randomly generating the set of virtual playing card values from the domain of playing card values includes pseudo-randomly generating the set of virtual playing card values from a non-integer multiple of fifty-two playing card values.

15. The method of claim 9 wherein controlling transport of a plurality of playing cards with respect to at least one intermediary playing card receiver to provide the at least one hand of playing cards includes placing playing cards into respective ones of the playing card receiving compartments of the at least one intermediary playing card receiver based on the set of virtual playing card values that are pseudo-randomly generated.

16. The method of claim 9 wherein controlling transport of a plurality of playing cards with respect to at least one intermediary playing card receiver to provide the at least one hand of playing cards includes retrieving playing cards from respective ones of the playing card receiving compartments of the at least one intermediary playing card receiver based on the set of playing card values that are pseudo-randomly generated.

17. A non-transitory computer-readable medium stores instructions that causes a computer to operate a gaming system, by:

receiving selections indicative of at least one of a set of house odds or a house advantage for at least one hand to be played by at least one player of a card game; and controlling transport of a plurality of playing cards with respect to at least one intermediary playing card receiver comprising a plurality of playing card receiving compartments to provide the at least one hand of playing cards as subsets of playing cards, each subset of playing cards forming a hand of playing cards, where the playing cards forming the at least one hand correspond to a set of virtual playing card values pseudo-randomly generated at least in part based on the received selection indicative of at least one of the set of house odds or the house advantage, wherein the at least one of the set of house odds or the house advantage includes corresponding different house odds or a different house advantage for a particular player position to which the subset of playing cards is to be dealt during a round of play than another player position to which a different subset of the subsets of playing cards is to be dealt during the same round of play.

18. The non-transitory computer-readable medium of claim 17 wherein receiving selections indicative of at least one of a set of house odds or a house advantage for at least one hand to be played by at least one player of a card game includes receiving a signal indicative of a set of house odds selected by a player.

19. The non-transitory computer-readable medium of claim 17 wherein the instructions cause the computer to operate the gaming system further by:

determining a total number of playing card values from which the set of virtual playing card values will be generated from based on the received selection; and pseudo-randomly generating the set of virtual playing card values from the number of playing card values.

20. The non-transitory computer-readable medium of claim 19 wherein pseudo-randomly generating the set of virtual playing card values from the number of playing card values includes pseudo-randomly generating the set of virtual playing card values from an integer multiple of fifty-two playing card values corresponding to respective ones of playing cards in a standard deck of playing cards.

21. The non-transitory computer-readable medium of claim 17 wherein the instructions cause the computer to operate the gaming system further by:

determining a domain of playing card values from which the set of virtual playing card values will be generated from based on the received selection; and pseudo-randomly generating the set of virtual playing card values from the domain of playing card values.

22. The non-transitory computer-readable medium of claim 21 wherein pseudo-randomly generating the set of virtual playing card values from the domain of playing card values includes pseudo-randomly generating the set of virtual playing card values from a non-integer multiple of fifty-two playing card values.

23. The non-transitory computer-readable medium of claim 17 wherein controlling transport of a plurality of playing cards with respect to at least one intermediary playing card receiver to provide the at least one hand of playing cards includes automatically placing playing cards into respective ones of the playing card receiving compartments based on the set of virtual playing card values that are pseudo-randomly generated.

24. The non-transitory computer-readable medium of claim 17 wherein controlling transport of a plurality of playing cards with respect to at least one intermediary playing card receiver to provide the at least one hand of playing cards includes automatically retrieving playing cards from respective ones of the playing card receiving compartments based on the set of virtual playing card values that are pseudo-randomly generated.

25. A playing card handling system, comprising:

a playing card input receiver sized and dimensioned to receive a plurality of collected playing cards;

a playing card output receiver sized and dimensioned to receive a plurality of randomized playing cards;

at least a first playing card transport path extending between the playing card input receiver and the playing card output receiver; and a first intermediary playing card receiver interposed in the first playing card transport path between the playing card input receiver and the playing card output receiver, the first intermediary playing card receiver selectively removable from the first playing card transport path, wherein the playing card handling system is operable to provide at least one of a set of house odds or a house advantage that includes corresponding different house odds or a different house advantage for a particular player position to which a subset of cards is to be dealt from the playing card handling system during a round of play than another player position to which a different subset of the subsets of playing cards is to be dealt from the card handling system during the sane round of play.

26. The playing card handling system of claim 25 wherein the playing card output receiver comprises a rectangular cartridge having at least one open side.

27. The playing card handling system of claim 25, further comprising:

a frame;

a motor coupled to the frame; and a linkage physically coupling the motor to the playing card output receiver, wherein the motor is operable to vertically translate the playing card output receiver with respect to a frame via the linkage.

28. The playing card handling system of claim 25 wherein the first intermediary playing card receiver is a carousel comprising an endless array of playing card receiving compartments, each of the playing card receiving compartments sized to receive one playing card.

29. The playing card handling system of claim 28, further comprising:

a second playing card transport path between the playing card input receiver and the playing card output receiver; and a second intermediary playing card receiver interposed in the second playing card transport path between the playing card input receiver and the playing card output receiver, the second intermediary playing card receiver selectively removable from the second playing card transport path.

30. The playing card handling system of claim 28 wherein the first intermediary playing card receiver is pivotally mounted for movement about a first vertical axis, the first vertical axis approximately vertical with respect a gravitational effect when the playing card handling system is in use.

31. The playing card handling system of claim 28, further comprising:

a second playing card transport path between the playing card input receiver and the playing card output receiver; and a second intermediary playing card receiver interposed in the second playing card transport path between the playing card input receiver and the playing card output receiver, the second intermediary playing card pivotally mounted for movement about a second vertical axis, the second vertical axis approximately vertical with respect a gravitational effect when the playing card handling system is in use.

32. The playing card handling system of claim 25 wherein the first and the second vertical axes are coaxial.

33. The playing card handling system of claim 25, further comprising:

an input sensor positioned to sense an identity of each of the collected playing cards as the collected playing cards move along the first playing card transport path to the first intermediary card receiver;

a playing card discharge device operable to selectively remove playing cards from the playing card receiving compartments of the first intermediary playing card receiver; and a processor communicatively coupled to receive signals from the input sensor and communicatively coupled to control the playing card discharge device based at least in part on the received signals and at least in part on randomly generated numbers.

34. A method of operating a playing card handling system comprising a playing card input receiver, a playing card output receiver, at least a first playing card transport path extending between the playing card input receiver and the playing card output receiver, and at least a first intermediary playing card receiver comprising a plurality of playing card receiving compartments, the method comprising:

loading playing cards into the card receiving compartments of the first intermediary playing card receiver;

selectively interposing the first intermediary playing card receiver in the first playing card transport path between the playing card input receiver and the playing card output receiver;

activating the playing card handling system to provide randomized playing cards to the playing card output receiver; and selectively removing the first intermediary playing card receiver from the first playing card transport path; and, using the playing card handling system, providing at least one of a set of house odds or a house advantage that includes corresponding different house odds or a different house advantage for a particular player position to which a subset of cards is to be dealt from the playing card handling system during a round of play than another player position to which a different subset of the subsets of playing cards is to be dealt from the card handling system during the same round of play.

35. The method of claim 34, further comprising:

removing the randomized playing cards from the playing card output receiver; and dealing the randomized playing cards to at least one player.

36. The method of claim 34, further comprising:

collecting discarded playing cards from at least one player; and placing the collected discarded playing cards in the playing card input receiver.

37. A playing card handling system, comprising:

a playing card input receiver;

a playing card output receiver;

at least one playing card transport path extending between the playing card input receiver and the playing card output receiver;

a first intermediary playing card receiver disposed between the playing card input receiver and the playing card output receiver in the at least one playing card transport path, the first intermediary playing card receiver comprising a plurality of playing card receiving compartments, the plurality of playing card receiving compartments of the first intermediary playing card receiver physically coupled for movement together; and a second intermediary playing card receiver disposed between the playing card input receiver and the playing card output receiver in the at least one playing card transport path, the second intermediary playing card receiver comprising a plurality of playing card receiving compartments, the plurality of playing card receiving compartments of the second intermediary playing card receiver physically coupled for movement together, wherein at least one of the first and the second intermediary playing card receivers is selectively removable and wherein the playing card handling system is operable to provide at least one of a set of house odds or a house advantage that includes corresponding different house odds or a different house advantage for a particular player position to which a subset of cards is to be dealt from the playing card handling system during a round of play than another player position to which a different subset of the subsets of playing cards is to be dealt from the card handling system during the same round of play.

38. The playing card handling system of claim 37, further comprising:

a processor configured to control placement of playing cards into the playing card receiving compartments of the first and the second intermediary playing card receivers.

39. The playing card handling system of claim 37, further comprising:

a processor configured to load playing cards into the playing card receiving compartments of the first intermediary playing card receiver at a first period, and to load playing cards into the playing card receiving compartments of the second intermediary playing card receiver during a second period, different than the first period.

40. The playing card handling system of claim 37, further comprising:

a processor configured to load playing cards into the playing card receiving compartments of the first intermediary playing card receiver at a first period, and to unload playing cards from the playing card receiving compartments of the second intermediary playing card receiver during the first period.

41. The playing card handling system of claim 37, further comprising:

an input sensor positioned to sense an identity of each of the collected playing cards as the collected playing cards move along the at least one playing card transport path toward at least one of the first and the second intermediary card receivers;

a playing card discharge device operable to selectively remove playing cards from the playing card receiving compartments of the first intermediary playing card receiver; and a processor communicatively coupled to receive signals from the input sensor and communicatively coupled to control the playing card discharge device to unload the playing cards from the playing card receiving compartments based at least in part on randomly generated numbers.

42. The playing card handling system of claim 37, further comprising:

an input sensor positioned to sense an identity of each of the collected playing cards as the collected playing cards move along the at least one playing card transport path toward at least one of the first and the second intermediary card receivers;

a playing card discharge device operable to selectively remove playing cards from the playing card receiving compartments of the first intermediary playing card receiver; and a processor communicatively coupled to receive signals from the input sensor and communicatively coupled to control loading of the playing cards to the playing card receiving compartments based at least in part on randomly generated numbers.

43. The playing card handling system of claim 37, further comprising:

a frame;

a motor coupled to the frame; and a linkage physically coupling the motor to the playing card output receiver, wherein the motor is operable to vertically translate the playing card output receiver with respect to a frame via the linkage.

44. The playing card handling system of claim 37 wherein the first intermediary playing card receiver is a carousel comprising an endless array of the playing card receiving compartments, each of the playing card receiving compartments sized to receive a playing card.

45. The playing card handling system of claim 37 wherein the first and the second intermediary playing card receivers are pivotally mounted for movement about a first vertical axis.

46. A method of operating a playing card handling system comprising a playing card input receiver, a playing card output receiver, at least one playing card transport path extending between the playing card input receiver and the playing card output receiver, a first intermediary playing card receiver comprising a plurality of playing card receiving compartments physically coupled to move in unison with one another, and a second intermediary playing card receiver comprising a plurality of playing card receiving compartments physically coupled to move in unison with one another, independently of the playing card receiving compartments of the first intermediary playing card receiver, the method comprising, under control of a computer processor:

loading playing cards from the playing card input receiver into the playing card receiving compartments of the first intermediary playing card receiver;

unloading playing cards from the playing card receiving compartments of the first intermediary playing card receiver to the playing card output receiver;

loading playing cards from the playing card input receiver into the playing card receiving compartments of the second intermediary playing card receiver;

unloading playing cards from the playing card receiving compartments of the second intermediary playing card receiver to the playing card output receiver; and translating the playing card output receiver to deliver a set of randomized playing cards collected therein, the set forming an individual hand of playing cards, the individual hand of playing cards being formed based on a selection of at least one of a set of house odds or a house advantage for a particular player position to which the individual hand is to be dealt during a round of play different than corresponding house odds or a corresponding house advantage selected for another player position to which a different hand of the of playing cards is to be dealt during the same round of play.

47. The method of claim 46 wherein loading playing cards from the playing card input receiver into the playing card receiving compartments of the first intermediary playing card receiver occurs during a first period and loading playing cards from the playing card input receiver into the playing card receiving compartments of the second intermediary playing card receiver occurs during a second period, different from the first period.

48. The method of claim 46 wherein loading playing cards from the playing card input receiver into the playing card receiving compartments of the first intermediary playing card receiver during a first period and unloading playing cards from the playing card receiving compartments of the second intermediary playing card receiver to the playing card output receiver occurs during the first period.

49. The method of claim 46 wherein loading playing cards from the playing card input receiver into the playing card receiving compartments of the first intermediary playing card receiver comprises loading playing cards from the playing card input receiver into randomly selected ones of the playing card receiving compartments of the first intermediary playing card receiver.

50. The method of claim 46 wherein unloading playing cards from the playing card receiving compartments of the first intermediary playing card receiver to the playing card output receiver comprises unloading playing cards from randomly selected ones of the playing card receiving compartments of the first intermediary playing card receiver.

51. The method of claim 46 further comprising:

automatically reading identifying information from the playing cards at a point between the playing card input receiver and the playing card output receiver.

52. The method of claim 46 further comprising:

automatically reading identifying information from the playing cards as the playing cards move along the at least one playing card transport path between the playing card input receiver one of the first and the second playing card intermediary receivers.

53. The method of claim 46, further comprising:

pivoting the first intermediary playing card receiver about a first vertically extending axis.

54. The method of claim 46, further comprising:

bi-directionally pivoting the first intermediary playing card receiver about a first vertically extending axis.

55. The method of claim 54, further comprising:

bi-directionally pivoting the second intermediary playing card receiver about a second vertically extending axis.

56. The method of claim 54, further comprising:

bi-directionally pivoting the second intermediary playing card receiver about the first vertically extending axis.

57. A playing card handling system, comprising:

a playing card input receiver;

a playing card output receiver;

at least one playing card transport path extending between the playing card input receiver and the playing card output receiver;

a first intermediary playing card receiver disposed between the playing card input receiver and the playing card output receiver in the at least one playing card transport path, the first intermediary playing card receiver comprising a plurality of playing card receiving compartments, the plurality of playing card receiving compartments of the first intermediary playing card receiver physically coupled for movement together about a first vertical axis; and a second intermediary playing card receiver disposed between the playing card input receiver and the playing card output receiver in the at least one playing card transport path, the second intermediary playing card receiver comprising a plurality of playing card receiving compartments, the plurality of playing card receiving compartments of the second intermediary playing card receiver physically coupled for movement together about a second vertical axis, wherein the playing card handling system is operable to provide at least one of a set of house odds or a house advantage that includes corresponding different house odds or a different house advantage for a particular player position to which a subset of cards is to be dealt from the playing card handling system during a round of play than another player position to which a different subset of the subsets of playing cards is to be dealt from the card handling system during the same round of play.

58. The playing card handling system of claim 57 wherein the first intermediary playing card receiver is a first carousel comprising an endless array of the playing card receiving compartments, each of the playing card receiving compartments sized to receive one playing card, and wherein the second intermediary playing card receiver is a second carousel comprising an endless array of the playing card receiving compartments, each of the playing card receiving compartments sized to receive one playing card, wherein at least one of the first and the second intermediary playing card receivers is selectively removable.

59. The playing card handling system of claim 57 wherein the first and the second vertical axes are coaxial.

60. The playing card handling system of claim 57, further comprising:

a frame;

a motor coupled to the frame; and a linkage physically coupling the motor to the playing card output receiver, wherein the motor is operable to vertically translate the playing card output receiver with respect to a frame via the linkage.

61. The playing card handling system of claim 57, further comprising:

an input sensor positioned to sense an identity of each of a plurality of playing cards at a position along the at least one playing card transport path between the playing card input receiver and at least one of the first and the second intermediary card receivers.

62. The playing card handling system of claim 57, further comprising:

a processor configured to control placement of playing cards into the playing card receiving compartments of the first and the second intermediary playing card receivers.

63. The playing card handling system of claim 57, further comprising:

a processor configured to load playing cards into the playing card receiving compartments of the first intermediary playing card receiver at a first period, and to load playing cards into the playing card receiving compartments of the second intermediary playing card receiver during a second period, different than the first period.

64. The playing card handling system of claim 57, further comprising:

a processor configured to load playing cards into the playing card receiving compartments of the first intermediary playing card receiver at a first period, and to unload playing cards from the playing card receiving compartments of the second intermediary playing card receiver during the first period.

* * * * *